US010961779B2

(12) United States Patent
Langenfeld et al.

(10) Patent No.: US 10,961,779 B2
(45) Date of Patent: Mar. 30, 2021

(54) DUAL ROD DIRECTIONAL DRILLING SYSTEM

(71) Applicant: Vermeer Manufacturing Company, Pella, IA (US)

(72) Inventors: Michael D. Langenfeld, Pella, IA (US); Jacob Richard Smith, Atloona, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 16/936,703

(22) Filed: Jul. 23, 2020

(65) Prior Publication Data

US 2020/0362635 A1 Nov. 19, 2020

Related U.S. Application Data

(63) Continuation of application No. 15/967,965, filed on May 1, 2018.

(60) Provisional application No. 62/492,818, filed on May 1, 2017, provisional application No. 62/530,610, filed on Jul. 10, 2017, provisional application No. (Continued)

(51) Int. Cl.

| | |
|---|---|
| ***E21B 3/00*** | (2006.01) |
| ***E21B 17/18*** | (2006.01) |
| ***E21B 7/04*** | (2006.01) |
| ***E21B 7/06*** | (2006.01) |
| ***E21B 17/02*** | (2006.01) |
| ***E21B 7/02*** | (2006.01) |
| ***E21B 17/07*** | (2006.01) |
| ***E21B 19/16*** | (2006.01) |
| ***E21B 17/046*** | (2006.01) |

(52) U.S. Cl.

CPC ..... *E21B 3/00* (2013.01); *E21B 7/02* (2013.01); *E21B 7/046* (2013.01); *E21B 7/062* (2013.01); *E21B 17/02* (2013.01); *E21B 17/046* (2013.01); *E21B 17/07* (2013.01); *E21B 17/18* (2013.01); *E21B 19/16* (2013.01)

(58) Field of Classification Search

None

See application file for complete search history.

(56) References Cited

U.S. PATENT DOCUMENTS 1,274,254 A 7/1918 Fleek
2,760,358 A 8/1956 Helm et al.
(Continued)

FOREIGN PATENT DOCUMENTS

CN 104499957 A 4/2015
CN M4729005 U 10/2015
(Continued)

OTHER PUBLICATIONS

European Patent Office Search Report for Application No. 18170061.8 dated Feb. 21, 2018 (8 pages).
(Continued)

*Primary Examiner* — Giovanna Wright
*Assistant Examiner* — Yanick A Akaragwe
(74) *Attorney, Agent, or Firm* — Michael Best and Friedrich LLP

(57) ABSTRACT

A coupler includes a main body that has an inner bore. The inner bore has a non-circular profile and a longitudinal axis. The coupler includes a cross aperture disposed in the main body. The cross aperture has an axis that is nonintersecting with the longitudinal axis of the main body.

20 Claims, 58 Drawing Sheets

Related U.S. Application Data

62/530,616, filed on Jul. 10, 2017, provisional application No. 62/530,642, filed on Jul. 10, 2017, provisional application No. 62/566,971, filed on Oct. 2, 2017, provisional application No. 62/567,624, filed on Oct. 3, 2017.

(56) References Cited

U.S. PATENT DOCUMENTS

| | | | |
|---|---|---|---|
| 3,142,972 | A | 8/1964 | Spaulding, Jr. |
| 3,260,541 | A | 7/1966 | Sadler et al. |
| 3,360,285 | A | 12/1967 | Huckshold |
| 3,940,946 | A | 3/1976 | Andersen |
| 4,378,057 | A | 3/1983 | O'Connell |
| 4,397,485 | A | 8/1983 | Wood |
| 4,622,022 | A | 11/1986 | Diffenderfer et al. |
| 4,732,223 | A | 3/1988 | Schoeffier et al. |
| 4,772,246 | A | 9/1988 | Wenzel |
| 4,824,418 | A | 4/1989 | Taubert |
| 5,288,271 | A | 2/1994 | Nelson et al. |
| 5,408,905 | A | 4/1995 | Mikic et al. |
| 5,484,029 | A | 1/1996 | Eddison |
| 5,490,569 | A | 2/1996 | Brotherton et al. |
| 6,173,794 | B1 | 1/2001 | von Gynz-Rekowski et al. |
| 6,494,495 | B1 | 12/2002 | Cunningham |
| RE38,418 | E | 2/2004 | Deken et al. |
| 7,469,524 | B2 | 12/2008 | Rieck et al. |
| 7,624,819 | B1 | 12/2009 | LeBlanc et al. |
| 7,694,753 | B2 | 4/2010 | Carlson et al. |
| 7,770,659 | B2 | 8/2010 | Uelhoff et al. |
| 8,062,140 | B2 | 11/2011 | Wall et al. |
| 8,201,644 | B2 | 6/2012 | Hall et al. |
| 8,322,460 | B2 | 12/2012 | Horton et al. |
| 8,534,388 | B2 | 9/2013 | Hall et al. |
| 8,650,992 | B2 | 2/2014 | Neitzell et al. |
| 8,915,788 | B2 | 12/2014 | Foote et al. |
| 9,366,087 | B2 | 6/2016 | Sugiura et al. |
| 9,382,950 | B2 | 7/2016 | Pheasey et al. |
| 9,556,691 | B2 | 1/2017 | Van Zee et al. |
| 9,598,905 | B2 | 3/2017 | Van Zee et al. |
| 9,890,880 | B2 | 2/2018 | Allin |
| 10,364,611 | B2 | 7/2019 | Lubberger et al. |
| 2004/0069517 | A1 | 4/2004 | Olson |
| 2007/0054743 | A1 | 3/2007 | Pleyer |
| 2007/0272444 | A1 | 11/2007 | Carlson et al. |
| 2008/0083077 | A1 | 4/2008 | Alexander et al. |
| 2009/0298597 | A1 | 12/2009 | Wall et al. |
| 2010/0044113 | A1 | 2/2010 | LeBlanc et al. |
| 2012/0141194 | A1 | 6/2012 | Rutledge, Sr. et al. |
| 2013/0207381 | A1 | 8/2013 | Morrison et al. |
| 2014/0027184 | A1 | 1/2014 | Slaughter, Jr. et al. |
| 2014/0224545 | A1 | 8/2014 | Nicol-Seto |
| 2014/0305709 | A1 | 10/2014 | Slaughter, Jr. et al. |
| 2014/0353045 | A1 | 12/2014 | Zhang et al. |
| 2015/0167399 | A1 | 6/2015 | Kuhn et al. |
| 2015/0197995 | A1 | 7/2015 | Gil et al. |
| 2015/0233192 | A1 | 8/2015 | Slaughter, Jr. et al. |
| 2016/0245025 | A1 | 8/2016 | Slaughter, Jr. et al. |

FOREIGN PATENT DOCUMENTS

| | | | |
|---|---|---|---|
| CN | 204754796 | U | 11/2015 |
| CN | 105863511 | A | 8/2016 |
| DE | 1909931 | A1 | 9/1969 |
| DE | 19527990 | C1 | 8/1996 |
| DE | 19906687 | A1 | 8/2000 |
| EP | 0190669 | A2 | 8/1986 |
| EP | 0851090 | A1 | 7/1998 |
| EP | 2157277 | A1 | 2/2010 |
| EP | 2505762 | A2 | 10/2012 |
| GB | 1030984 | A | 5/1966 |
| GB | 2492695 | B | 11/2017 |
| WO | 9630616 | A1 | 10/1996 |
| WO | 1999064712 | A1 | 12/1999 |
| WO | 2010021999 | A2 | 2/2010 |
| WO | 2011146490 | A1 | 11/2011 |
| WO | 2013159153 | A1 | 10/2013 |
| WO | 2013173785 | A1 | 11/2013 |
| WO | 2016043719 | A1 | 3/2016 |
| WO | 2016149183 | A1 | 9/2016 |
| WO | 2017135929 | A1 | 8/2017 |

OTHER PUBLICATIONS

Upstream Pumping, "Directional Drilling Motors Evolve for Demanding Downhole Environments", May/Jun. 2015, (http://www.upstreampumping.com/article/drilling/2015/directional-drilling-motors>, (6 pages).

Bahco, "Screwdriver Catalogue", Ergo Screwdrivers, Hexagonal, Hex Ball Double Handle, 2016, cover, pp. 20-21.

Terra Trenchless Technologies, "Hdd Horizontal Directional Drilling" Product List, Rod Connectors (Drive Chucks), Sub Savers, Drill Rod Connector 170/API-36pin (MJLV), Mar. 22, 2017 (1 pages).

ChinA-ogpe.com, Product Directory, Oil Field Tool, Other Oil Field Tools, taper drill rod (flr032), Mar. 3, 2017 (2 pages).

Zen Cart the Art of E-Commerce, "Rineer M057 Hydraulic Rotary Heard" Product Information, Mar. 22, 2017 (3 pages).

CMW, "JT4020 Mach 1/All Terrain" Operators Manual, Issue 5.1, 2011, pp. Service—202, 210, 221 (229 pages).

First Office action issued from the China Patent Office for related Application No. 201810413314.2 dated Jan. 26, 2021 (14 pages including English translation).

DUAL ROD DIRECTIONAL DRILLING SYSTEM

CROSS-REFERENCE TO RELATED APPLICATIONS

This application is a continuation of U.S. application Ser. No. 15/967,965 filed May 1, 2018, which claims the benefit of U.S. Provisional Patent Application No. 62/492,818, filed May 1, 2017; 62/530,610, filed Jul. 10, 2017; 62/530,616, filed Jul. 10, 2017; 62/530,642, filed Jul. 10, 2017; 62/566,971, filed Oct. 2, 2017; and 62/567,624 filed Oct. 3, 2017, which applications are hereby incorporated by reference in their entireties.

BACKGROUND

Dual drill rod drilling systems ("dual rod") for use in directional drilling having an inner rod and an outer rod are known. A typical dual rod drilling system is generally configured to drive into the ground a series of drill rods joined end-to-end to form a drill string. At the end of the drill string is a rotating drilling tool or drill bit. A dual rod drilling system typically includes a first drive mechanism that controls rotation of a drill bit and a second drive mechanism that controls rotation of a steering element. When a straight hole is drilled with a dual rod drilling system, the first and second drive mechanisms are concurrently operated such that both the drill bit and the steering element are rotated as the drill string is thrust into the ground. When a directional change is needed, because the steering element is axially misaligned with the drill string, the drive mechanism that controls the steering element is stopped and the drill string is thrust further into the ground while the drive mechanism that controls the drill bit is rotated. This causes the drill bit to deviate from a straight path and follow the direction dictated by the steering element.

Dual rod drilling systems also use drilling fluid that is passed internally within the drill rods for cooling of the drill bit and also for transporting cuttings within the drill hole. Therefore, to ensure proper operation, it is important to reduce obstructions within the drilling fluid flow path. However, this can be difficult due to the unavoidable relative longitudinal offsets between inner and outer drill rods within the drill string.

Further, the inner and outer drill rods of each drill rod assembly can have variations in length resulting from manufacturing tolerances. Because of the length variations, drill rod assemblies are designed such that the overall length of interconnected inner drill rods are never longer than the overall length of interconnected outer drill rods. If the interconnected inner drill rods were longer than the outer drill rods, the inner rods would collide while the outer drill rods were being coupled together, causing damage to one or both of the inner and outer drill rods. Accordingly, by design, the length of interconnected inner drill rods is slightly less than the length of interconnected outer drill rods. However, this design requirement results in a situation where certain portions of the drill string, e.g., the inner drill rods, contact the outer drill rods and obstruct the fluid flow path. This results in being able to send less drilling fluid to the drill head and/or possible damage to portions of the drill string. Therefore, improvements in maintaining an open drilling fluid flow path are needed.

To drive the drill bit with the first drive mechanism, flexible and/or bent drive shafts have been used in order to allow steering and still facilitate torque transfer. Other designs have used a coupling (sometimes referred to as a "transmission") so as to allow misalignment between a straight drill bit shaft and a straight drive shaft. However, such a coupling, or transmission, has traditionally included several components and required separate lubrication and isolation from the drilling fluid, thus complicating manufacture and maintenance. Therefore, improvements to the drill head of a dual rod drilling system are needed.

To drive the rotation of the drill string, a gearbox having a plurality of motors has traditionally been used. The gearbox can include a gear arrangement that transfers power from the plurality of motors to the inner and out drill rods of the dual rod drilling system. Drilling fluid has also been traditionally introduced at the gearbox to the drill string; however, isolating the drilling fluid from the internal components of the gearbox can be difficult. Further, should a malfunction occur and drilling fluid be introduced to the interior of the gearbox, due to the internal positioning of the gearbox components, it is difficult for an operator to realize this before the components of the gearbox are damaged. Therefore, improvements to the gearbox of a dual rod drilling system are needed.

SUMMARY

The present disclosure relates generally to a dual rod horizontal directional drilling system. In one possible configuration, and by non-limiting example, the horizontal directional drilling system includes a drill head that has a spherical hexagonal end having torque transmitting features and radial load bearing features. In another possible configuration, and by non-limiting example, the horizontal directional drilling system includes a drill string arrangement that includes at least one inner rod and at least one coupling that are together configured to provide an unobstructed fluid flow path within the drill string. In another possible configuration, and by non-limiting example, the horizontal directional drilling system includes a gearbox that includes a drilling fluid inlet at the rear of the gear box and a fluid weep indicator at the front of the gear box.

In one aspect of the present disclosure, a coupling system for a dual rod drilling system is disclosed. The coupling system includes a coupler that comprises an inner bore that has a non-circular profile and a longitudinal axis. The coupler also includes a cross aperture that has an axis that is perpendicular to the longitudinal axis, and the cross aperture has a first width. The coupling system includes an inner member that comprises a torque-carrying section that has a non-circular profile adapted to mate with the non-circular profile of the inner bore of the coupler. The inner member also includes a non-torque carrying portion that has a cross-sectional width that is smaller than a cross-sectional width of the inner bore of the coupler. The inner member also includes a groove positioned between the torque-carrying section and the non-torque carrying section. The groove has a width at least equal to the first width of the cross aperture of the coupler. The inner member also includes a pin positioned within the cross aperture of the coupler and within the groove of the inner member to secure the inner member at least partially within the coupler.

In another aspect of the present disclosure, a coupler for a drill rod is disclosed. The coupler includes a main body that has an inner bore. The inner bore has a non-circular profile and a longitudinal axis. The coupler includes a cross aperture disposed in the main body. The cross aperture has an axis that is nonintersecting with the longitudinal axis of the main body. The coupler also includes a sleeve that is positioned around an exterior surface of the main body. The sleeve has at least one drilling fluid flow passage.

In another aspect of the present disclosure, a drill rod is disclosed. The drill rod includes a torque-carrying section that has a non-circular profile. The torque-carrying section has a first cross-sectional width. The drill rod also includes a non-torque carrying portion that has a second cross-sectional width. The second cross-sectional width is less than the first cross-sectional width of the torque-carrying section. The drill rod also includes a groove positioned between the torque-carrying section and the non-torque carrying section.

In another aspect of the present disclosure, a drill rod assembly is disclosed. The drill rod assembly includes an outer drill rod assembly that has a shoulder and an inner drill rod assembly positioned at least partially inside the outer drill rod assembly. The inner drill rod assembly includes a sleeve. The sleeve is movable relative to the inner drill rod assembly upon receipt of a force exceeding a predetermined amount from the shoulder. The force is generally parallel with a longitudinal axis of the inner drill rod assembly.

In another aspect of the present disclosure, a drill rod assembly is disclosed. The drill rod assembly includes an outer drill rod assembly that includes a first shoulder at a first end and a second shoulder at a second end. The drill rod assembly includes an inner drill rod assembly that is positioned at least partially inside the outer drill rod assembly. The inner drill rod assembly includes a first and a second flow element, each positioned at first and second ends of the inner drill rod assembly, respectively. The first and second ends of the inner drill rod assembly correspond with the first and second ends of the outer drill rod assembly. The first and second flow elements each include at least one fluid flow passage, wherein fluid flow is permitted within an annular fluid flow passage defined between the inner and outer drill rod assemblies when either the first flow element is in contact with the first shoulder or the second flow element is in contact with the second shoulder.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
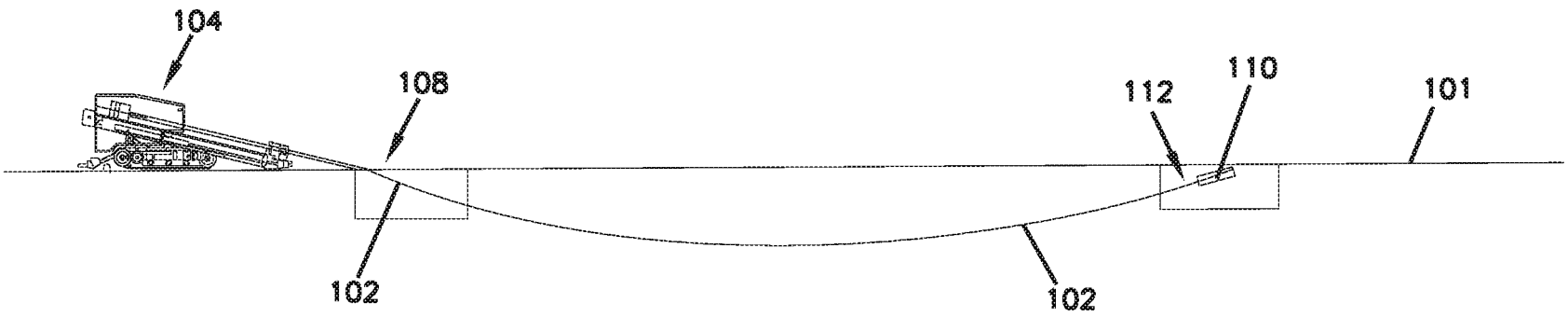
FIG. 1 illustrates a schematic side view of a drilling machine and a drill string, according to one embodiment of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Figure 2:
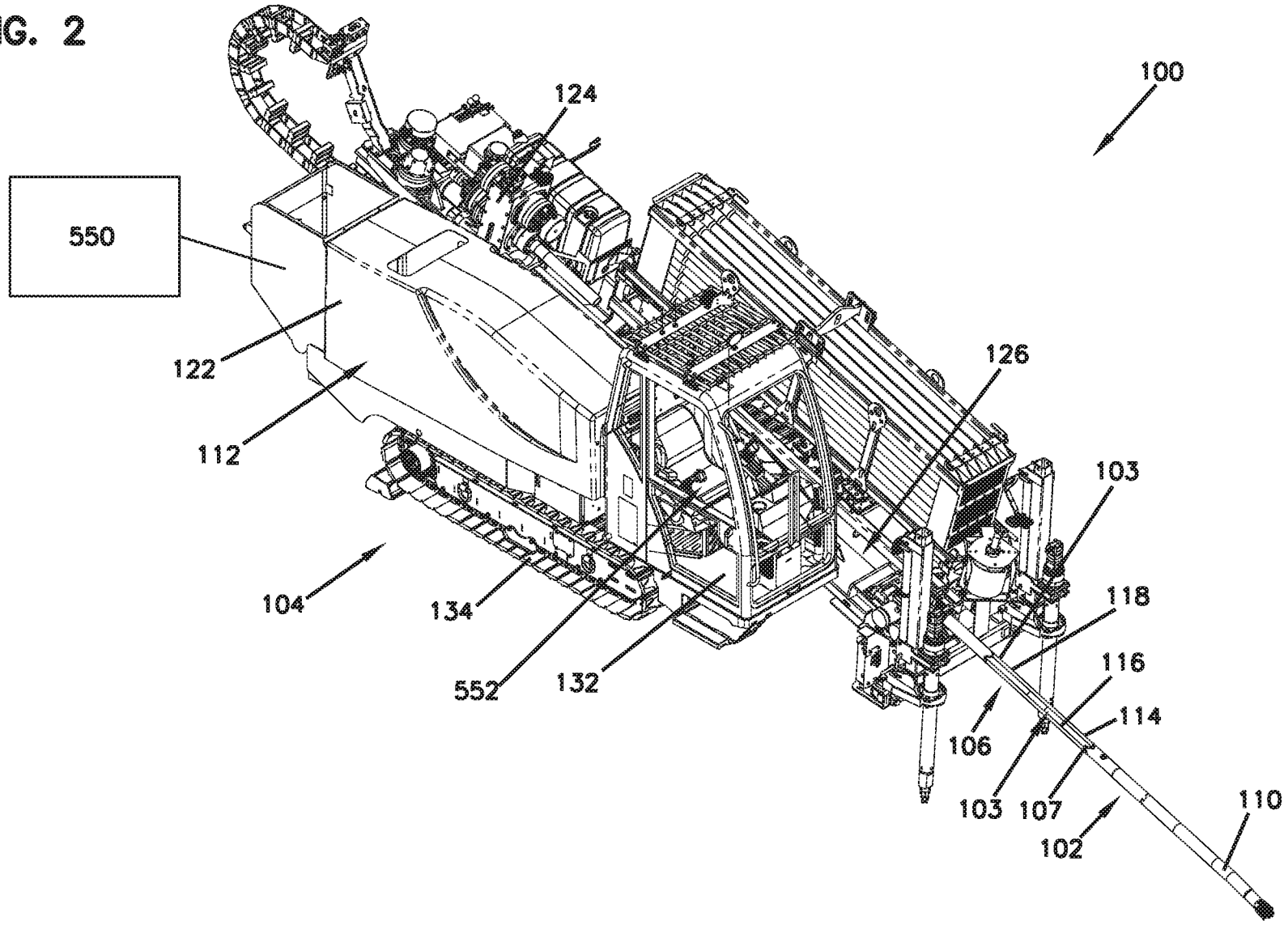
FIG. 2 illustrates a perspective view of a drilling machine, according to one embodiment of the present disclosure.
Figure 3:
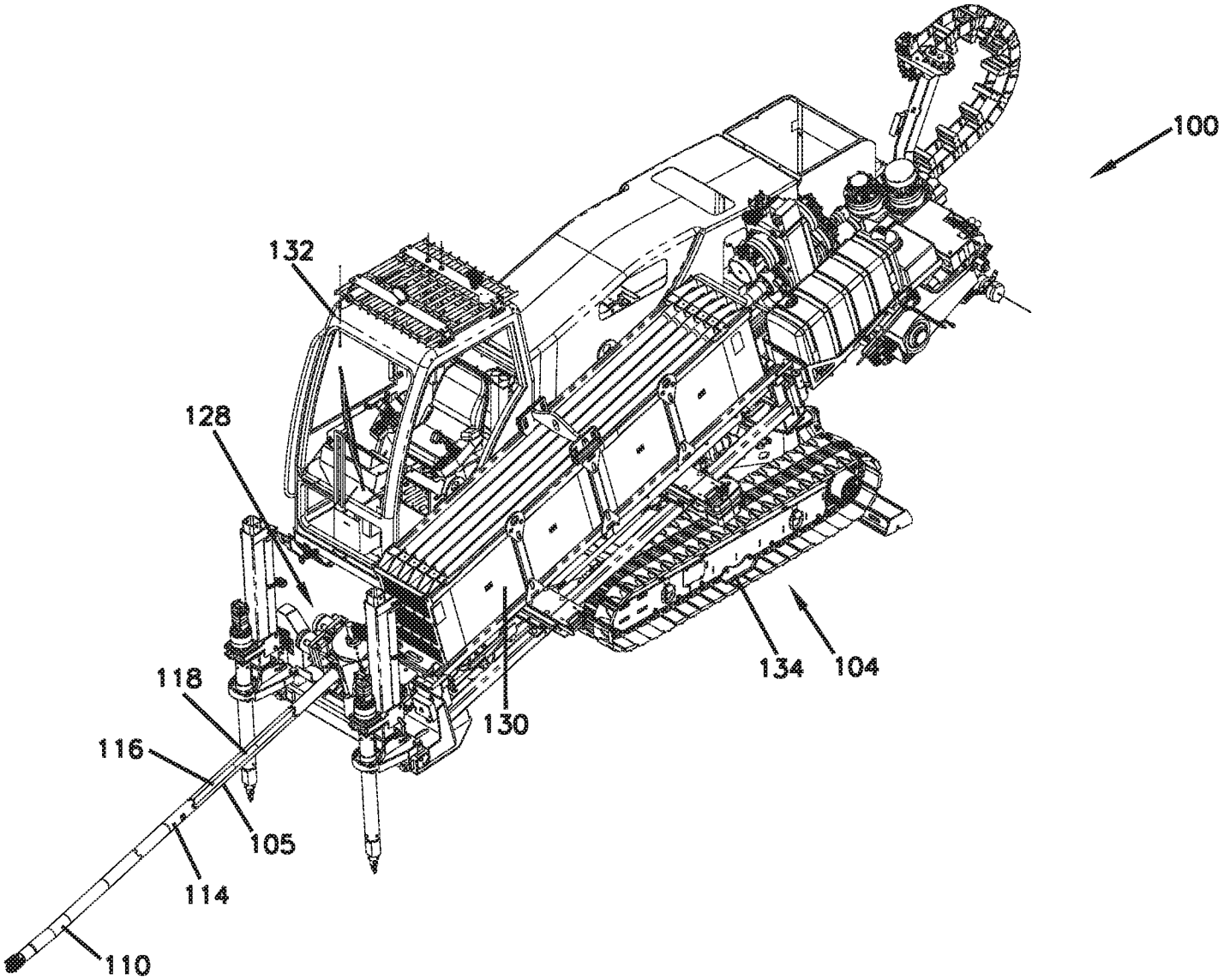
FIG. 3 illustrates another perspective view of the drilling machine of FIG. 2.

FIGS. 1-3 show a dual rod drilling system 100. The dual rod drilling system 100 includes a drill string 102 that is directed into the ground 101 by a drilling machine 104. An example drill string 102 is shown in FIG. 1.

The drilling machine 104 includes a prime mover 122 (e.g., a diesel engine), gearbox 124, a rack 126, and a break out mechanism 128 (e.g., a vise system). Optionally, the drilling machine 104 can include a drill rod storage box 130, an operator's station 132, and a set of tracks or wheels 134.

The drill string 102 consists of individual sections of drill rod assemblies 106 that are connected to the drilling machine 104 at an uphole end 108 and a drill head 110 at a downhole end 112. Each drill rod assembly 106 includes a downhole end 109 and an uphole end 111. The drill rod assemblies 106 are strung together end-to-end to form the drill string 102, which can extend significant distances in some drilling applications.

Each drill rod assembly 106 includes an outer tubular drill rod 114 having external threads on one end and internal threads on the opposite end. In some examples, the drill rod assembly 106, and the associated drilling machine 100, is configured so that, when the drill string 102 is constructed, the external threads of the outer drill rod 114 are positioned at the uphole end 111 of the drill rod assembly 106 and the internal threads of the outer drill rod 114 are positioned at the downhole end 111 of the drill rod assembly 106.

Each drill rod assembly 106 further includes a smaller, inner drill rod 116. The inner drill rod 116 fits inside the tubular outer drill rod 114. The inner drill rod 116 of each drill rod assembly is interconnected to the adjacent inner drill rods by an inner rod coupling 118. In some examples, each inner rod coupling 118 is affixed to each inner drill rod 116 at the uphole end 111 of each drill rod assembly 106 (shown in FIG. 5).

During a drilling operation, the drilling machine 104 individually removes drill rod assemblies 106 from the drill rod storage box 130 and moves each drill rod assembly 106 onto the rack 126. Once positioned on the rack 126, both the break out mechanism 128 and the gearbox 124 engage the drill rod assembly 106 and couple the drill rod assembly with an immediately preceding downhole drill rod assembly 106. Once coupled, the gearbox 124 is configured to travel longitudinally on the rack 126 toward the break out mechanism 128, while simultaneously rotating one or both of the outer and inner drill rods 114, 116 of the drill rod assembly 106. When the gearbox 124 reaches the break out mechanism 128 at the end of the rack 126, the gearbox 124 is de-coupled from the drill rod assembly 106, and thereby the drill string 102, and retracts up the rack 126 so that another drill rod assembly 106 can be added to the drill string 102. This process is repeated until the drilling operation is complete, and then reversed during a pullback operation in which the drilling machine 104 removes the drill rod assemblies 106 from the ground 101.

The dual rod drilling system 100 is operable to execute a plurality of software instructions that, when executed by the controller 550, cause the system 100 to implement the methods and otherwise operate and have functionality as described herein. In some examples, the controller 550 is in communication the prime mover 122, gearbox 124, rack 126, break out mechanism 128, operator's station 132 and/or other components of the system 100. The controller 550 may comprise a device commonly referred to as a microprocessor, central processing unit (CPU), digital signal processor (DSP), or other similar device, and may be embodied as a standalone unit or as a device shared with components of the system 100. The controller 550 may include memory for storing software instructions, or the system 100 may further comprise a separate memory device for storing the software instructions that is electrically connected to the controller 550 for the bi-directional communication of the instructions, data, and signals therebetween. In some examples, the controller 550 waits to receive signals from the operator's station 132 before communicating with and operating the components of the drilling machine 104. In other examples, the controller 550 can operate autonomously, without receiving signals from the operator's station 132, to communicate with and control the operation of the components of the drilling machine 104.

The operator's station 132 can be mounted to the drilling machine 104 to allow an operator to control the operation of the drilling machine 104. In some examples, the operator's station 132 includes a plurality of controls 552 with which the operator can interact to control the components of the drilling machine 104. In some examples, the controls 552 include joysticks, knobs, buttons, and the like. In some examples, the controls 552 can be in communication with the controller 550. In some examples, as the user interacts with the controls 552, the controls 552 generate a signal that is sent to the controller 550 that can indicate operations the user would like the drilling machine 104 to perform. Such operations can include, but not be limited to, separate rotation of the inner and outer drill rods 116 via the gearbox 124, movement of the gearbox 124 via the rack 126 on the drilling machine 104, and operation of the break out mechanism 128. In some examples, the controls 552 and controller 550 are an open loop system and there does not exist any feedback between the drilling machine 104's actual operation and the controller 550 and controls 552. In other examples, the controls 552 and controller 550 are a closed loop system and there exists feedback between the drilling machine 104's operation and the controller 550 and controls 552. In such a closed loop system, a plurality of sensors can be used to monitor the performance of the components of the drilling machine 104.

Figure 4:
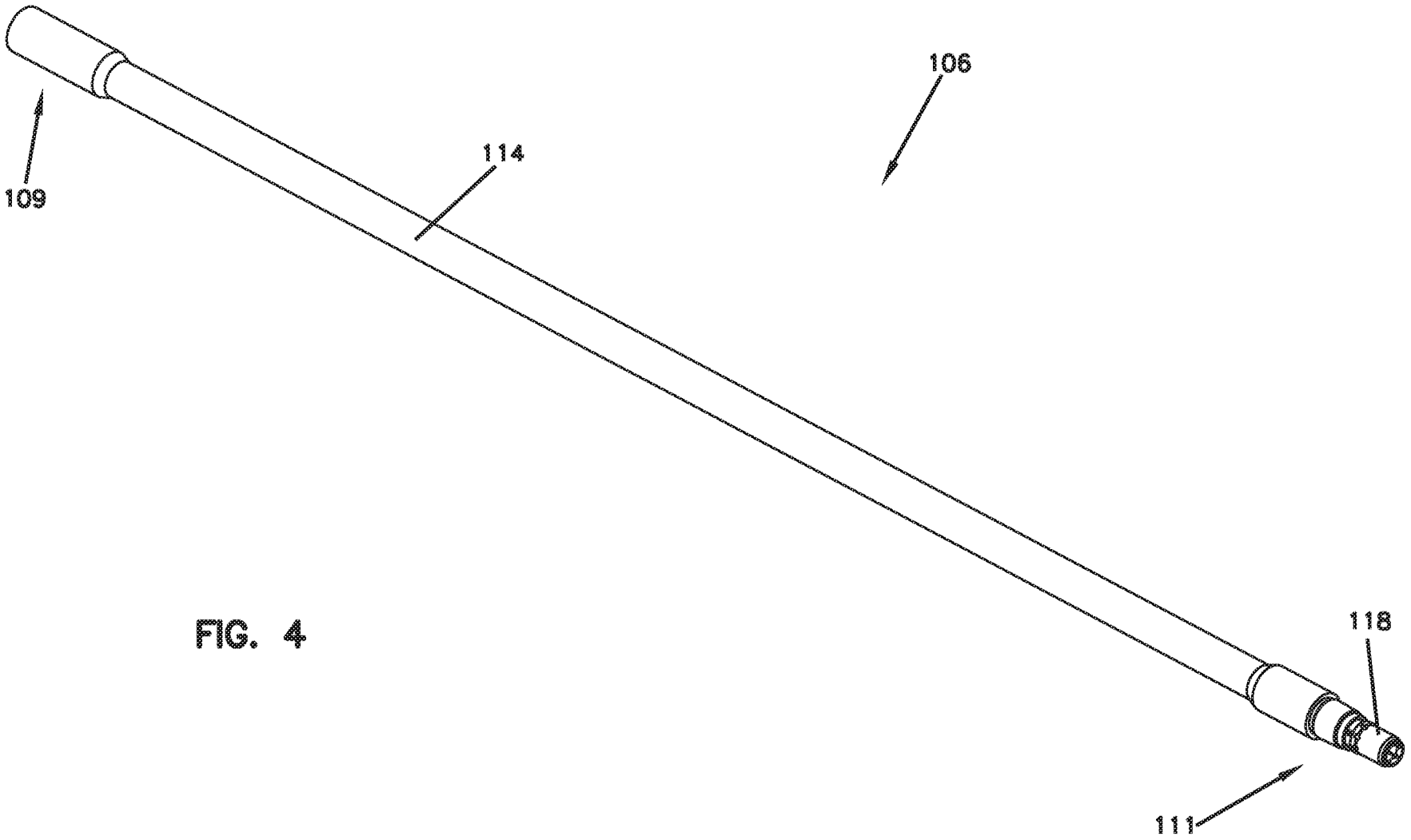
FIG. 4 illustrates a perspective view of a drilling rod assembly, according to one embodiment of the present disclosure.
Figure 5:
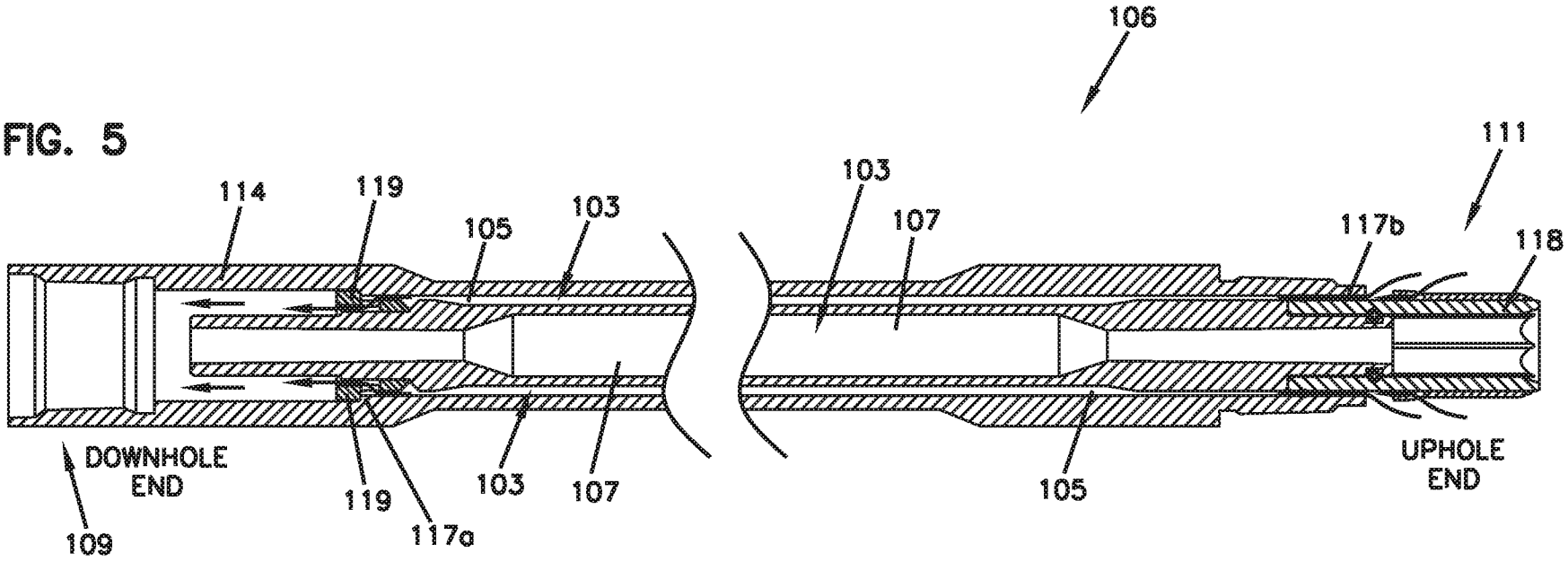
FIG. 5 illustrates a side cross-sectional view of the drilling rod assembly of FIG. 4.

FIG. 4 shows a perspective view of a single drill rod assembly 106, and FIG. 5 shows a longitudinal cross-section of a drill rod assembly 106. The drill string 102, and each drill rod assembly 106, defines a fluid flow path 103 that extends along the lengths of the drill rod assemblies 106. In some examples, the drill string 102 can have multiple fluid flow paths such as an annular fluid flow 105 path disposed between the inner and outer drill rods 116, 114 and an inner rod fluid flow path 107 disposed within the inner drill rod 116. In operation, fluid is pumped into the drill rod assembly 106 and travels to the drill head 110 for cooling, transporting cuttings, lubricating, and drill hole stabilizing. As will be described herein, drilling fluid can be provided to the drill string 102 at the gearbox 124.

In some examples, the inner rod coupling 118 and a flow collar 119 are flow elements that are configured to allow fluid flow within the fluid flow path 103 through each of the inner rod coupling 118 and the flow collar 119. The flow collar 119 is secured around the inner drill rod 116 at the downhole end 109 of the drill rod assembly 106 at an opposite end from the inner rod coupling 118. In some examples, the inner rod coupling 118 and the flow collar 119 help to retain the inner drill rod 116 within the outer drill rod 114 by interfacing with an uphole shoulder 117*a* and a downhole shoulder 117*b* of the outer drill rod 114, respectively. The inner rod coupling 118 and the flow collar 119 are configured to allow fluid flow along the fluid flow path 103 no matter the relative position of the inner drill rod 116 and the outer drill rod 114 of each drill rod assembly 106. The inner rod coupling 118 and the flow collar 119 are configured to allow fluid flow along the fluid flow path 103 while the flow collar 119 and/or the inner rod coupling 118 are interfacing (e.g., contacting) with the uphole shoulder 117*a* and/or the downhole shoulder 117*b* of the outer drill rod 114. Fluid flow through the flow collar 119 and the inner rod coupling 118 is represented in FIG. 5 with arrows F. In some examples, the flow collar 119 and/or the inner rod coupling 118 interface with the uphole shoulder 117*a* and/or the downhole shoulder 117*b* of the outer drill rod 114 with continuous annular surfaces.

Figure 5A:
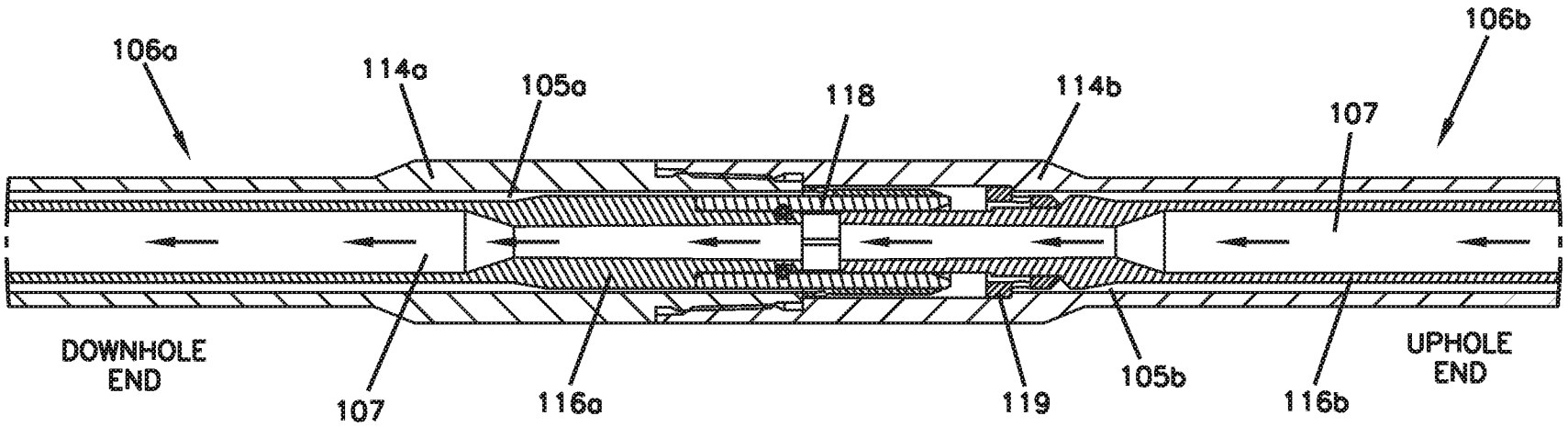
FIG. 5*a* illustrates a side cross-sectional view of a coupled pair of drilling rod assemblies of FIG. 4.

FIG. 5*a* shows two drill rod assemblies 106*a*, 106*b* coupled to one another. The outer drill rods 114*a*, 114*b* are shown coupled to one another, and the inner drill rods 116*a*, 116*b* are shown coupled to one another via the inner rod coupling 118. Further, the uphole drill rod assembly 106*b* is shown to be coupled, but not attached to, the inner rod coupling 118, adjacent the flow collar 119. Fluid flow is permitted from the uphole drill rod assembly annular flow path 105*a*, through and around the flow collar 119, through and around the inner rod coupling 118, and into the downhole drill rod assembly annular flow path 105*b*. Therefore, as shown, even when the inner rod coupling 118 is contacting the uphole shoulder 117*a* of the outer drill rod 114*a* of the downhole drill rod assembly 106*a* and the flow collar 119 is contacting the downhole shoulder 117*b* of the outer drill rod 114*b* of the uphole drill rod assembly 106*b*, annular flow between the two drill rod assemblies 106*a*, 106*b* is permitted.

Figure 6:
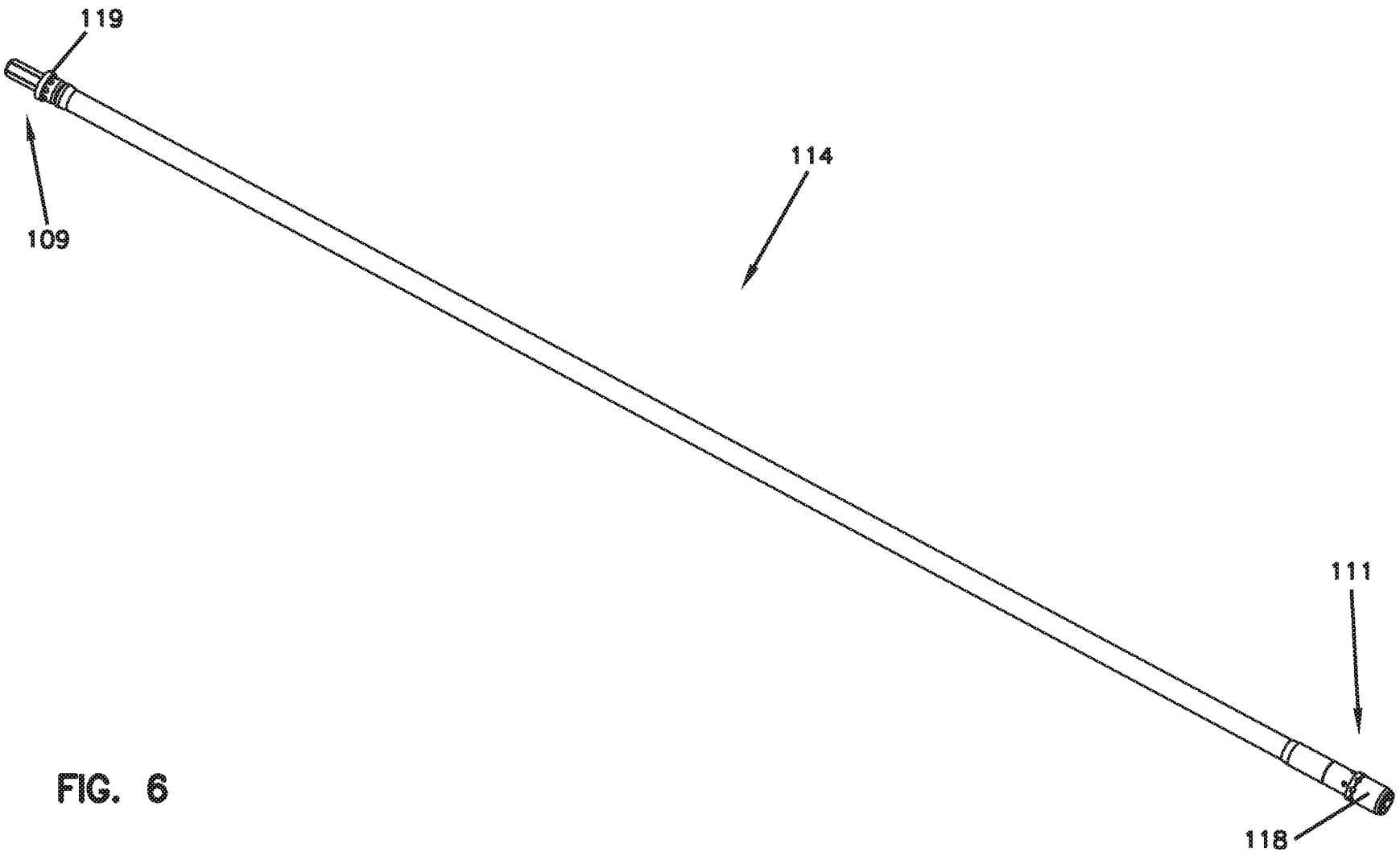
FIG. 6 illustrates a perspective view of an inner drill rod, inner drill rod coupling, and flow collar, according to one embodiment of the present disclosure.

FIG. 6 shows a perspective view of an inner drill rod 116 with an inner rod coupling 118 installed on the uphole end 111 and a flow collar 119 installed on the downhole end 109. The inner drill rod 116 includes features that allow each inner drill rod 116 to be coupled with additional similar inner rods and/or drilling tools.

Figure 7:
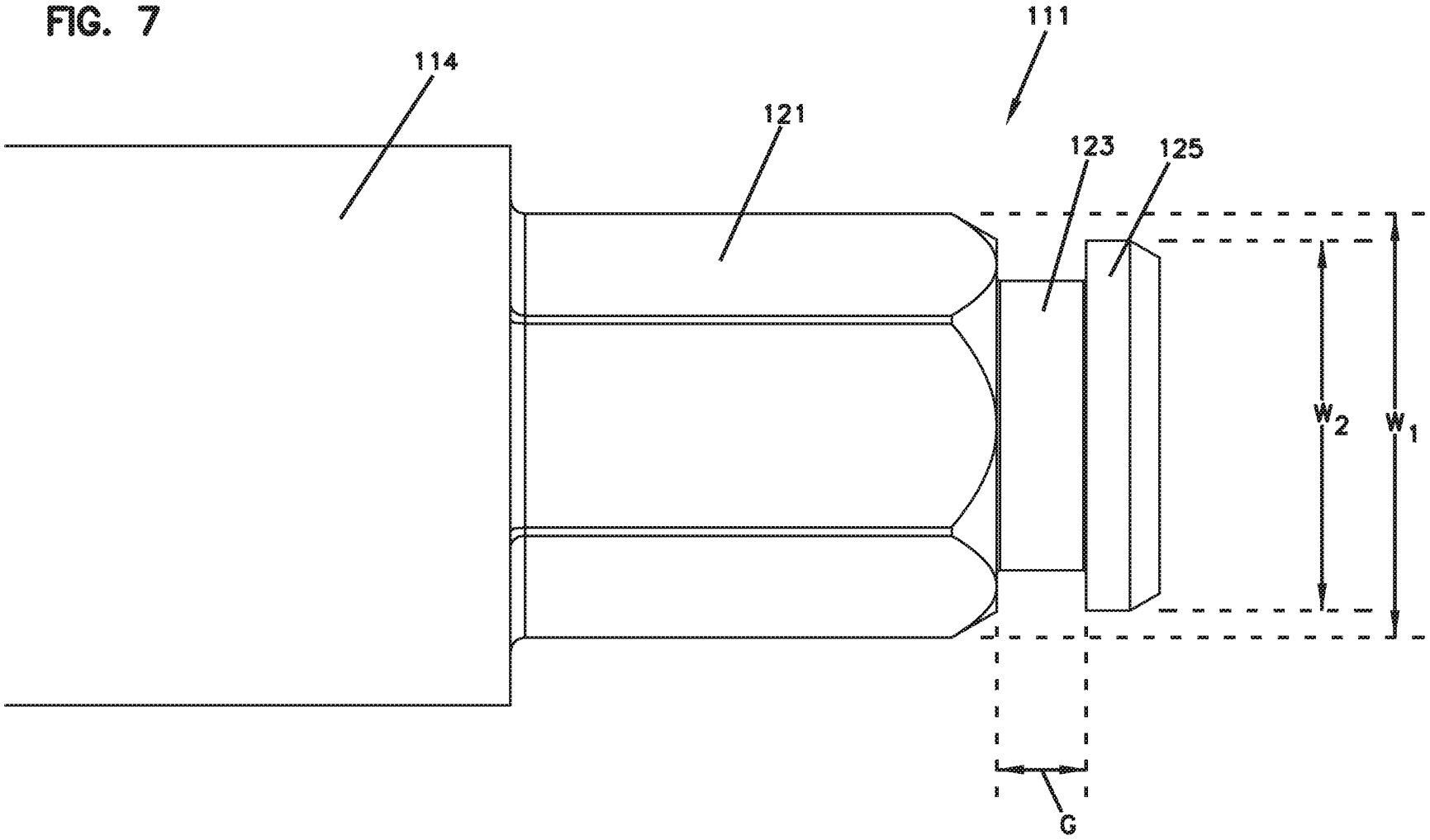
FIG. 7 illustrates a side view of an uphole end of the inner drill rod of FIG. 6.

FIG. 7 shows a side view of the uphole end 111 of the inner drill rod 116 without the inner rod coupling 118 installed. The uphole end 111 of the inner drill rod 116 includes a torque-carrying section 121, a groove 123, and a non-torque-carrying section 125.

The torque-carrying section 121 is configured to mate with the inner rod coupling 118 so that torque can be transferred through the inner rod coupling 118 and to the inner drill rod 116. In some examples, the torque carrying section 121 can have a polygonal cross-section. In some examples, the torque-carrying section 121 has a hexagonal cross-section. The torque-carrying section 121 can be of any cross-sectional profile that is configured to transfer torque while minimizing friction and the potential for jamming (e.g., lobes, flat faces, curved faces, etc.). The torque-carrying section 121 has a maximum width of W1.

The groove 123 is configured to receive a fastening device (shown in FIG. 9) to secure the inner rod coupling 118 to the inner drill rod 116. In some embodiments, the groove 123 is configured to receive a pair of fastening devices such as pins, bolts, or other like devices. In some examples, the groove 123 can have a width G that is greater than the width of the fastening device.

The non-torque-carrying section 125 is configured to be positioned within the inner rod coupling 118 so that it does not bear any torque forces from the inner rod coupling 118. The non-torque-carrying section 125 has a maximum width of W2. W2 is less than the width W1 of the torque-carrying section 121. In some examples, the non-torque-carrying section 125 has a circular cross-section.

The uphole end 111 of the inner drill rod 116 is described herein as an example and it is considered within the scope of the present disclosure that other drilling components in the dual rod drilling system 100 may have a similar construction to the uphole end 111 of the inner drill rod 116 described herein. For example, such components can include, but are not limited to, a sub saver, as discussed with respect to FIGS. 48-61 herein, and the drill head 110, as discussed with respect to FIGS. 22-47 herein.

Figure 8:
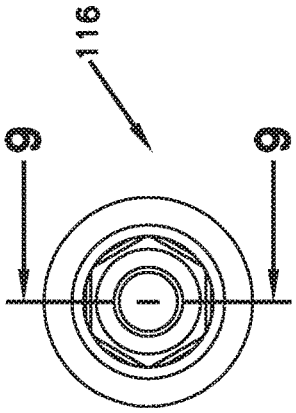
FIG. 8 illustrates an end view of a downhole end of the inner drill rod, inner drill rod coupling, and flow collar of FIG. 6.
Figure 9:
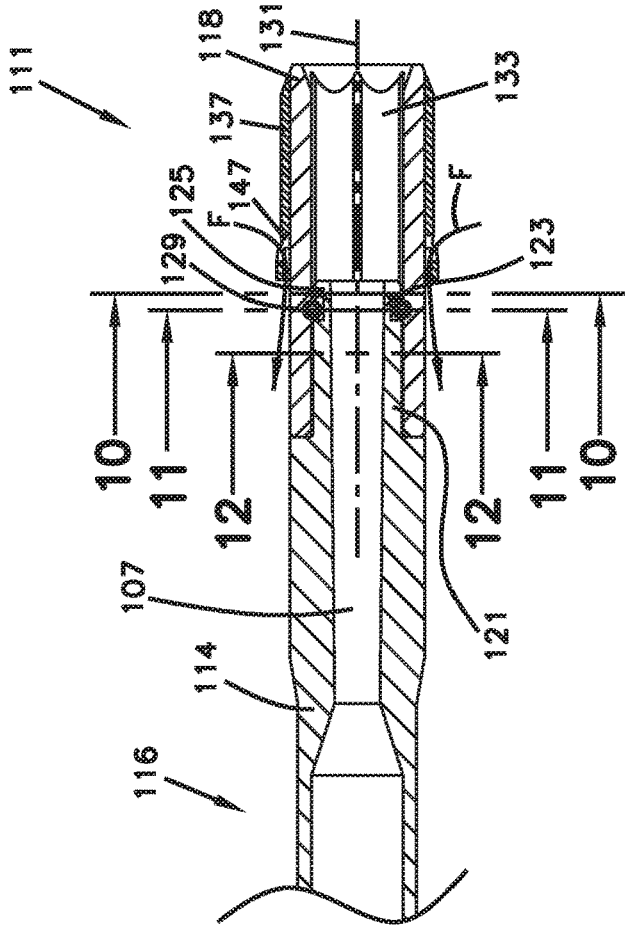
FIG. 9 illustrates a side cross-sectional view of the inner drill rod, inner drill rod coupling, and flow collar of FIG. 8 along line 9-9.
Figure 9:
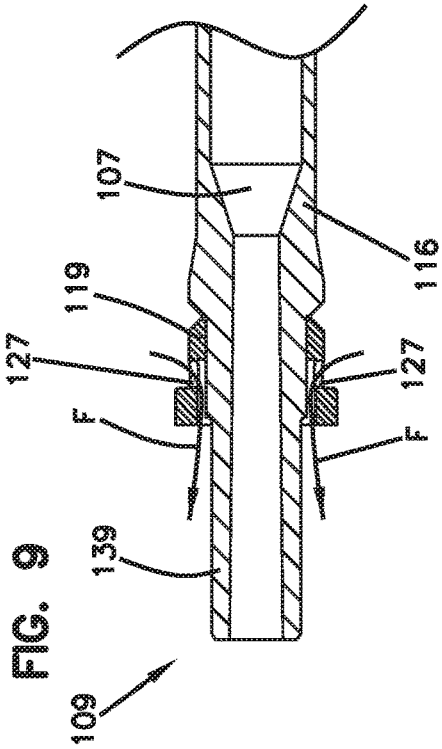

FIG. 8 shows an end view of the inner drill rod 116, and FIG. 9 shows a longitudinal cross-section of the inner drill rod 116, inner rod coupling 118, and flow collar 119 along line 9-9 in FIG. 8. FIG. 8 shows both the downhole end 109 and the uphole end 111 of the inner drill rod 116. Further, FIG. 8 depicts break lines to represent the middle of the inner drill rod 116.

At the downhole end 109, the flow collar 119 is secured around the inner drill rod 116. In some examples, the flow collar is configured to be welded onto the inner drill rod 116. In other examples, the flow collar 119 is press fit and secured around the downhole end of the inner drill rod 116. In other examples, the flow collar 119 is attached to the inner drill rod 116 via a fastener (not shown). In other examples still, the flow collar 119 is attached loosely to the downhole end 109.

Similar to FIG. 5, FIG. 8 also depicts arrows F that travel through the flow collar 119 to depict fluid flow. As will be discussed with respect to FIGS. 19-21, the flow collar 119 includes at least one peripheral fluid passage 127 positioned within the annular fluid flow passage 103 between the inner drill rod 116 and the outer drill rod 114 so as to allow generally axial fluid flow within the annular fluid flow passage 107.

At the uphole end 111 of the inner drill rod 116, the inner rod coupling 118 is secured to the inner drill rod 116 by a pair of pins 129. The pins 129 are configured to pass through the inner rod coupling 118 and through the groove 123 in the inner drill rod 116. Due to the size of the groove 123, the inner drill rod 116 is captured in an axial direction within the inner rod coupling 118. In some examples, the groove 123 can have a width G that allows for limited axial movement between the inner drill rod 116 and inner rod coupling 118. In some examples, a single pin 129 can be utilized with the inner rod coupling 118.

The inner rod coupling 118 includes a longitudinal axis 131, an inner bore 133, at least one cross aperture 135, and a flow sleeve 137. The inner bore 133 has a non-circular profile that is configured to mate with the torque-carrying section 121 of the uphole end 111 of the inner drill rod 116. The inner bore 133 can also have a profile that is configured to mate with a downhole end torque-carrying section 139 of the inner drill rod 116 so that it can couple two like inner drill rods 116. The torque-carrying section 139 can be of any cross-sectional profile that is configured to transfer torque while minimizing friction and the potential for jamming (e.g., lobes, flat faces, curved faces, etc.). The inner bore 133 is configured to interface with the inner drill rod 116 to transfer torque between successive inner drill rods 116.

The cross aperture 135 is configured to receive and hold the pin(s) 129. In some examples, the inner rod coupling 118 includes a plurality of cross apertures 135.

The flow sleeve 137 of the inner rod coupling 118 is configured to allow fluid flow therethrough so as to allow generally axial fluid flow within the annular fluid flow passage 105, similar to the peripheral fluid passage 127 of the flow collar 119. Further, the flow sleeve 137 is configured to interface with the outer drill rod 114 so as to aid in retaining the inner drill rod 116 within the outer drill rod 114. In some examples, the flow sleeve 137 can have an outer diameter that is larger than the inner diameter of the outer drill rod 114.

Figure 10:
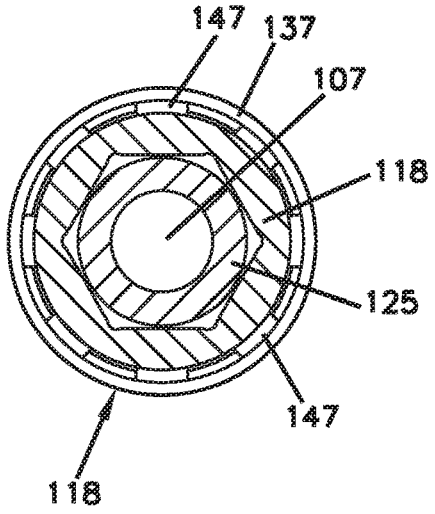
FIG. 10 illustrates a cross-sectional view of the inner drill rod and inner drill rod coupling of FIG. 9 along line 10-10.

FIG. 10 shows a cross-section of the inner drill rod 116 and the inner rod coupling 118 taken along line 10-10 in FIG. 9. As shown, the non-torque-carrying section 125 of the inner drill rod 116 does not make contact with the inner bore 133 of the inner rod coupling 118. Further, in the depicted example, the flow sleeve 137 of the inner rod coupling 118 includes a plurality of flow sleeve fluid passages 147 that are positioned around the periphery of the inner rod coupling 118. In some examples, the flow sleeve 137 can include a single flow sleeve fluid passage 147.

Figure 11:
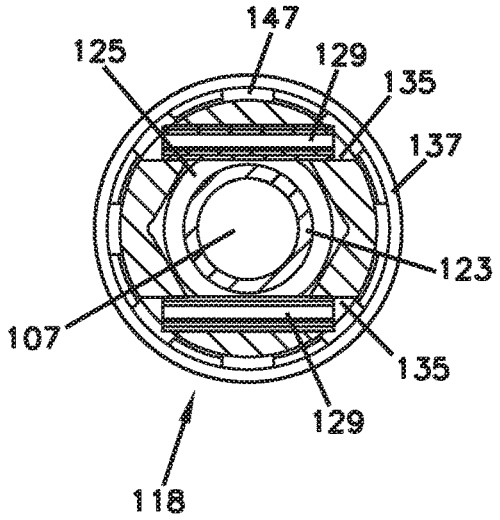
FIG. 11 illustrates a cross-sectional view of the inner drill rod and inner drill rod coupling of FIG. 9 along line 11-11.

FIG. 11 shows a cross-section of the inner drill rod 116 and the inner rod coupling 118 taken along line 11-11 in FIG. 9. The pins 129 are positioned in the groove 123 of the inner drill rod 116 and also within the cross apertures 135 of the inner rod coupling 118. In some examples, the cross apertures 135 of the inner rod coupling 118 are positioned at opposite sides of the inner rod coupling 118.

Figure 12:
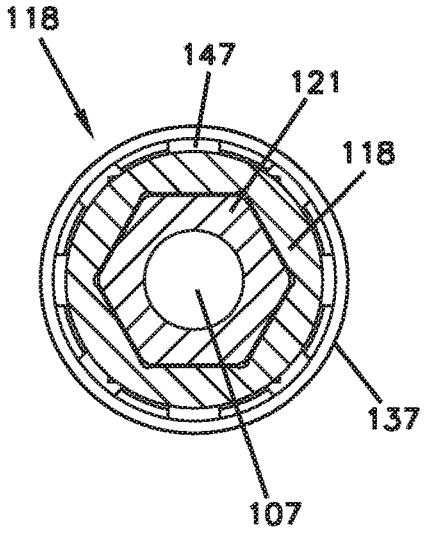
FIG. 12 illustrates a cross-sectional view of the inner drill rod and inner drill rod coupling of FIG. 9 along line 12-12.

FIG. 12 shows a cross-section of the inner drill rod 116 and the inner rod coupling 118 taken along line 12-12 in FIG. 9. The torque-carrying section 121 of the inner drill rod 116 is mated with the inner bore 133 of the inner rod coupling 118. In some examples, the inner bore 133 can have a hexagonal cross-section that matches the cross-section of the torque-carrying section 121.

Figure 13:
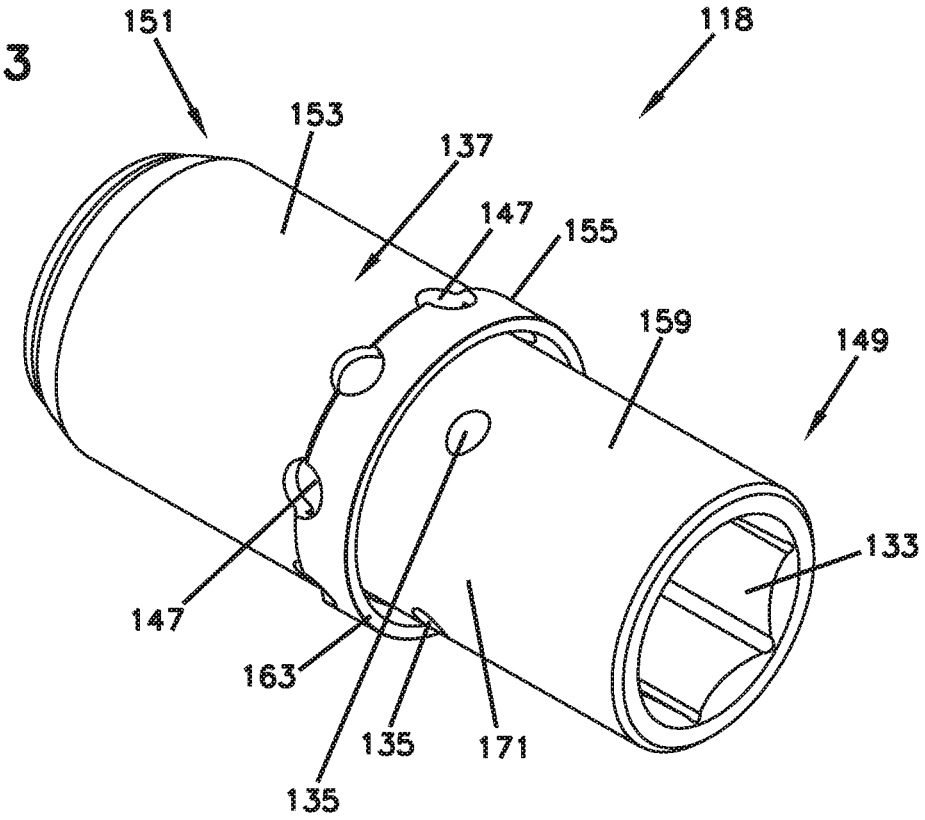
FIG. 13 illustrates a perspective view of an inner drill rod coupling, according to one embodiment of the present disclosure.
Figure 14:
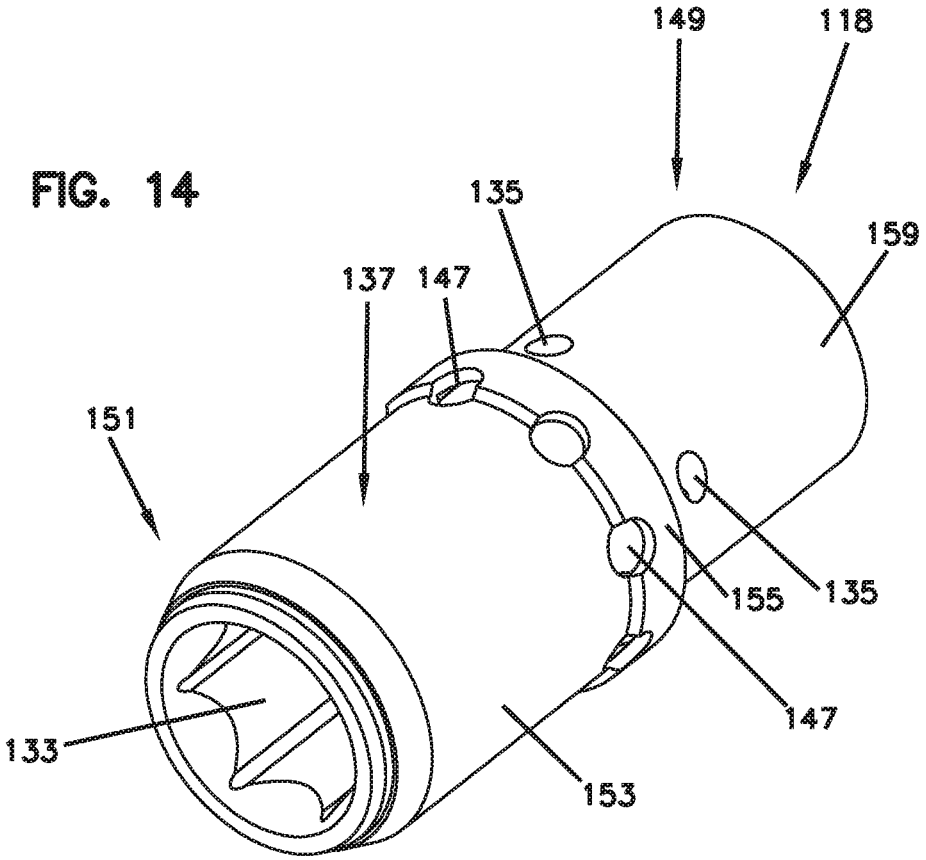
FIG. 14 illustrates another perspective view of the inner drill rod coupling of FIG. 13.
Figure 15:
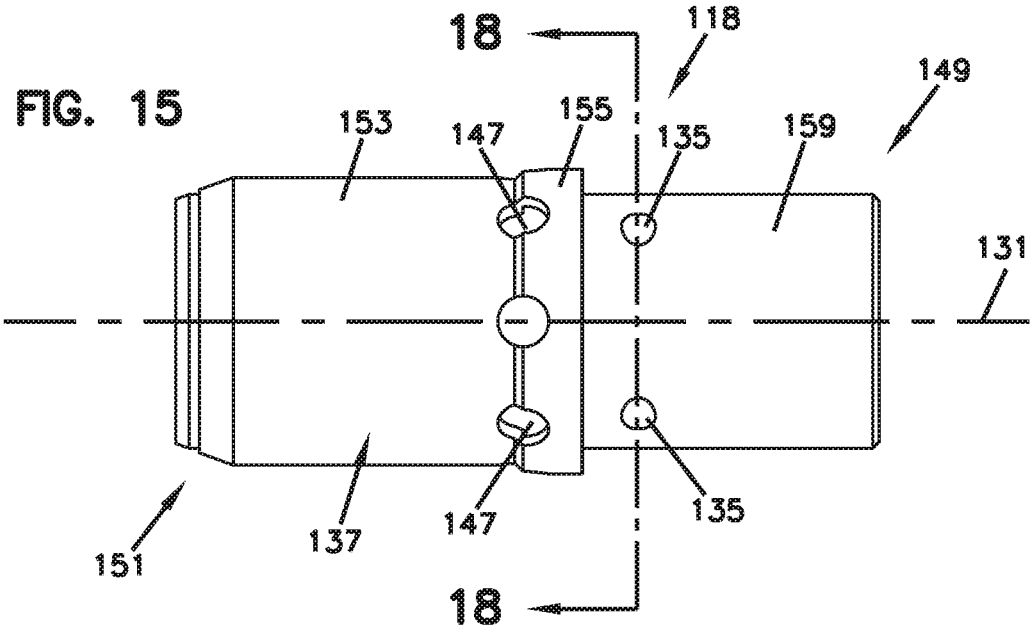
FIG. 15 illustrates a side view of the inner drill rod coupling of FIG. 13.
Figure 16:
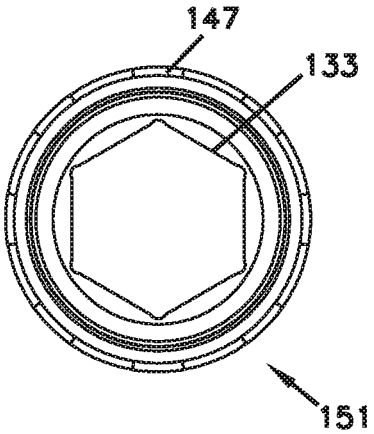
FIG. 16 illustrates an uphole end view of the inner drill rod coupling of FIG. 13.
Figure 17:
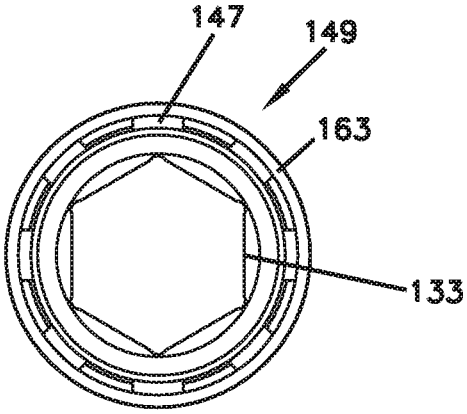
FIG. 17 illustrates a downhole end view of the inner drill rod coupling of FIG. 13.

FIGS. 13 and 14 show perspective views of the inner rod coupling 118. FIG. 15 shows a side view of the inner rod coupling 118. FIGS. 16 and 17 show the ends of the inner rod coupling 118.

The inner rod coupling 118 includes a downhole end 149 and an uphole end 151. The downhole end 149 is configured to be secured to the inner drill rod 116 via pins 129 (as shown in FIG. 9). Further, the inner bore 133 of the inner rod coupling 118 has a consistent cross-section along the length of the inner coupling.

The flow sleeve 137 of the inner rod coupling 118 can include a flow sleeve main body 153 and a ring 155. In some examples, the ring 155 includes a larger outer diameter than the flow sleeve main body 153. In some examples, the flow sleeve main body 153 can be press fit around a main body 159 of the inner rod coupling 118 while the ring 155 remains spaced away from the main body 159 of the inner rod coupling 118. Further, as noted above, the flow sleeve 137 includes a plurality of flow sleeve fluid passages 147 that allow for axial fluid flow from the downhole end 149 to the uphole end 151 of the inner rod coupling 118. In some examples, the flow sleeve fluid passages 147 are radial apertures disposed around the periphery of the flow sleeve 137 in both the ring 155 and the flow sleeve main body 153. The flow sleeve fluid passages 147 allow fluid to flow around the flow sleeve main body 153, through the flow sleeve fluid passages 147, and between the ring 155 and main body 159 of the inner rod coupling 118. In some examples, the flow sleeve fluid passages 147 are generally perpendicular to the longitudinal axis 131 of the inner rod coupling 118. In some examples, the flow sleeve 137 can include flow sleeve fluid passages 147 of varying sizes.

In some examples, the flow sleeve 137 includes an outer rod interfacing surface 163 on the ring 155. The outer rod interfacing surface 163 is generally perpendicular to the longitudinal axis 131 of the inner rod coupling 118. The outer rod interfacing surface 163 is configured to periodically contact the outer drill rod 114 of the drill rod assembly 106 of which the inner rod coupling 118 is a part. Specifically, the outer rod interfacing surface 163 is configured to contact the uphole end shoulder 117*b* of the outer drill rod 114, as shown in FIG. 5. In some examples, the outer rod interfacing surface 163 is a continuous annular surface that extends around the entire perimeter of the flow sleeve 137 that surrounds the main body 159 of the inner rod coupling 118. The outer rod interfacing surface 163 aids in retaining the inner drill rod 116 within the outer drill rod 114. Once the outer rod interfacing surface 163 interfaces with the outer drill rod 114, the inner drill rod 116 cannot move further toward the downhole end 109 of the drill rod assembly 106. Further, the flow sleeve fluid passages 147 of the flow sleeve 137 are longitudinally offset from the outer rod interfacing surface 163. In some examples, such a longitudinal offset prevents the flow sleeve fluid passages 147 from becoming blocked when the outer rod interfacing surface 163 contacts the outer drill rod 114.

In some examples, the flow sleeve 137 can be configured to be forced off of, and removed from, the main body 159 by the uphole end shoulder 117*b* of the outer drill rod 114 during a malfunction during a drilling operation. This can be advantageous because the integrity of the inner rod coupling 118 can be maintained during a malfunction. The flow sleeve 137 acts similar to a fuse, failing by being removed from the inner rod coupling 118 during a malfunction, but saving the inner rod coupling 118 from damage at the same time.

Figure 18:
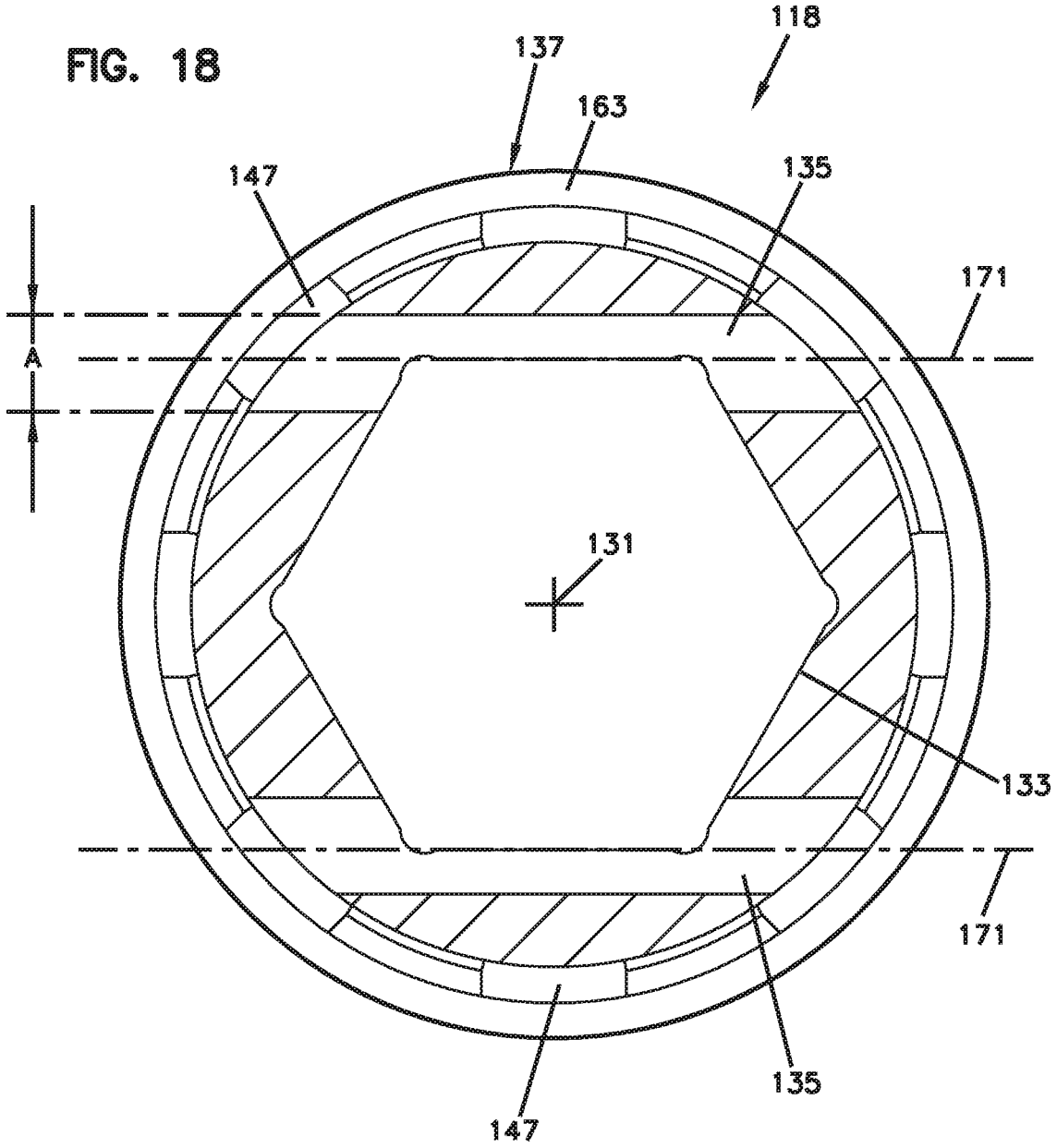
FIG. 18 illustrates a cross-sectional view of the inner drill rod coupling of FIG. 15 along line 18-18.

FIG. 18 shows a cross-section of the inner rod coupling 118 taken along line 18-18 in FIG. 15. The cross apertures 135 are disposed in the main body 159 having axes 171 so as to not intersect the longitudinal axis 131 of the inner rod coupling 118. By positioning the cross apertures 135 through the main body 159 and not intersecting the longitudinal axis, the pins 129 are positioned at sides of the inner bore 133 so as to only interface with the groove 123 of the inner drill rod 116 and not obstruct either of the annular fluid flow path 105 or the inner rod fluid flow path 107 of the drill string 102. Specifically, because the groove 123 surrounds the inner rod fluid flow path 107 of the inner drill rod 116, the cross apertures 135 position the pins in such a way where they never obstruct fluid flow.

The cross apertures 135 can have a variety of different shapes. In some examples, the cross apertures 135 have a width A (e.g., a diameter) at least equal to the width G of the groove 123 of the inner drill rod 116.

Figure 18A:
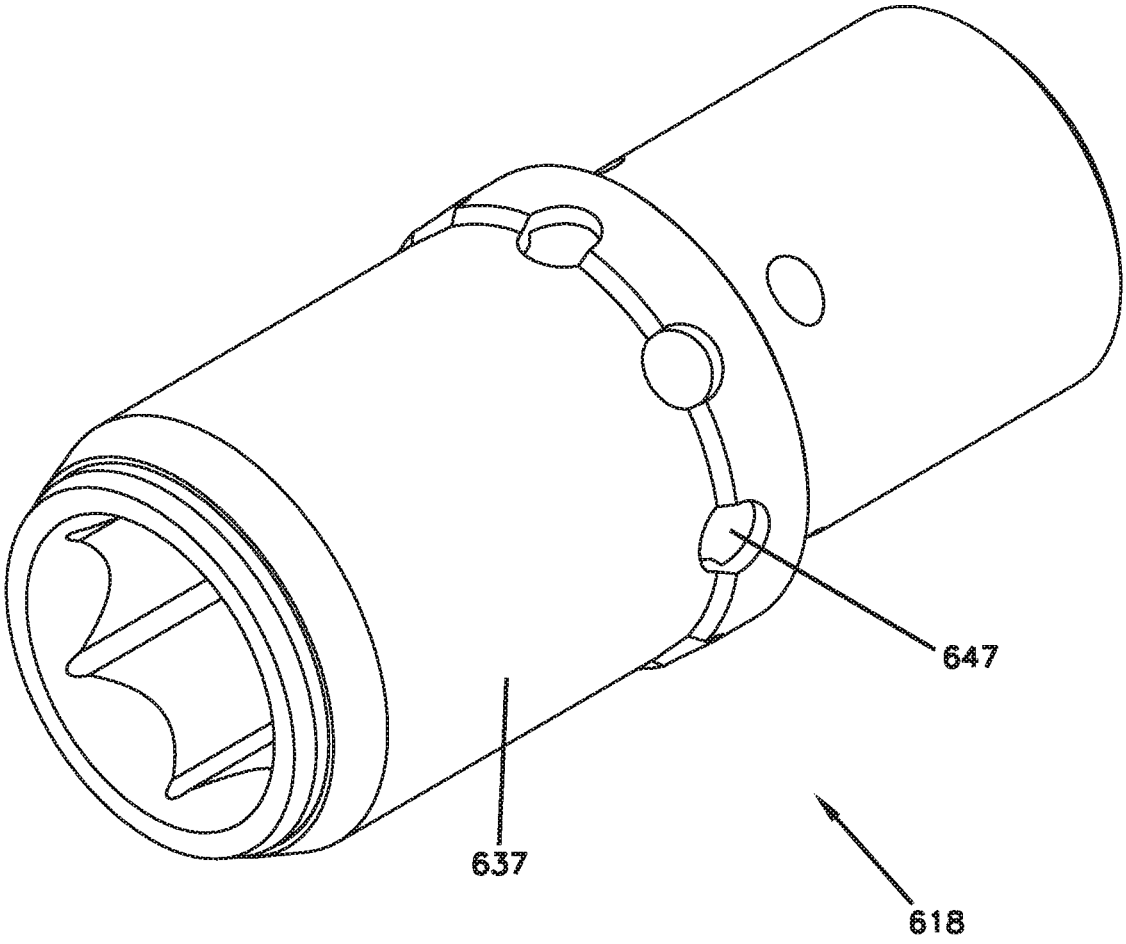
FIG. 18*a* illustrates a perspective view of an inner drill rod coupling, according to one embodiment of the present disclosure.
Figure 18B:
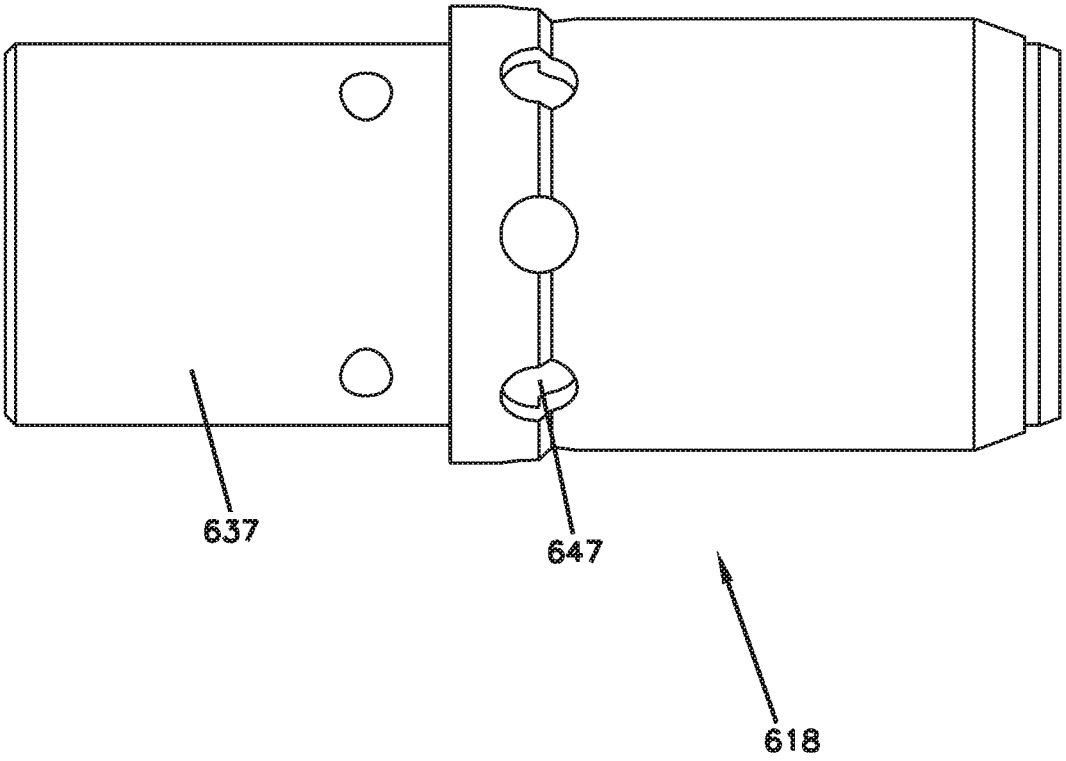
FIG. 18*b* illustrates a side view of the inner drill rod coupling of FIG. 18*a*.

FIGS. 18*a* and 18*b* depict an inner rod coupling 618. The inner rod coupling 618 is substantially similar to the inner rod coupling 118 discussed above. The inner rod coupling 618 includes flow sleeve 637 that is configured to allow fluid flow therethrough so to allow generally axial fluid flow within the annular fluid flow passage 103. Like the flow sleeve 137 described above, the flow sleeve 637 includes a plurality of flow sleeve fluid passages 647 that are positioned around the periphery of the inner rod coupling 618. In some examples, the flow sleeve fluid passages 647 are sized and shaped to allow adequate flow therethrough. In some examples, the flow sleeve fluid passages 647 can be slots.

Figure 19:
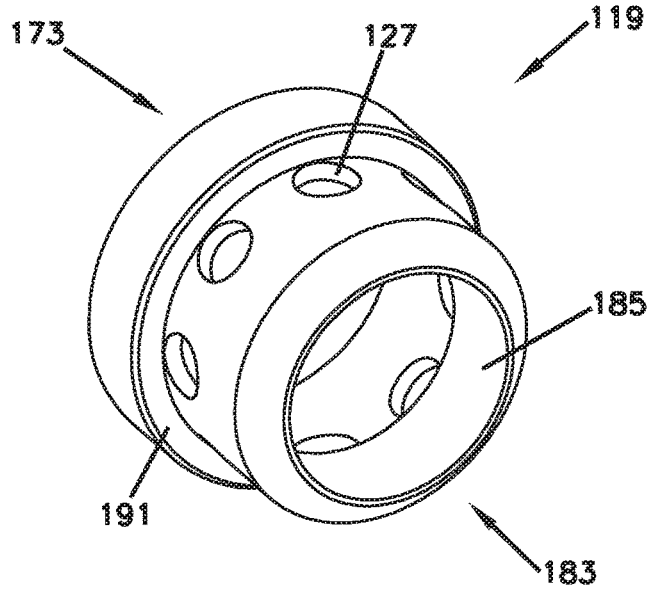
FIG. 19 illustrates a perspective view of a flow collar, according to one embodiment of the present disclosure.
Figure 20:
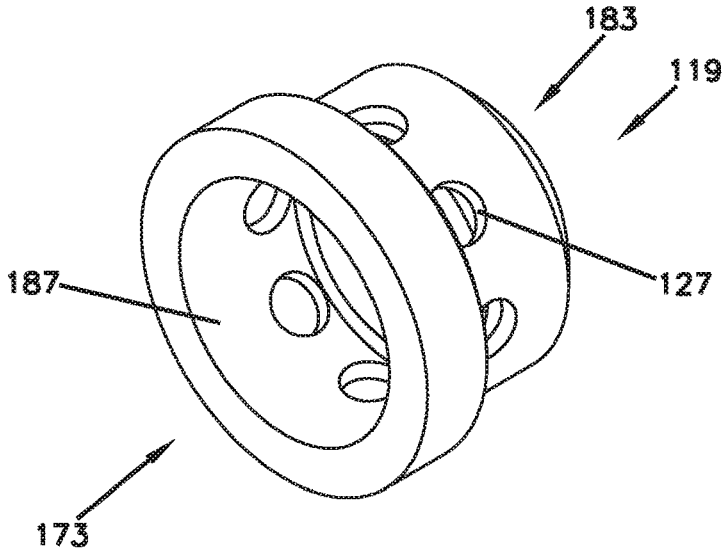
FIG. 20 illustrates another perspective view of the flow collar of FIG. 19.
Figure 21:
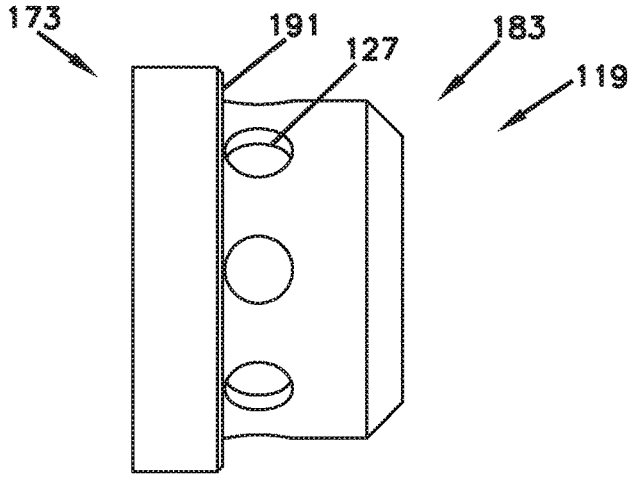
FIG. 21 illustrates a side view of the flow collar of FIG. 19.

FIGS. 19-21 show perspective views of the flow collar 119. The flow collar 119 includes a downhole end 173 and an uphole end 183.

The flow collar 119 includes a first interior portion 185 that has a first interior diameter and a second interior portion 187 that has a second interior diameter. In some examples, the first interior portion 185 has a smaller interior diameter than the second interior portion 187. Further, in some examples, the second interior portion 185 is configured to be press fit onto the downhole end 109 of the inner drill rod 116. The downhole end 173 is configured to be secured to the inner drill rod 116 via pins 129 (as shown in FIG. 9). The inner bore 133 of the inner rod coupling 118 has a consistent cross-section along the length of the inner coupling.

Similar to the flow sleeve fluid passages 147 discussed above, the flow collar 119 includes a plurality of peripheral fluid passages 127. The peripheral fluid passages 127 allow fluid flow from the uphole end 183 to the downhole end 173. Specifically, when installed on the inner drill rod 116, fluid flows around the outside of the flow collar 119, through the peripheral passages 127, and between the second interior portion 187 and the inner drill rod 116.

The flow collar 119 further includes an outer rod interfacing surface 191, similar to the outer rod interfacing surface 163 of the inner rod coupling 118. The outer rod interfacing surface 191 is configured to periodically contact the outer drill rod 114 of the drill rod assembly 106 of which the flow collar 119 is a part. The outer rod interfacing surface 191 aids, along with the outer rod interfacing surface 163 of the inner rod coupling 118, in retaining the inner drill rod 116 within the outer drill rod 114. In some examples, the outer rod interfacing surface 191 is a continuous annular surface that extends around the entire perimeter of the flow collar 119. Once the outer rod interfacing surface 191 interfaces with the outer drill rod 114, the inner drill rod 116 cannot move further toward the uphole end 111 of the drill rod assembly 106. Thus, the flow collar 119 also reduces the amount of axial force that can be introduced to the inner rod coupling 118.

Figure 22:
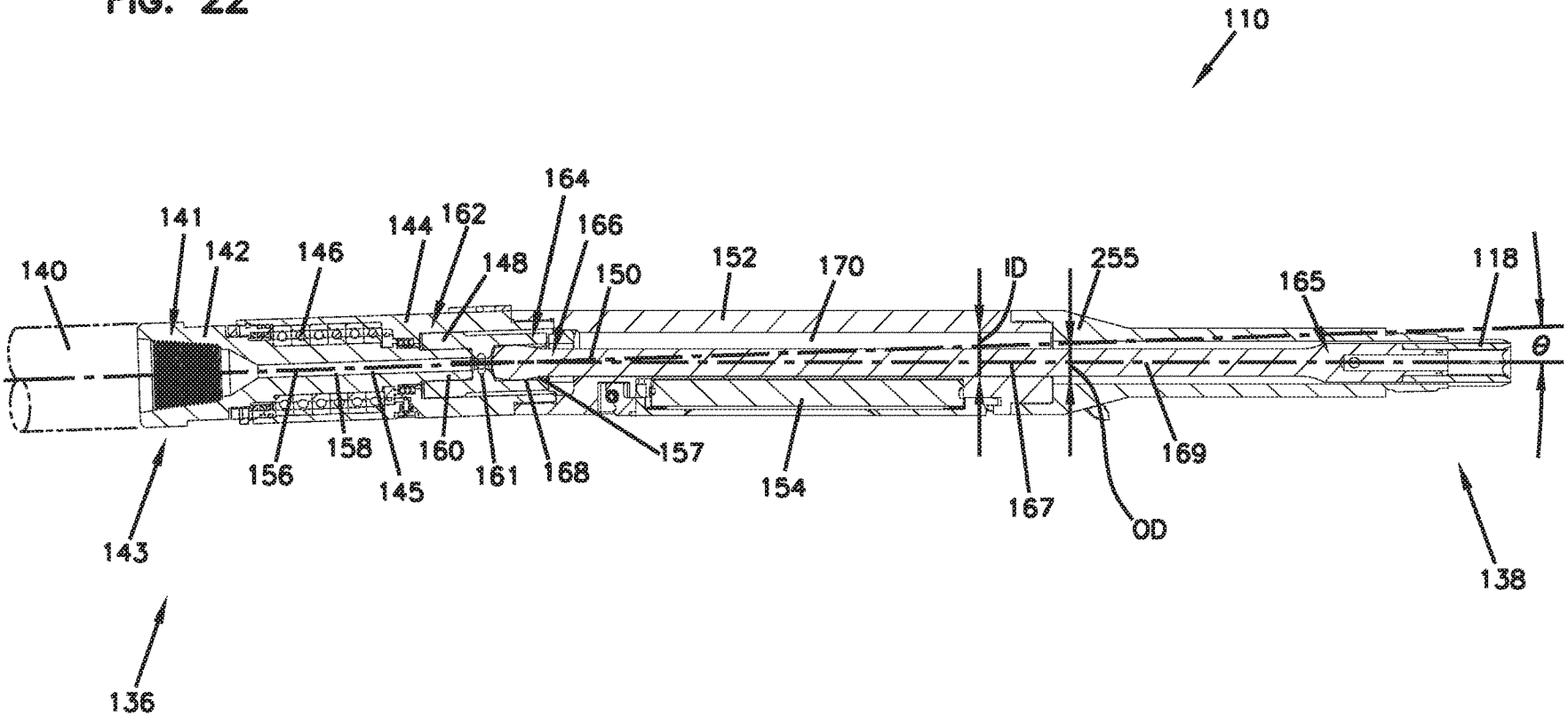
FIG. 22 illustrates a side cross-sectional view of a drill head, according to one embodiment of the present disclosure.

FIG. 22 shows a longitudinal cross-section of the drill head 110. The drill head 110 is connectable to the outer drill rods 114 and inner drill rods 116 of the drill string 102. The drill head 110 includes a downhole end 136 and an uphole end 138. Further, the drill head 110 includes a replaceable drill bit 140, a drill bit shaft 142, an end casing 144, a plurality of drill bit shaft bearings 146, a drive coupling 148, a drive shaft 150, a main casing 152, and an optional sonde 154 positioned within the main casing 152. In some examples, the drill head 110 can include an outer rod adapter 255 to connect the drill head 110 to the outer drill rods 114 of the drill string 102 and the inner rod coupling 118 to connect the drill head 110 to the inner drill rod 116.

The inner drill rods 116 of the drill string 102 are collectively used to drive the rotation of the drill bit 140 via the drive shaft 150, the drive coupling 148, and the drill bit shaft 142. The outer drill rods 114 of the drill string 102 are collectively used to rotate and/or control the rotational orientation of the main casing 152, which is connected to the end casing 144.

The replaceable drill bit 140 can have a variety of different configurations and, in some examples, can be a tri-cone bit. The replaceable drill bit 140 is mounted to a downhole end 141 of drill bit shaft 142 at the downhole end 136 of the drill head 110.

The drill bit shaft 142 is rotatably mounted within the end casing 144 via the drill bit shaft bearings 146 making the drill bit shaft 142 rotatable relative to the end casing 144 along a drill bit shaft axis 156. The drill bit shaft axis 156 is parallel to an end casing axis 158. The drill bit shaft 142 includes drive features 160 at an uphole end 143 that are configured to mate with the drive coupling 148 to facilitate torque transfer between the drive coupling 148 and the drill bit shaft 142. The drill bit shaft 142 also includes an inner fluid flow cavity 145 that allows drill fluid flow to transfer from the drill string 102 to the drill bit 140.

The drive coupling 148 is positioned between the drill bit shaft 142 and the drive shaft 150 within a recess 157 of the end casing 144 to facilitate the transfer of torque between the drill bit shaft 142 and the drive shaft 150. Specifically, the drive coupling 148 receives the drill bit shaft 142 at a downhole end 162 and the drive shaft 150 at an uphole end 164. The drive coupling 148 includes a coupling fluid flow passage 161 to allow fluid flow from the uphole end 164 to the downhole end 162 and then on to the inner fluid flow cavity 145 of the drill bit shaft 142.

The drive shaft 150 includes a downhole end 166 and an uphole end 165. The uphole end 165 is configured to attach to the inner drill rods 116 of the drill string 102. In some examples, the inner rod coupling 118 can be secured to the uphole end 165. The downhole end 166 includes drive features 168 that are torque transmitting and radial load bearing. The downhole end 166 of the drive shaft 150 is configured to mate with the uphole end 164 of the drive coupling 148. The drive shaft 150 is rotatable about a drive shaft axis 167 and is positioned within the main casing 152. In the depicted example, the drive shaft axis 167 is parallel with a main casing axis 169. The drive shaft axis 167 is not aligned and is not parallel with the end casing axis 158 and the drill bit shaft axis 156. In some examples, the drive shaft axis 167 and the drill bit shaft axis 156 are angled at an angle θ with respect to one another between about 1 degree and 5 degrees. In some examples, the drive shaft axis 167 and the drill bit shaft axis 156 are angled at an angle θ equal to about 2 degrees from one another. In some examples, the misalignment can be adjustable to alter the steering characteristics of the drill head 110.

The drive shaft 150 has an outer diameter OD that is smaller than an inner diameter ID of the main casing 152. A drive shaft fluid flow passage 170 is disposed between the inner diameter ID of the main casing 152 and the outer diameter OD of the drive shaft 150. In some examples, the drive shaft fluid flow passage 170 is an annular fluid flow passage between the drive shaft 150 and the main casing 152. The drive shaft fluid flow passage 170 is in communication with the fluid flow path 103 of the drill string 102 at the uphole end 138 of the drill head 110. Further, due to the location of the drive coupling 148 and the drive shaft 150, the drive coupling 148 and drive shaft 150 are surrounded by fluid flow from the drive shaft fluid flow passage 170. This allows drilling fluid to be in communication with the drive features 168 of the drive shaft 150 and the uphole end 164 of the drive coupling 148.

Figure 23:
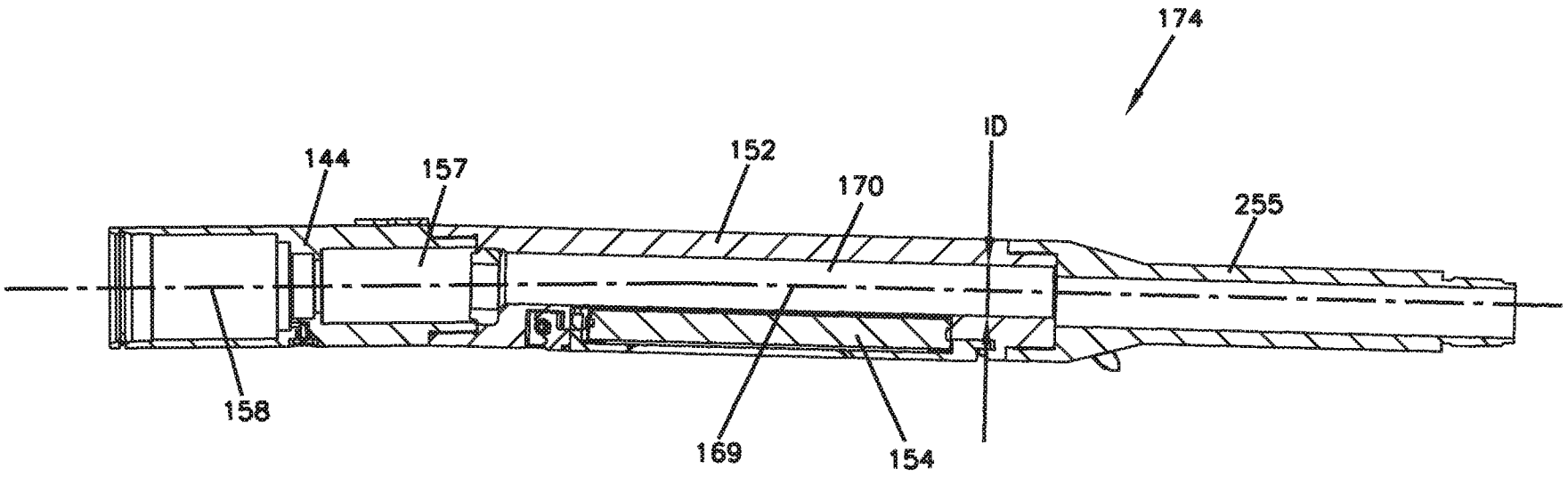
FIG. 23 illustrates a side cross-sectional view of an outer assembly of the drill head of FIG. 22.

FIG. 23 shows an outer assembly 174 of the drill head 110 that includes the end casing 144 connected to the main casing 152. Further, as shown, the outer rod adapter 255 is connected to the main casing 152. In some examples, a sonde 154 (i.e., probe or beacon) can be positioned within the main casing 152. The misalignment of the end casing axis 158 and the main casing axis 169 is fixed so as to allow the outer assembly 174 to interact with the bore hole to allow steering of the drill string 102 along a generally horizontal path.

Figure 24:
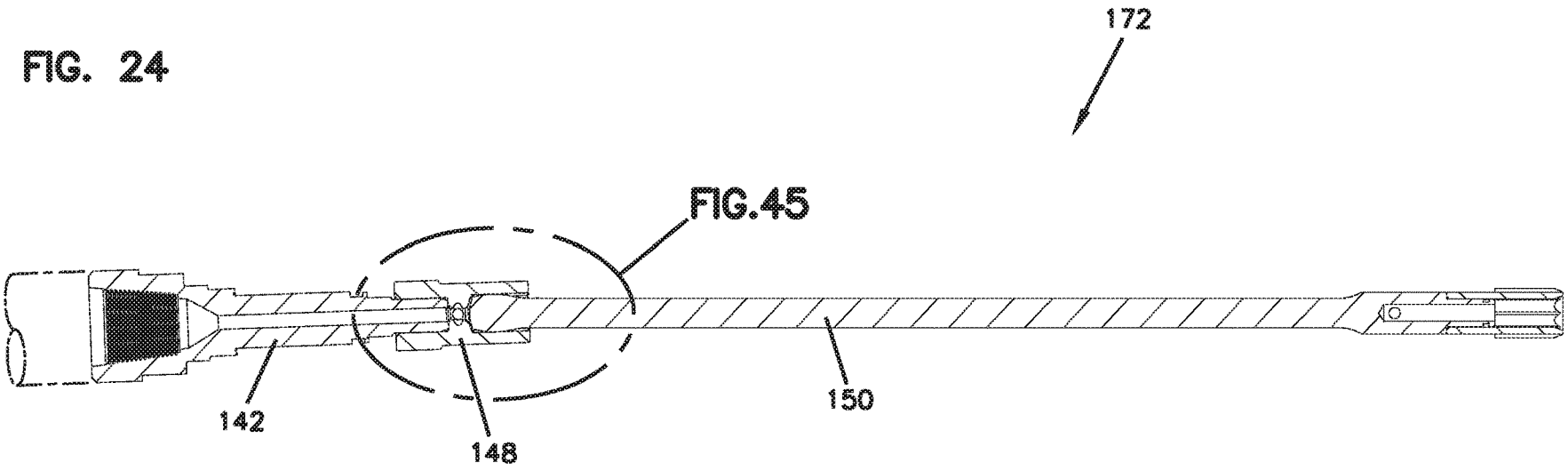
FIG. 24 illustrates a side cross-sectional view of an inner assembly of the drill head of FIG. 22.

FIG. 24 shows an inner assembly 172 of the drill head 110 that includes the drive shaft 150, the drive coupling 148, and the drill bit shaft 142. The inner assembly 172 is configured to drive the rotation of the drill bit 140 via the inner drill rod 116 of the drill string 102. As shown, the drill bit shaft 142 and the drive shaft 150 are both straight members that are axially misaligned at the drive coupling 148. In some examples, the misalignment of the drive shaft 150 with the drive coupling 148 is adjustable.

Figure 25:
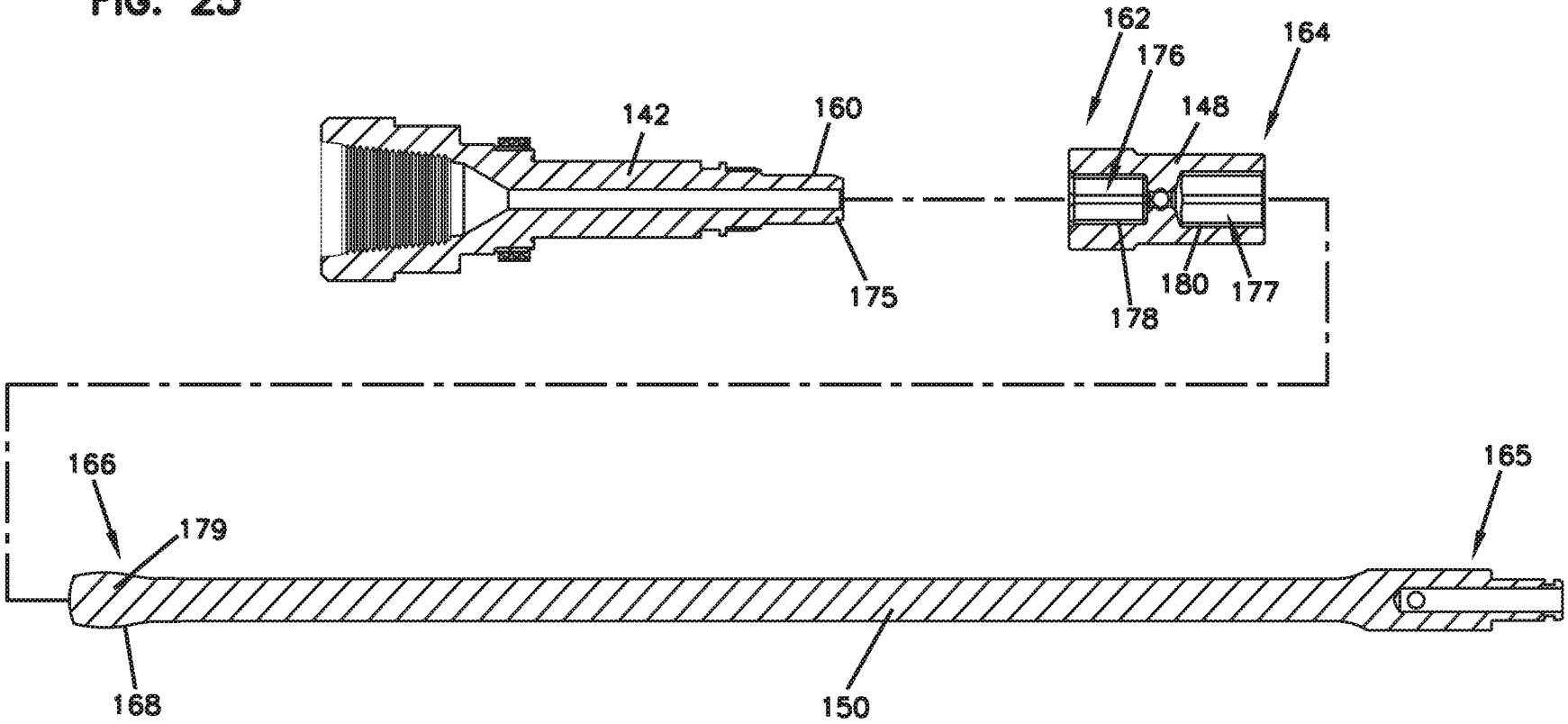
FIG. 25 illustrates an exploded side view of the inner assembly of the drill head of FIG. 22.

FIG. 25 shows an exploded longitudinal cross-section of the inner assembly 172. As shown, the drill bit shaft 142 includes a projection 175 at the uphole end 143, and the drive coupling 148 includes a recess 176 at the downhole end 162. The drive features 160 of the drill bit shaft 142 are configured to mate with drive features 178 of the drive coupling 148 located within the recess 176. Further, the drive coupling 148 also includes a second recess 177 at the uphole end 164 that includes drive features 180 within the recess 177 that are sized and shaped to mate with the drive features 168 of a projection 179 the drive shaft 150. In some examples, the drive coupling 148 can include one or more projections and mate with recesses on either, or both, the drill bit shaft 142 and the drive shaft 150.

Figure 26:
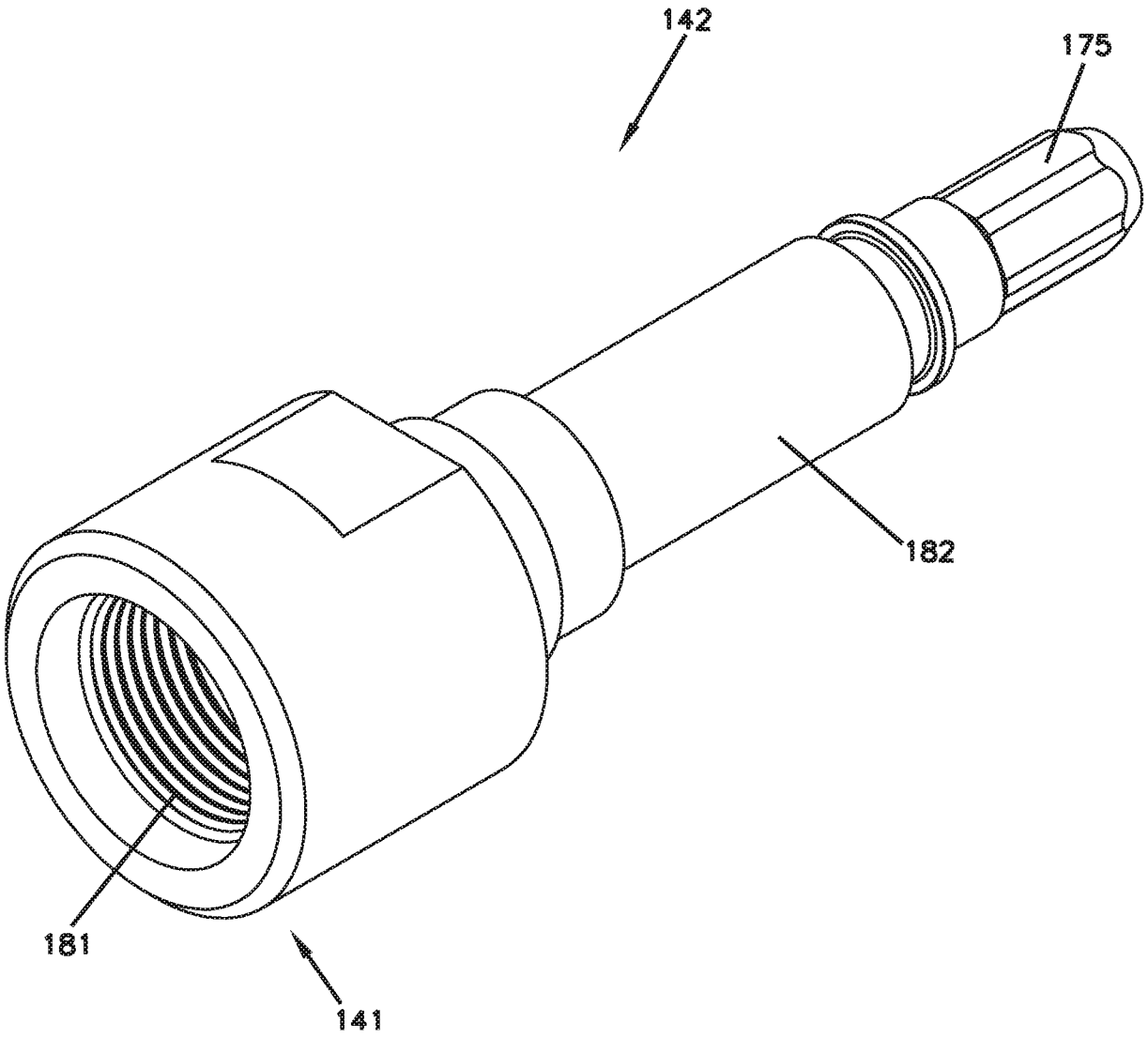
FIG. 26 illustrates a perspective view of a drill bit shaft, according to one embodiment of the present disclosure.
Figure 27:
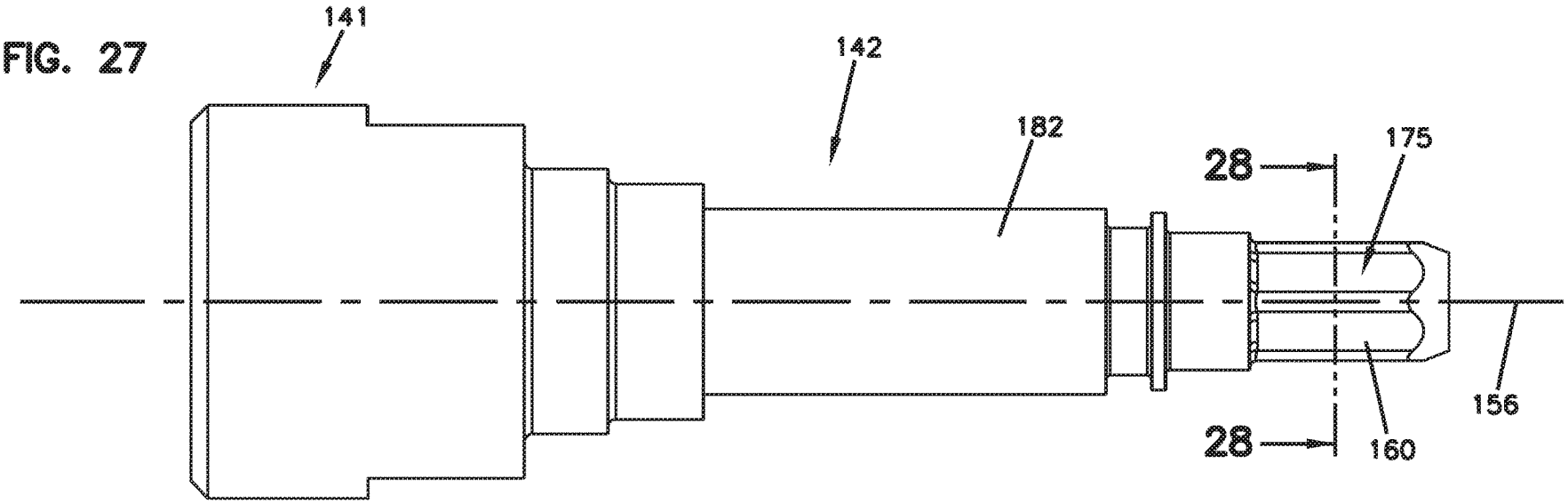
FIG. 27 illustrates a side view of the drill bit shaft of FIG. 26.

A perspective view of the drill bit shaft 142 is shown in FIG. 26. A side view of the drill bit shaft 142 is shown in FIG. 27. At the downhole end 141, the drill bit shaft includes an interface 181 that is sized and shaped to mate with the drill bit 140. In some examples, the interface 181 is a threaded interface. The drill bit shaft 142 is rotatable about the drill bit shaft axis 156. The drill bit shaft 142 also includes a bearing portion 182 that is configured to interface and rotate about the drill bit shaft bearings 146.

Figure 28:
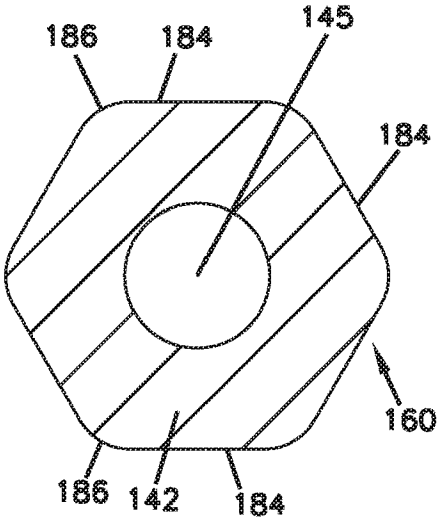
FIG. 28 illustrates a cross-sectional view of the drill bit shaft of FIG. 27 along line 28-28.

FIG. 28 shows a transverse cross-section of the drill bit shaft along line 28-28 of FIG. 27. As shown, the drive features 160 are a series of faces 184 each with a generally planar construction. In some examples, the projection 175 of the drill bit shaft 142 can have a generally polygonal cross-section. In the depicted embodiment, the drive features 160 of the projection 175 form a generally hexagonal profile. In some examples, the projection 175 can also include transitional surfaces 186 between the drive features 160 to allow for slight misalignment between the projection 175 of the drill bit shaft 142 and the recess 176 of the drive coupling 148.

Figure 29:
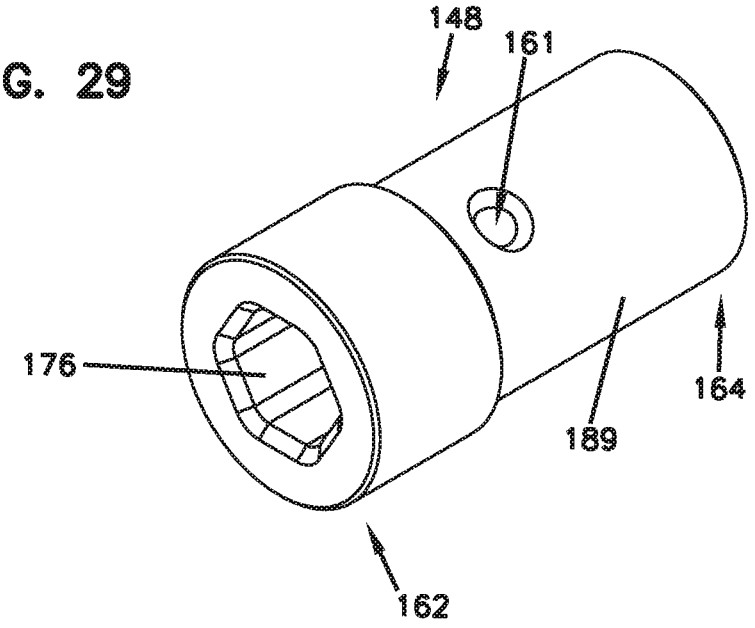
FIG. 29 illustrates a perspective view of a drive coupling, according to one embodiment of the present disclosure.
Figure 30:
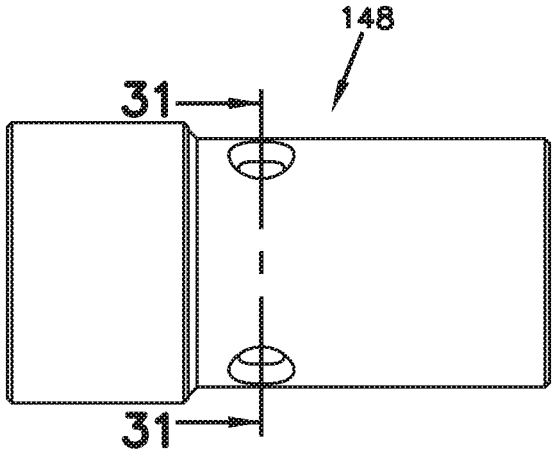
FIG. 30 illustrates a side view of the drive coupling of FIG. 29.
Figure 31:
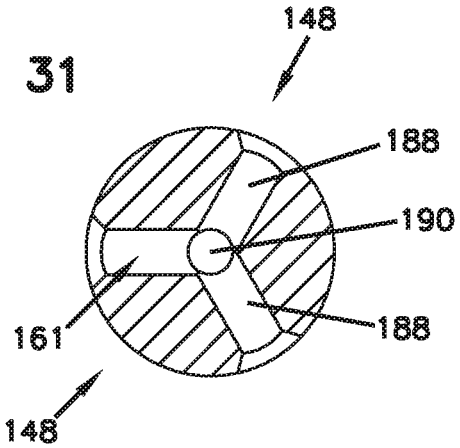
FIG. 31 illustrates a cross-sectional view of the drive coupling of FIG. 30 along line 31-31.
Figure 32:
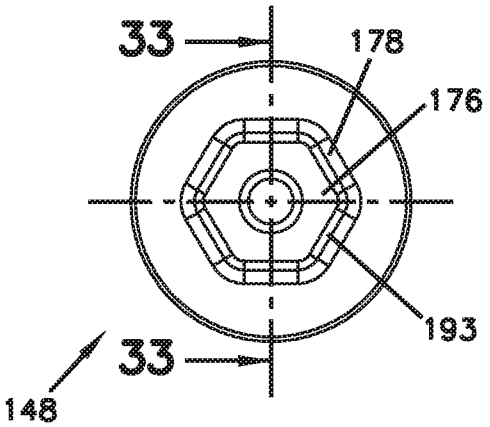
FIG. 32 illustrates a downhole end view of the drive coupling of FIG. 29.

FIG. 29 shows a perspective view of the drive coupling 148. FIG. 30 shows a side view of the drive coupling 148, and FIG. 31 shows a cross-sectional view of the drive coupling 148 along line 31-31 in FIG. 30. FIG. 32 shows an end view of the drive coupling 148.

Figure 33:
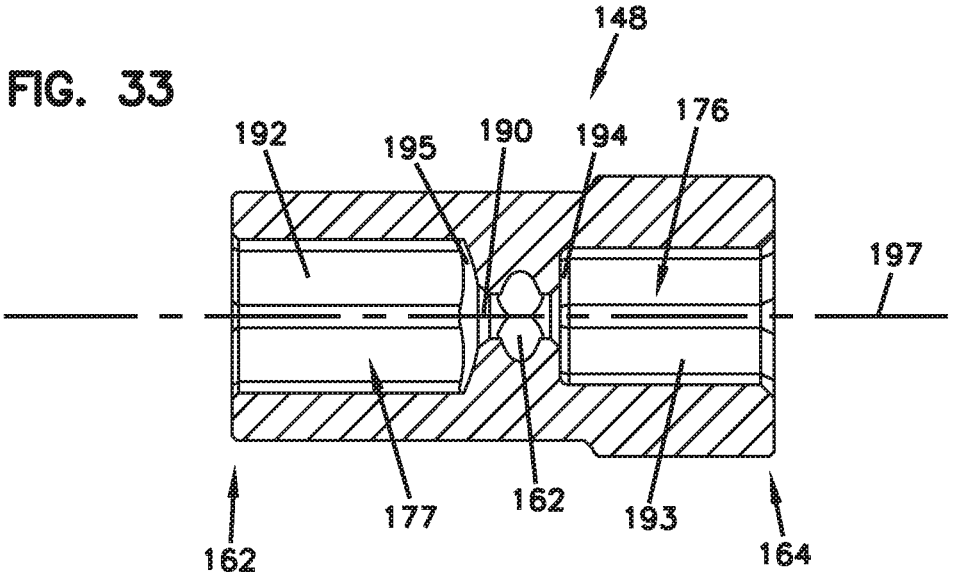
FIG. 33 illustrates a cross-sectional view of the drive coupling of FIG. 29 along line 33-33.

In the depicted example, the coupling fluid flow passage 161 includes a plurality of radial fluid flow passages 188 and an axial fluid flow passage 190. The radial fluid flow passages 188 allow fluid communication between an exterior 189 of the drive coupling 148 and the recesses 176, 177. As shown in FIG. 33, the radial fluid flow passages 188 are positioned around the drive coupling 148 and are in communication with an axial fluid flow passage 190. In some examples, the drive coupling 148 can include a single radial fluid flow passage 188.

Figure 34:
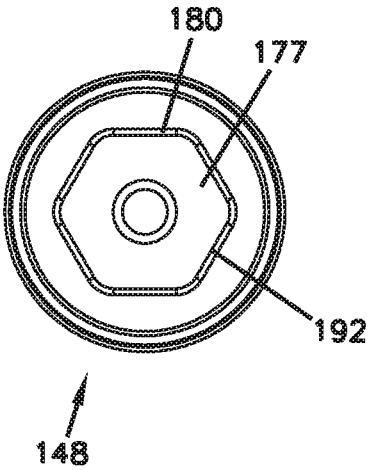
FIG. 34 illustrates an uphole end view of the drive coupling of FIG. 29.

FIG. 32 shows the downhole end 162 of the drive coupling 148, and FIG. 34 shows the uphole end 164 of the drive coupling 148. The drive features 178, 180 of each of the recesses 176, 177 are torque transmitting and radial load bearing. In some examples, the drive features 178, 180 include a plurality of faces 192, 193 that form a polygonal cross-section. In some examples, the faces 192, 193 form a hexagonal profile. The faces 192, 193 can form any cross-sectional profile that is configured to transfer torque while minimizing friction and the potential for jamming (e.g., lobes, flat faces, curved faces, etc.). In some examples, the faces 192, 193 are at least partially heat treated.

As shown in the longitudinal cross-section of FIG. 33, the recesses 176, 177 are connected to one another by the axial fluid flow passage 190. In some examples, the axial fluid flow passage 190 can be as wide as the recesses 176, 177. In other examples, the axial fluid flow passage 190 is disposed between two end faces 194, 195 of each recess 176, 177. In the depicted example, the end wall 195 of the uphole recess 177 has a non-planar construction. In some examples, the end wall 195 has a shape that matches a corresponding shape of an end face 196 of the downhole end 166 of the drive shaft 150. In some examples, the end wall 195 can have a concave shape. In some examples, the drive coupling 148 includes a longitudinal axis 197 that is generally aligned with the drill bit shaft axis 156 when the drill head 110 is assembled.

Figure 35:
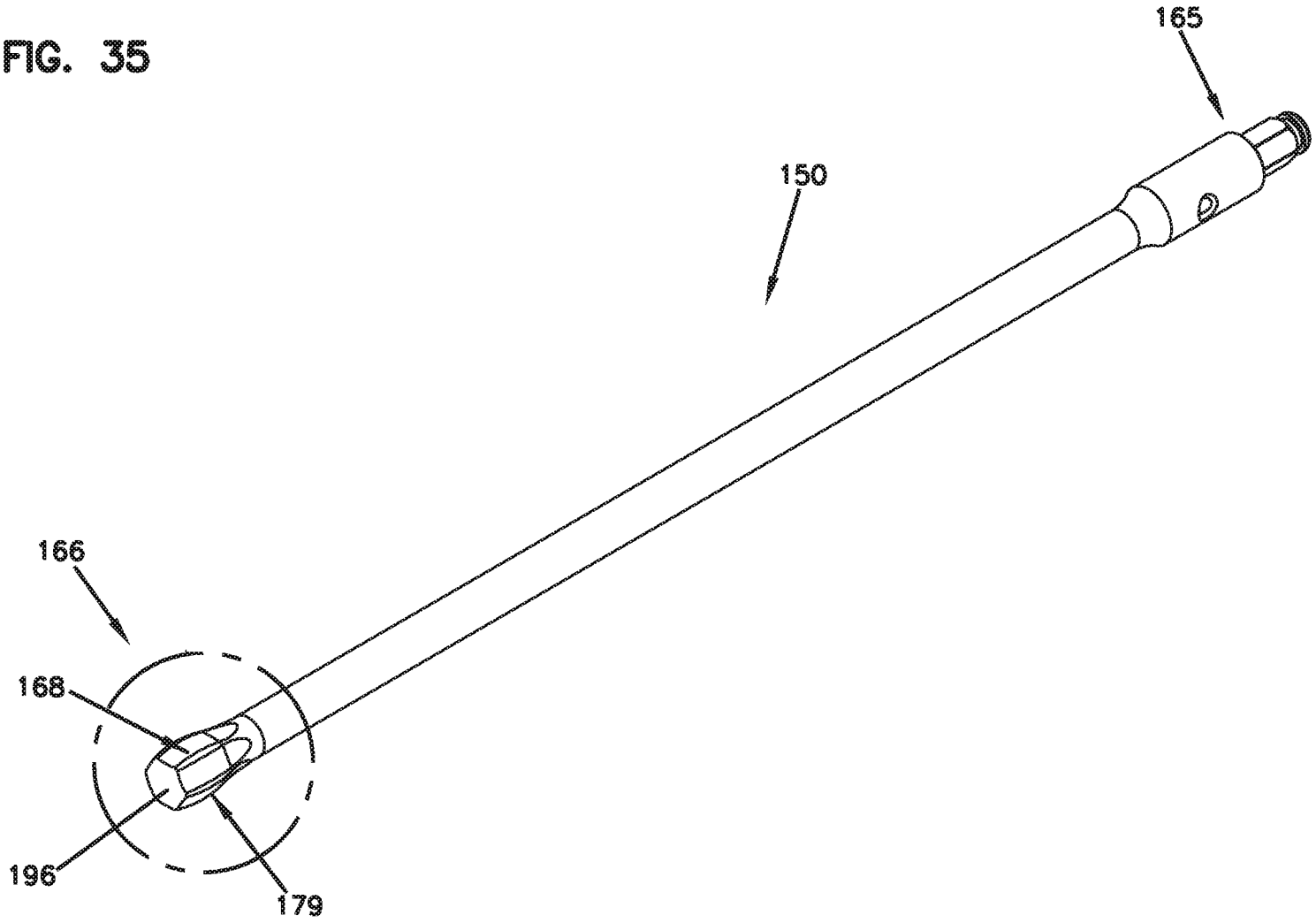
FIG. 35 illustrates a perspective view of a drive shaft, according to one embodiment of the present disclosure.

FIG. 35 shows a perspective view of the drive shaft 150. In some examples, the drive shaft 150 can be a solid, straight shaft without a bend.

Figure 36:
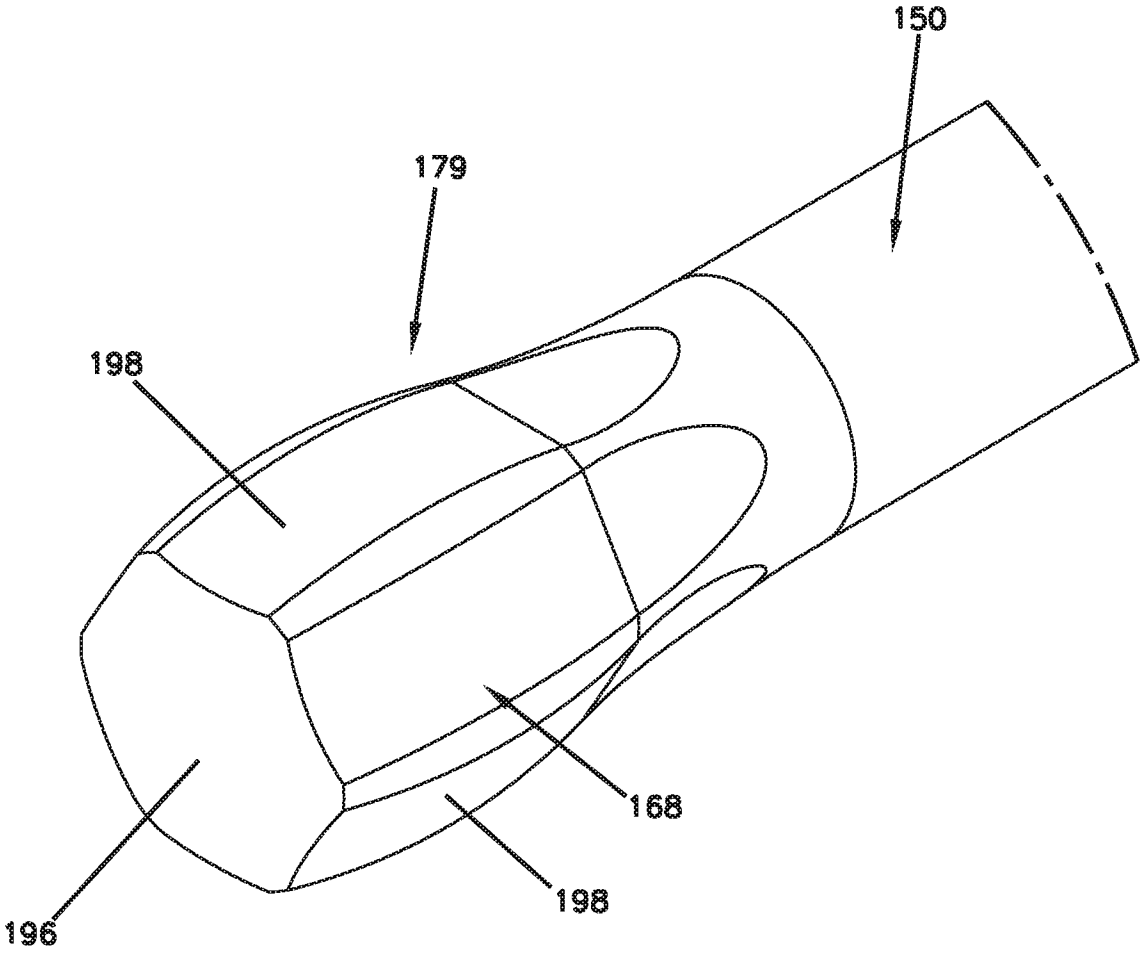
FIG. 36 illustrates a zoomed-in perspective view of a downhole end of the drive shaft of FIG. 35.

FIG. 36 shows a zoomed-in perspective view of the downhole end 166 of the drive shaft 150. The drive features 168 of the downhole end 166 of the drive shaft 150 are torque transmitting and radial load bearing. In some examples, the drive features 168 of the downhole end 166 include a plurality of faces 198. In the depicted example, the projection 179 of the drive shaft 150 is configured to be received within the recess 177 of the drive coupling 148. Accordingly, once received within the drive coupling 148, the drive shaft 150 can transmit torque through the drive coupling 148 and bear radial loads while the drive shaft axis 167 remains misaligned with the drive coupling axis 197.

In some examples, a portion of the downhole end 166 of the drive shaft 150 (e.g., the projection 179) has an outer profile that is generally spherical. In some examples, a portion of the downhole end 166 has an outer profile that is generally an ellipsoid. In other examples, a portion of the downhole end 166 has an outer profile that is generally a prolate spheroid. In other examples still, a portion of the downhole end 166 has an outer profile that is a prolate spheroid with the plurality of faces 198 having a rounded shape. The faces 198 together form a profile that has a generally hexagonal transverse cross-section (shown in FIG. 40). In other examples still, a portion of the downhole end 166 is a crowned spline.

Figures 37, 38, 39, 40, 41, 42, 43, 44:
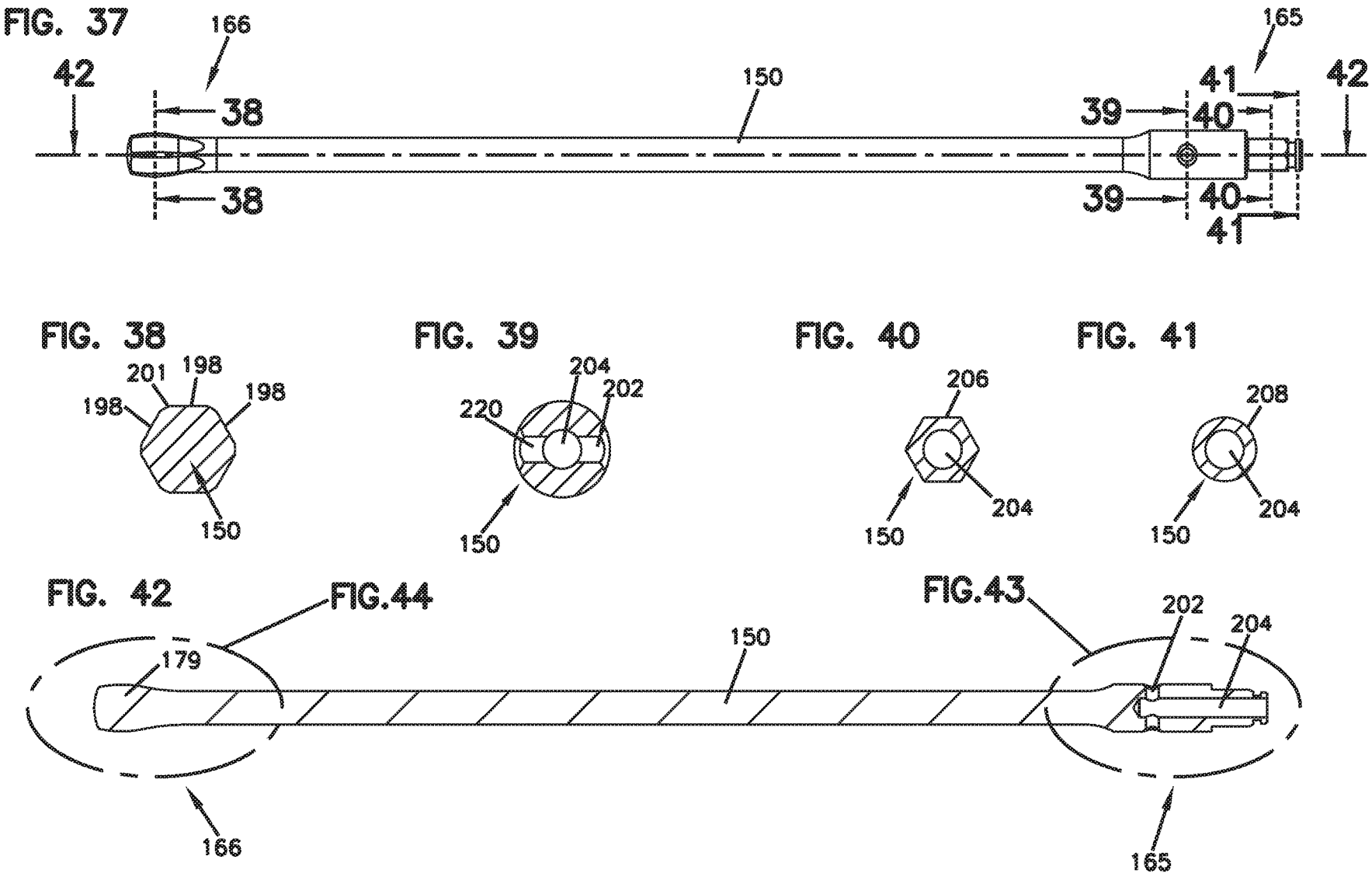
FIG. 37 illustrates a side view of the drive shaft of FIG. 35.
FIG. 38 illustrates a cross-sectional view of the drive shaft of FIG. 37 along line 38-38.
FIG. 39 illustrates a cross-sectional view of the drive shaft of FIG. 37 along line 39-39.
FIG. 40 illustrates a cross-sectional view of the drive shaft of FIG. 37 along line 40-40.
FIG. 41 illustrates a cross-sectional view of the drive shaft of FIG. 37 along line 41-41.
FIG. 42 illustrates a cross-sectional view of the drive shaft of FIG. 37 along line 42-42.
FIG. 43 illustrates a zoomed-in cross-sectional side view of an uphole end of the drive shaft of FIG. 42.
FIG. 44 illustrates a zoomed-in cross-sectional side view of the downhole end of the drive shaft of FIG. 42.
Figure 43:
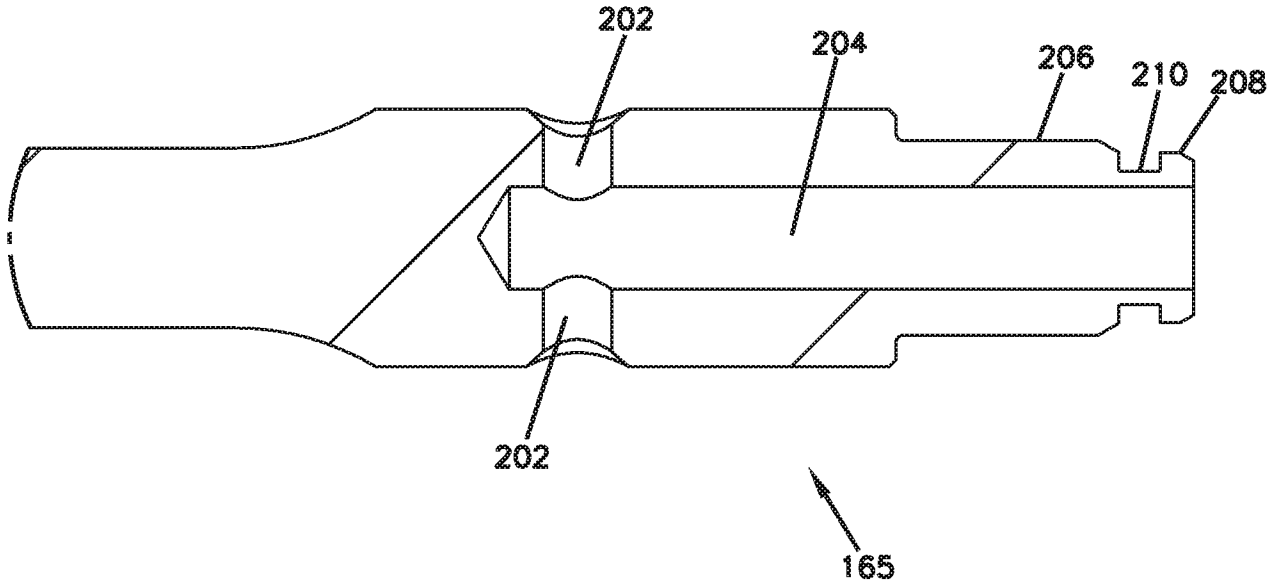
Figure 44:
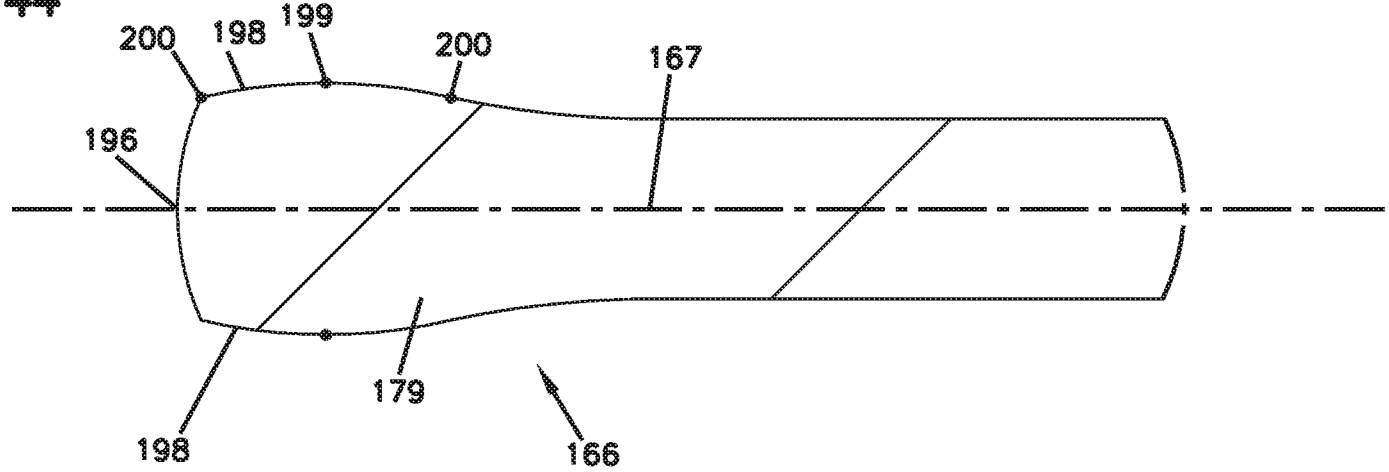

FIG. 37 shows a side view of the drive shaft 150. FIG. 38 shows a transverse cross-section of the drive shaft 150 along line 38-38 of FIG. 37. As shown, the faces 198 form a generally polygonal cross-section. In some examples, the cross-sectional profile can be generally hexagonal. In some examples, the drive features 168 of the drive shaft 150 include transitional faces 201 positioned between circumferentially consecutive faces 198. In some examples, the transitional faces 201 reduce binding between the projection 179 and the drive features 178 of the recess 177 of the drive coupling 148. In some examples, the faces 198 are immediately adjacent the transitional faces 201. In some examples, the faces 198 are at least partially heat treated. In other examples, only about half of each face 198 is heat treated.

FIG. 39 shows a transverse cross-section of the drive shaft 150 along line 39-39 of FIG. 37. The drive shaft 150 includes radial fluid ports 202 and an axial fluid port 204. The axial fluid port 204 is configured to be in fluid communication with the inner rod fluid flow path 107 of the inner drill rod 116 of the drill string 102. The axial fluid port 204 is configured to transmit fluid to the radial fluid ports 202 and into the drive shaft fluid flow passage 170.

FIG. 40 shows a transverse cross-section of the drive shaft 150 along line 40-40 of FIG. 37. The drive shaft 150 includes a plurality of torque-carrying uphole end faces 206 that form a generally polygonal cross-sectional profile. In some examples, the uphole end faces 206 have a generally hexagonal profile. The uphole end faces 206 can form any cross-sectional profile that is configured to transfer torque while minimizing friction and the potential for jamming (e.g., lobes, flat faces, curved faces, etc.). In some examples, the uphole end faces 206 are configured to mate with the inner rod coupling 118 so as to receive torque from the inner rod coupling 118.

FIG. 41 shows a transverse cross-section of the drive shaft 150 along line 41-41 of FIG. 37. The drive shaft 150 includes a non-torque-carrying surface 208 that is configured to be captured within the inner rod coupling 118. However, in the depicted example, the non-torque-carrying surface does not receive torque from the inner rod coupling 118.

FIG. 42 shows a longitudinal cross-section of the drive shaft 150 along line 42-42 of FIG. 37. FIG. 43 shows a zoomed-in side view of the uphole end 165 of the drive shaft 150. The uphole end 165 of the drive shaft 150 includes a groove 210 that is configured to receive at least one pin (not shown) to retain the inner rod coupling 118. The groove 210 is positioned between the torque-carrying uphole end faces 206 and the non-torque-carrying surface 208. In some examples, the groove 210, torque-carrying uphole end faces 206, and the non-torque-carrying surface 208 are substantially similar to the torque-carrying section 121, groove 123, and non-torque-carrying section 125 of the uphole end 111 of the inner drill rod 116.

FIG. 44 shows a zoomed-in side view of the downhole end 166 of the drive shaft 150. As shown, each face 198 has a rounded shape that has a radius of curvature that extends in an axial direction along the drive shaft 150. In some examples, a midpoint 199 of each face 198 is a greater distance away from the drive shaft axis 167 than end points 200 of each face 198.

Figure 45:
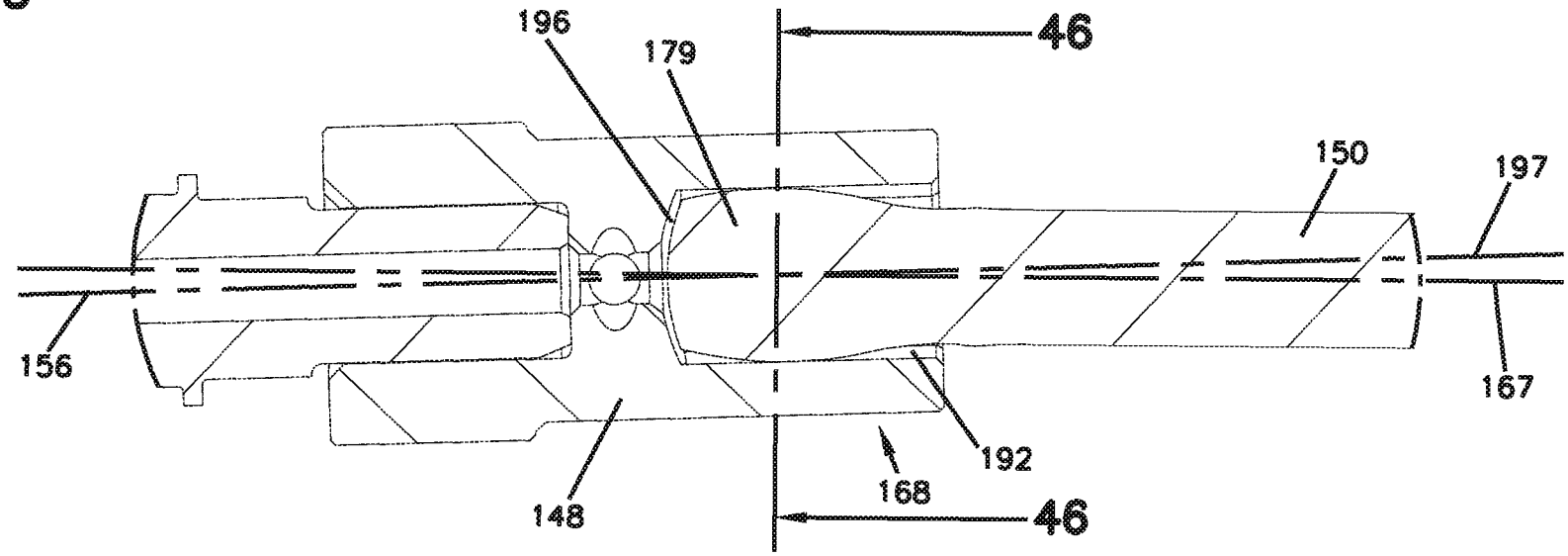
FIG. 45 illustrates a zoomed-in cross-sectional side view of a drive coupling and drive shaft of the inner assembly of FIG. 24.

FIG. 45 shows a zoomed-in schematic cross-sectional view of the drive shaft 150 positioned within the drive coupling 148. As described above, the drive shaft axis 167 is misaligned with the drive coupling axis 197. Specifically, the drive coupling axis 197 is aligned with the drill bit shaft axis 156.

Figure 46:
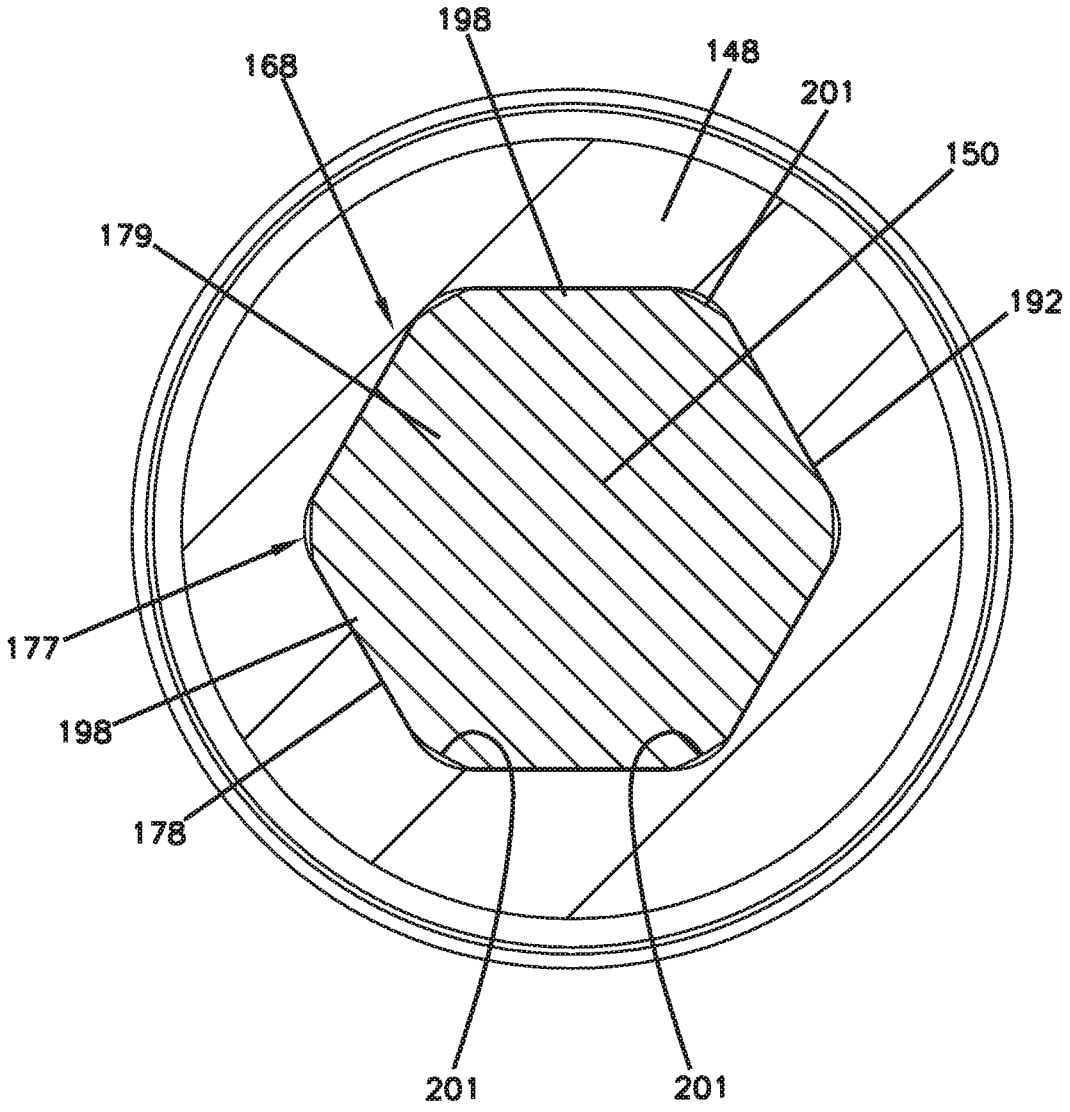
FIG. 46 illustrates a zoomed-in cross-sectional view of the drive coupling and drive shaft of FIG. 45 along line 46-46.

FIG. 46 shows a cross-sectional view along line 46-46 of FIG. 45. In some examples, the transitional faces 201 do not make contact with the drive features 178 of the recess 177 and, thereby, allow fluid flow around the projection 179 while the projection 179 is mated with the drive features 178 of the drive coupling 148.

Therefore, when the drive coupling 148 and drive shaft 150 are positioned within the drill head 110, fluid flow is permitted from the drive shaft fluid flow passage 170 into the drive coupling 148 at both the recess 177 and the radial fluid flow passages 188. Such fluid flow allows for a lubricated connection between the drive shaft 150 and the drive coupling 148 at the recess 177. Fluid flow is further permitted along the axial fluid flow passage 190 in the drive coupling and then finally into the inner fluid flow cavity 145 of the drill bit shaft 142.

Figure 47:
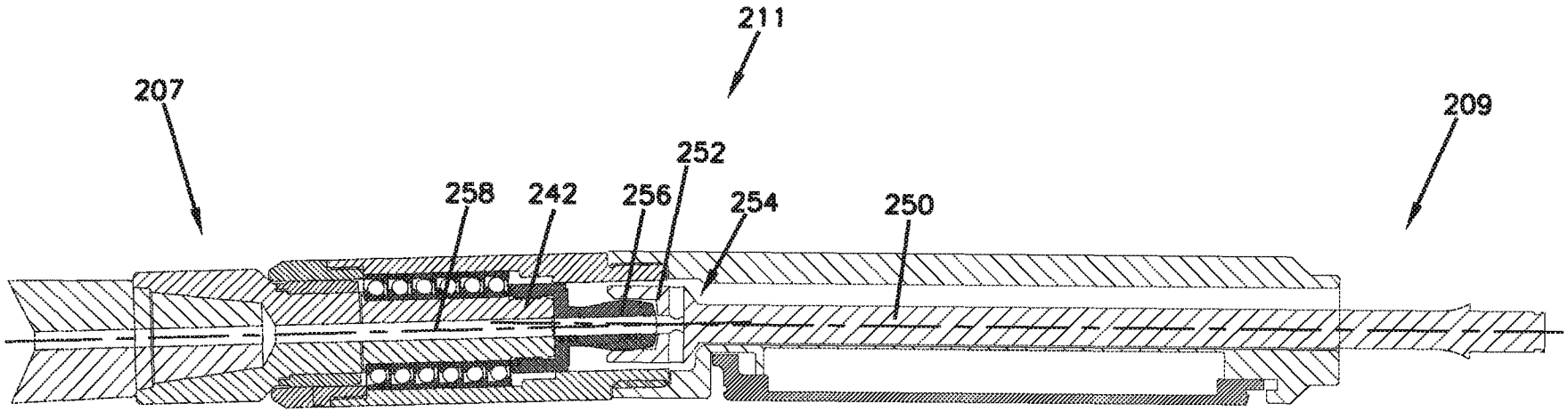
FIG. 47 illustrates a side cross-sectional view of a drill head, according to one embodiment of the present disclosure.

FIG. 47 show a drill head 211 with an uphole end 209 and a downhole end 207, according to another embodiment of the present disclosure. The drill head 211 includes a drive shaft 250 that includes a recess 252 at a downhole end 254. The recess 252 is configured to mate with a projection 256 attached to a drill bit shaft 242 having a casing axis 258. The recess 252 is configured to transfer torque from the drive shaft 250 to the drill bit shaft 242. In some examples, the projection 256 is substantially similar to the projection 179 of the drive shaft 150, described above. Further, the recess 252 of the drive shaft 250 is substantially similar to the recess 177 of the drive coupling 148, described above.

Figure 48:
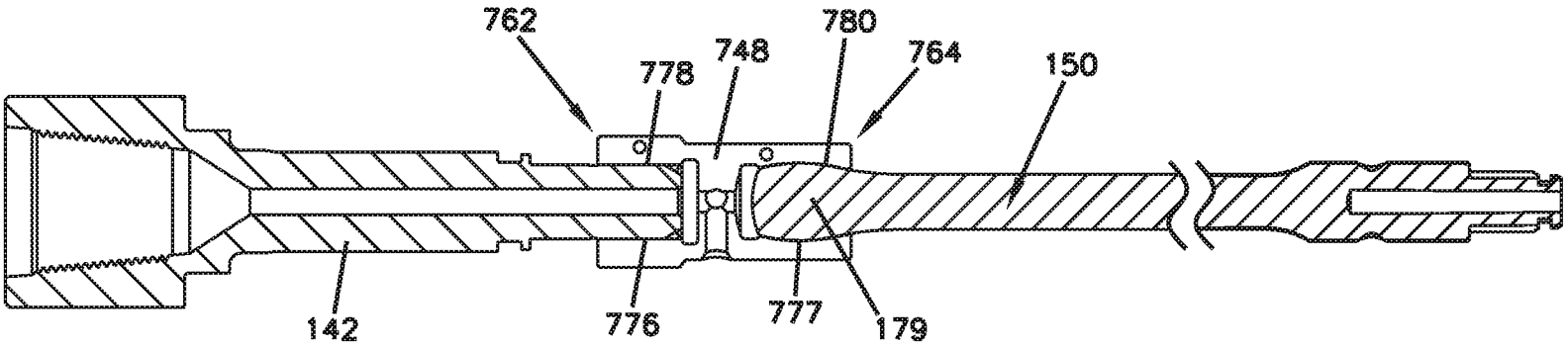
FIG. 48 illustrates a zoomed-in cross-sectional side view of a drive coupling and drive shaft, according to one embodiment of the present disclosure.

FIG. 48 shows the drill bit shaft 142 coupled to the drive shaft 150 via a drive coupling 748. As shown, the drive coupling 748 is substantially similar to the drive coupling 148 described above. The coupling 748 includes a pair of recesses 776, 777 that are configured to mate with the drill bit shaft 142 and the drive shaft 150, respectively. Each recess 776, 777 includes drive features 778, 780 that are torque transmitting and radial load bearing. As shown, the drive features 780 of the recess 777 that receives the drive shaft 150 can have a cross sectional profile that generally matches the cross sectional profile of the projection 179 of the drive shaft 150. In some examples, the drive features 780 are rounded, or curved as the drive features 780 extend in a longitudinal direction generally towards an uphole end 764 or a downhill end 762 of the drive coupling 748. In some examples, the drive features 780 form a polygonal lateral cross-sectional profile, like the drive features 180 described above. In some examples, the drive features 780 have a generally hexagonal lateral cross-sectional profile. In some examples, the drive features 780 can form any lateral cross-sectional profile that is configured to transfer torque while minimizing friction and the potential for jamming. In some examples, the drive features 780 are at least partially heat-treated.

It is considered within the scope of the present disclosure that any drive shaft and drive coupling disclosed herein can have generally rounded longitudinal cross-sectional profiles. Like in the example shown in FIG. 48, both the drive features 168 of the draft shaft 150 and the drive features 780 of the drive coupling 748 can include rounded longitudinal cross-sectional profiles. Like in the example shown in FIG. 45, the drive features 168 of the draft shaft 150 have rounded longitudinal cross-sectional profiles while the drive features 180 of the drive coupling 148 have straight/flat longitudinal cross-sectional profiles. In other examples, the drive features 168 of the draft shaft 150 have straight/flat longitudinal cross-sectional profiles and the drive features 180, 780 of the drive coupling 148, 748 have rounded longitudinal cross-sectional profiles.

In some examples, the drive coupling 748 and/or the drive shaft 150 can be assembled with one another to prevent decoupling from one another during a drilling operation. In some examples, the assembly to prevent decoupling can include press-fitting the drive coupling 748 and drive shaft 150 together. In some examples, the assembly to prevent decoupling can include heating at least one of the drive coupling 748 and drive shaft 150 prior to coupling. In some examples, the assembly to prevent decoupling can include providing a seam on the drive coupling 748 (or the drive shaft 250 as shown in the embodiment shown in FIG. 47) to allow the drive coupling 748 to be separated into multiple pieces. The multiple pieces can then be secured around the drive shaft 150 by, for example, a fastener such as an adhesive, a bolt(s), a screw(s), a weld, or other type fastener.

Figure 49:
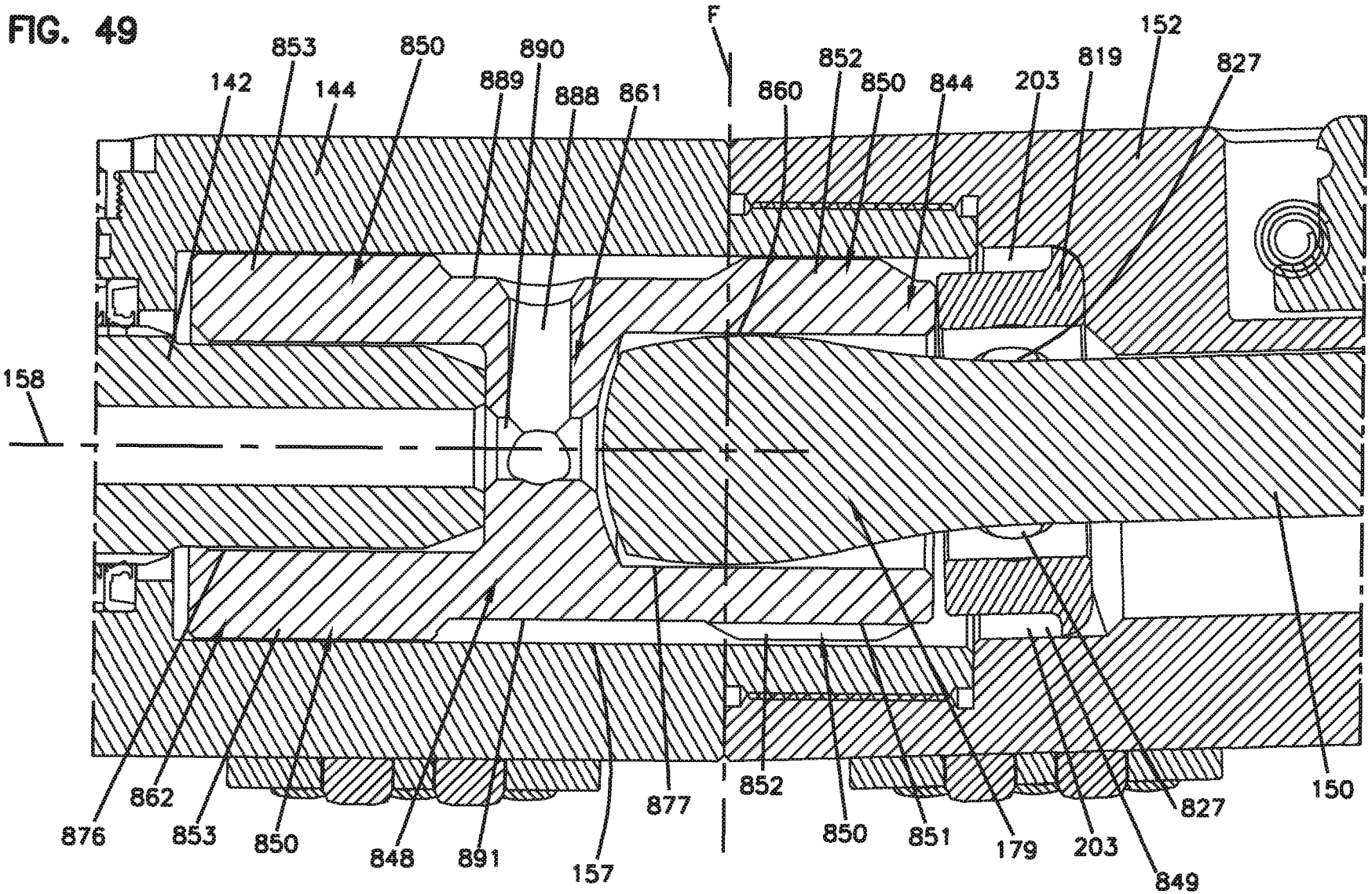
FIG. 49 illustrates a side cross-sectional view of a drill head, according to one embodiment of the present disclosure.

FIG. 49 shows a flow collar 819 adjacent a drive coupling 848 and within the drill head 110, according to one example of the present disclosure.

The flow collar 819 is substantially similar to the flow collar 119. The flow collar 119 is shown positioned around drive shaft 150, adjacent the drive coupling 848. In some examples, the main casing 152 defines a recess 203 in communication with the recess 157 of the end casing 144 when the end casing 144 and the main casing 152 are attached to one another. In some examples, the flow collar 819 is positioned within the recess 203 of the main casing 152, around the drive shaft 150. The flow collar 819 aids in preventing axial movement of the drive coupling 848 within the recess 157 of the end casing 144, yet also permits fluid flow from around the drive shaft 150 to around the drive coupling 848.

The flow collar 819 includes a plurality of peripheral fluid passages 827. The peripheral fluid passages 827 allow fluid flow from the annular fluid flow path 105 around the drive shaft 150 to an annular fluid flow passage 849 defined between the flow collar 819 and the recess 203 and also between the recess 157 and the drive coupling 848. Therefore, fluid is not only allowed around the projection 179 within the drive coupling 848 (i.e., coupling lubrication), but fluid flow is also facilitated by the flow collar 819 to flow around the drive coupling 848 within the recess 157. In some examples, the flow collar 819 is positioned within the recess 157. In some examples, the flow collar 819 is positioned to move freely within the recess 203. In other examples, the flow collar 819 is press fit into at least one of the recesses 157, 203.

The drive coupling 848 is substantially similar to the drive couplings 148, 748 disclosed herein. Accordingly, the drive coupling 848 has a pair of recesses 876, 877 at downhole and uphole ends 862, 864 that are configured to mate with the drill bit shaft 142 and drive shaft 150, respectively. In the depicted example, the drive coupling 848 includes a coupling fluid flow passage 861 that includes at least one radial fluid flow passage 888 and an axial fluid flow passage 890, the radial fluid flow passage 888 extending between an exterior surface 889 and the axial fluid flow passage 890.

The exterior surface 889 of the drive coupling 848 includes portions that have different outer dimensions (e.g., outer diameters) to allow fluid flow around the drive coupling 848 within the recess 157 of the end casing 144. Specifically, fluid flow is permitted around the exterior surface 889 of the uphole end 864 of the drive coupling 848. Fluid can travel in and out of the radial fluid flow passage 888 so as to lubricate the recesses 876, 877. Therefore, portions 891 of the exterior surface 889 are dimensioned smaller than the recess 157 of the end casing 144 to allow fluid flow therebetween. However, alignment of the drive coupling 848 within the recess 157 is desired to reduce premature wear. In order to stabilize the drive coupling 848 within the recess 157, the drive coupling 848 includes balancing features 850 disposed on exterior surface 889 that are configured to aid in stabilizing the drive coupling 848 within the recess 157 of the end casing 144. However, sufficient space must be maintained between the recess 157 and the drive coupling 848, because, during a drilling operation, the drive shaft 150 transfers rotation to the bit shaft 142 through the drive coupling 848, thereby rotating the drive coupling 848. Because of this, at least at points during the drilling operation, the drive coupling 848 rotates with the drive shaft 150 within, and relative to, the recess 157 in the end casing 144.

The balancing features 850 are dimensioned more closely to the dimension of the recess 157, and larger than the portions 891, to permit rotational movement between the drive coupling 848 and the recess 157 but limit substantial relative movement transverse to the end casing axis 158 between the drive coupling 848 and the recess 157. In some examples, this aids in reducing movement (e.g., wobbling) of drive coupling 848 generally perpendicular to the end casing axis 158. Such movement can be brought on by bending forces exerted on the drive coupling 858 by the drive shaft 150, specifically the projection 179 exerting forces within the recess 877. The bending forces can originate uphole in the inner drill rod 116 of the drill string 102. Relative movement of the drive coupling 848 within the recess 157 can cause the projection 179 in the recess 877 of the drive coupling to loosen (i.e., "walk") within the recess 877 of the drive coupling 848. Such walking can distribute bending forces from the drive shaft 150 differently, thereby causing wear at the drive coupling 848, the recess 157, and/or the drill bit shaft 142. By reducing relative movement of the drive coupling 848 in the recess 157, the loosening of the connection between the projection 179 of the drive shaft 150 and the recess 877 of the drive coupling 848 is reduced, thereby limiting premature wear.

In some examples, the balancing features 850 include uphole balancing features 852 at the uphole end 864 and downhole balancing features 853 at the downhole end 862 of the drive coupling 848. However, because stabilizing and fluid flow is desired, especially around the uphole end 864, the uphole balancing features 852 include fluid flow passages 851 to allow fluid flow between uphole end 864 and the recess 157 of the end casing 144.

As shown in FIG. 49, the projection 179 of the drive shaft 150 is shown to be positioned within the recess 877 of the drive coupling 848 so that a force inducing portion 860 is aligned with a connection of the end casing 144 and the main casing 152, traverse to the end casing axis 152. Such alignment is depicted as plane F.

Figure 50:
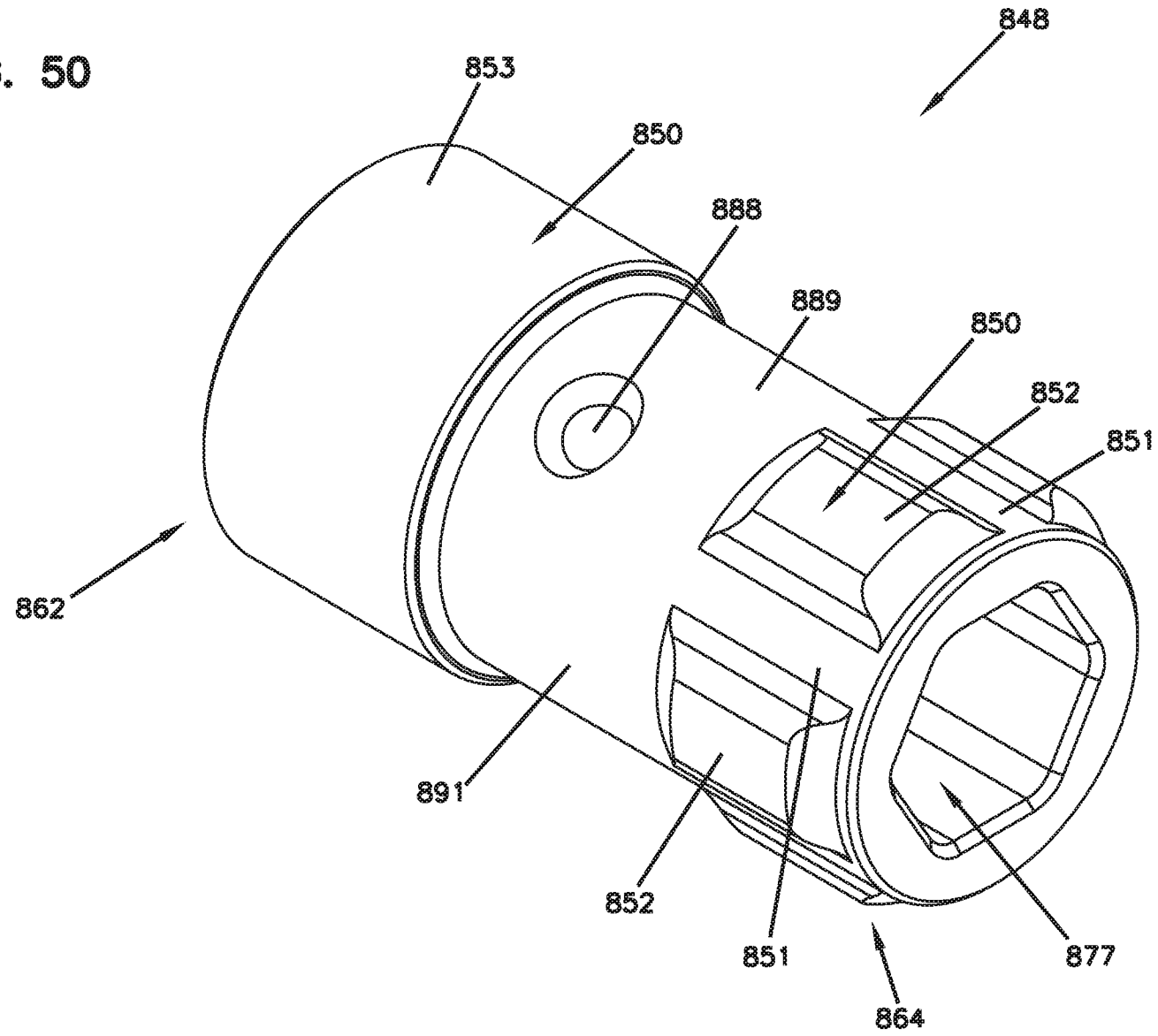
FIG. 50 illustrates a perspective view of the drive coupling of FIG. 48.
Figure 51:
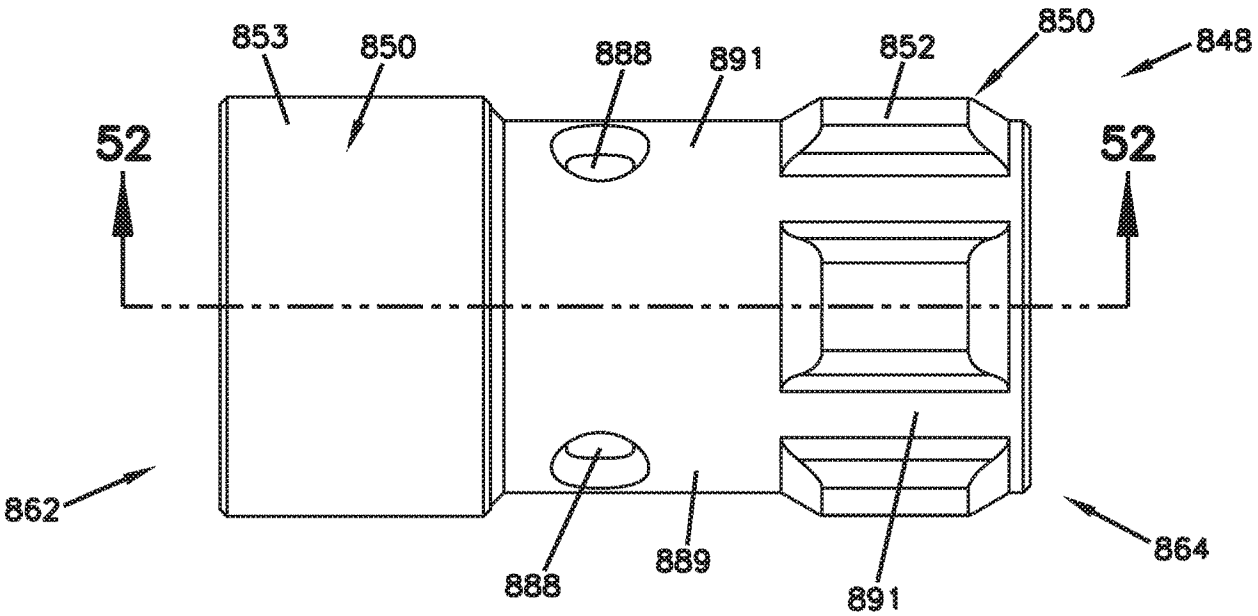
FIG. 51 illustrates a side view of the drive coupling of FIG. 48.
Figure 52:
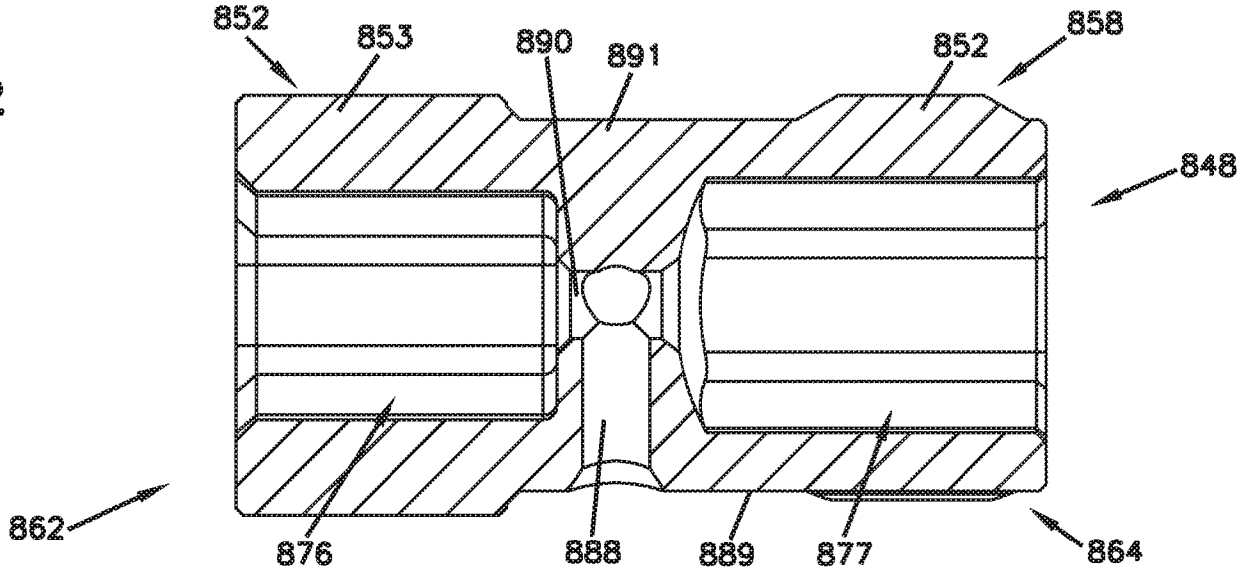
FIG. 52 illustrates a cross-sectional view of the drive coupling of FIG. 48 along line 52-52.
Figure 53:
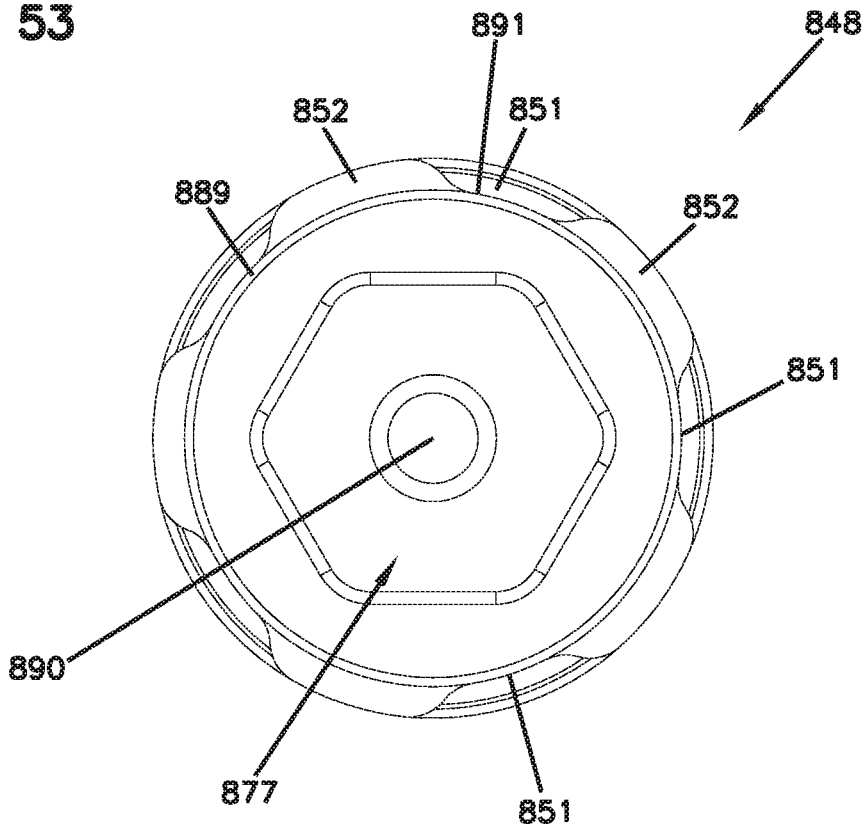
FIG. 53 illustrates an uphole end view of the drive coupling of FIG. 48.
Figure 57:
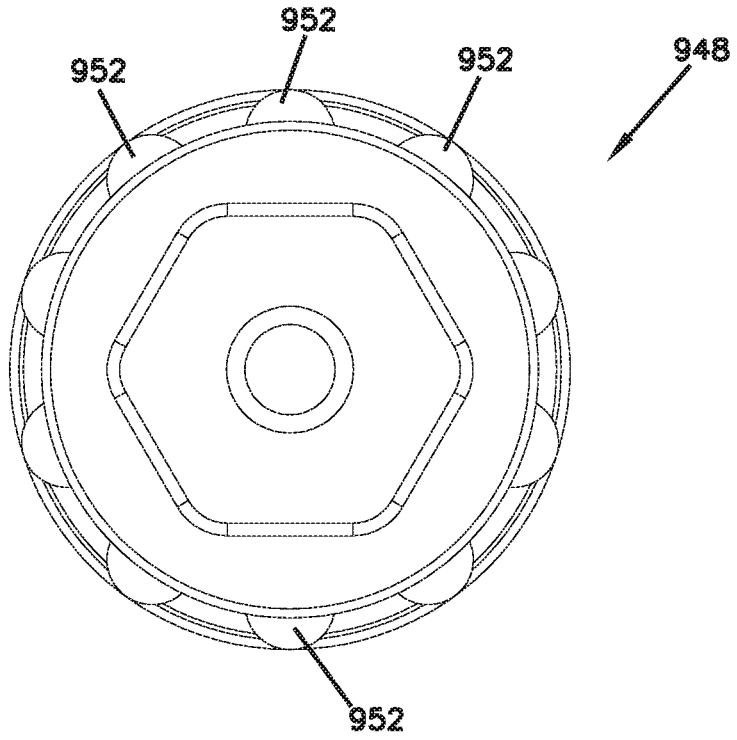
FIG. 57 illustrates an uphole end view of the drive coupling of FIG. 54.
Figure 54:
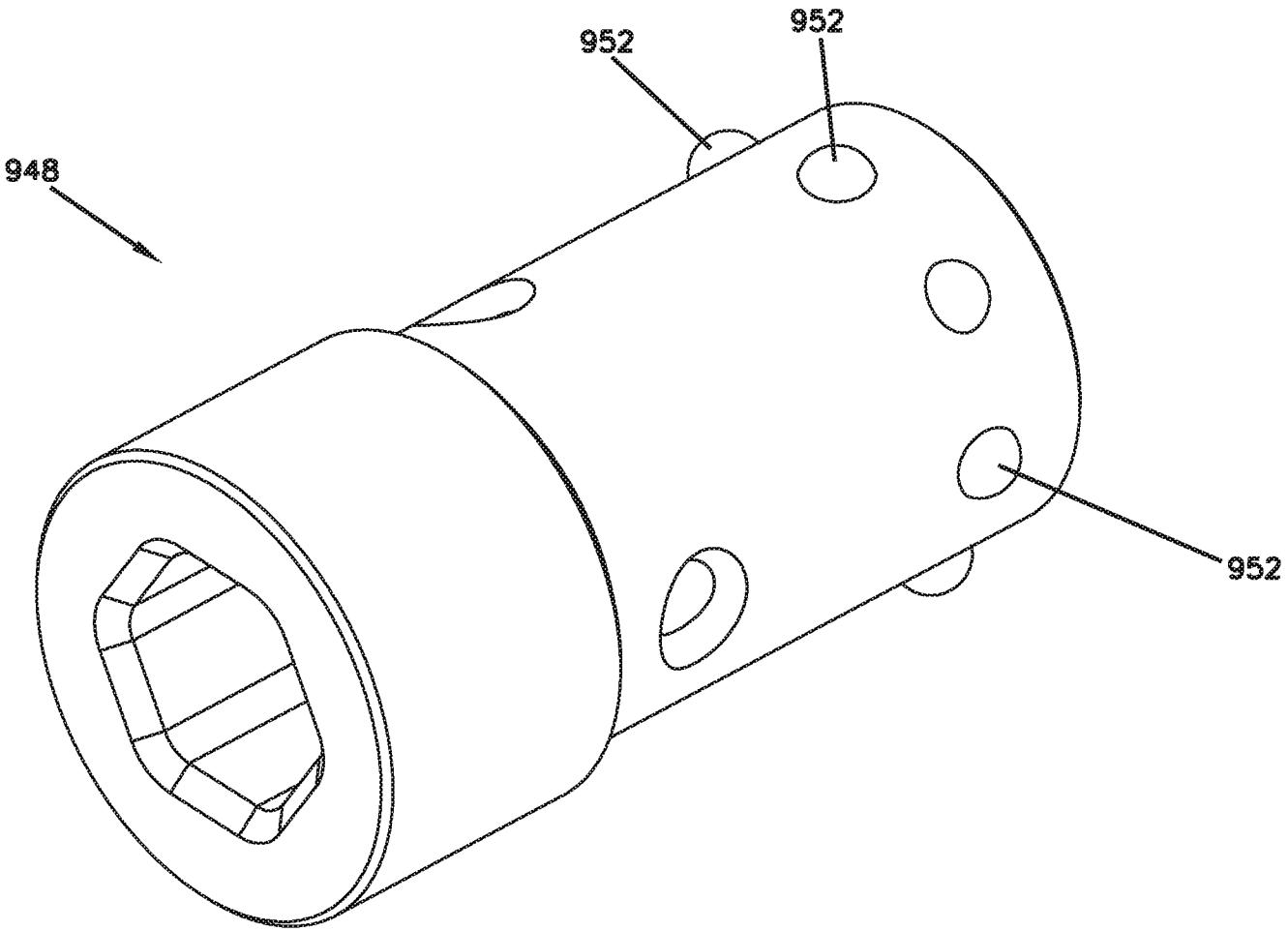
FIG. 54 illustrates a perspective view of a drive coupling, according to one embodiment of the present disclosure.
Figure 55:
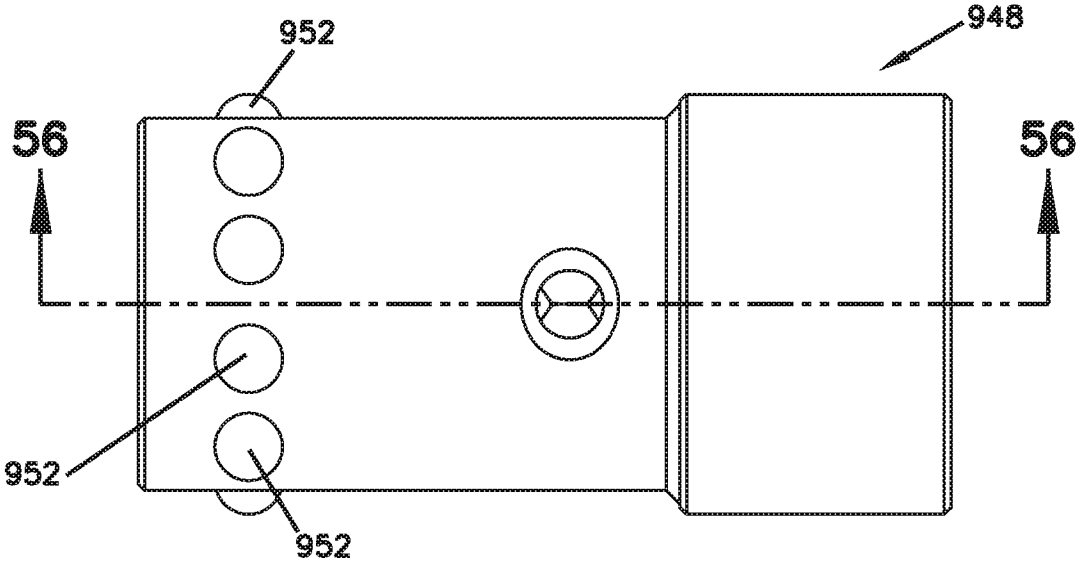
FIG. 55 illustrates a side view of the drive coupling of FIG. 54.
Figure 56:
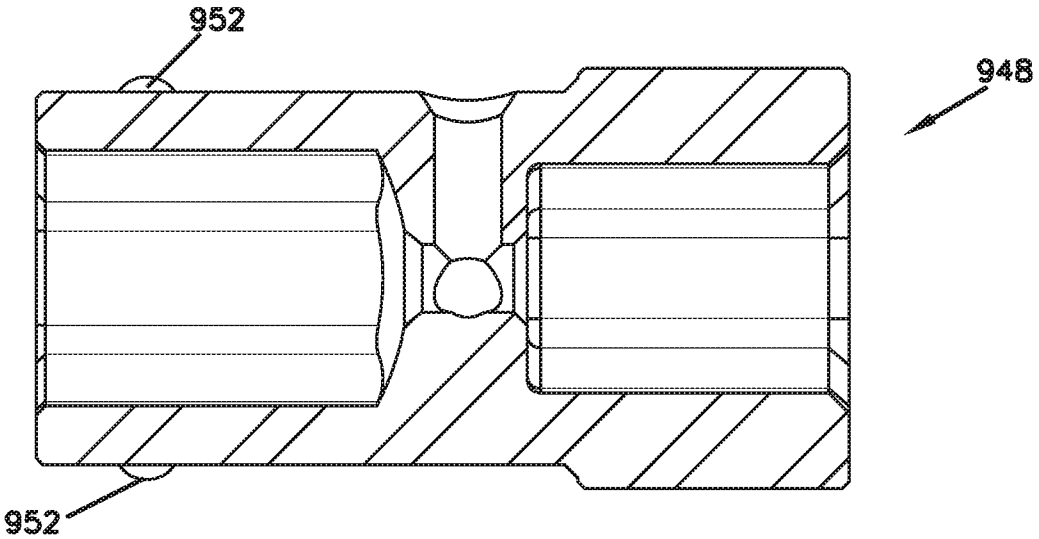
FIG. 56 illustrates a cross-sectional view of the drive coupling of FIG. 54 along line 56-56.
Figure 58:
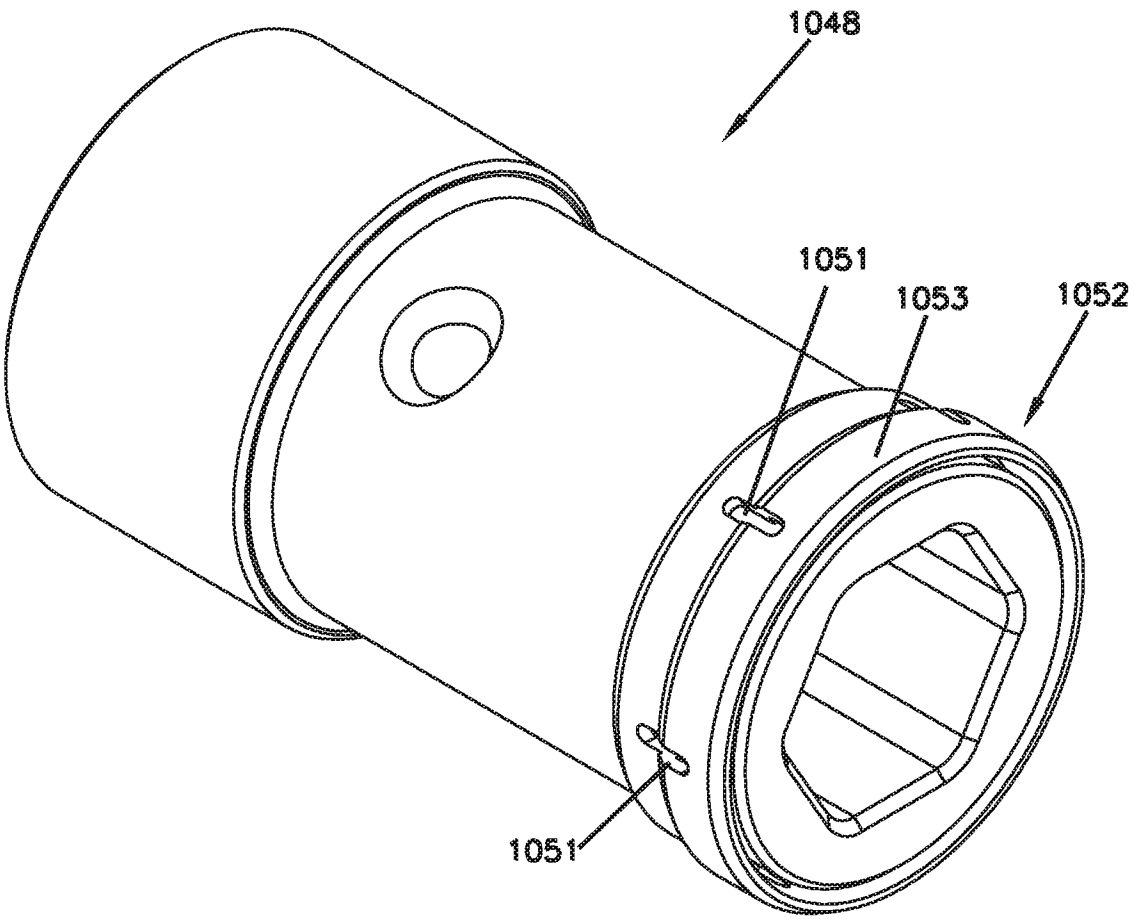
FIG. 58 illustrates a perspective view of a drive coupling, according to one embodiment of the present disclosure.
Figure 59:
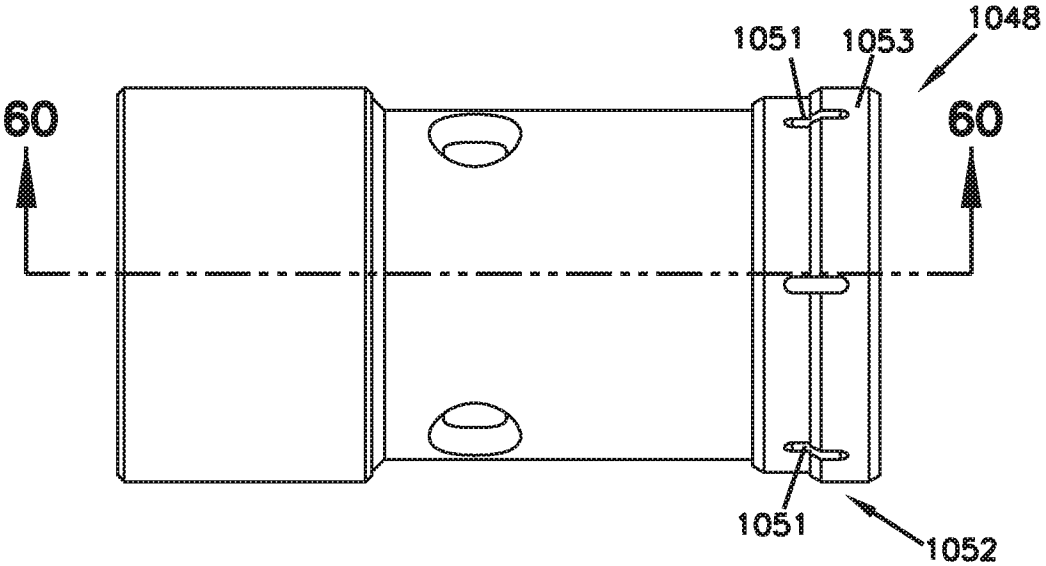
FIG. 59 illustrates a side view of the drive coupling of FIG. 58.
Figure 60:
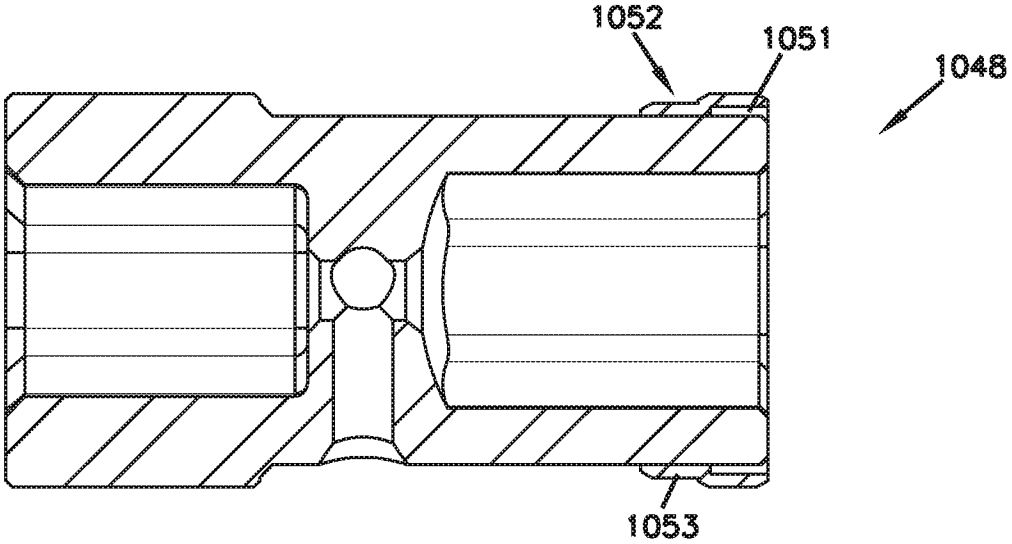
FIG. 60 illustrates a cross-sectional view of the drive coupling of FIG. 58 along line 60-60.
Figure 61:
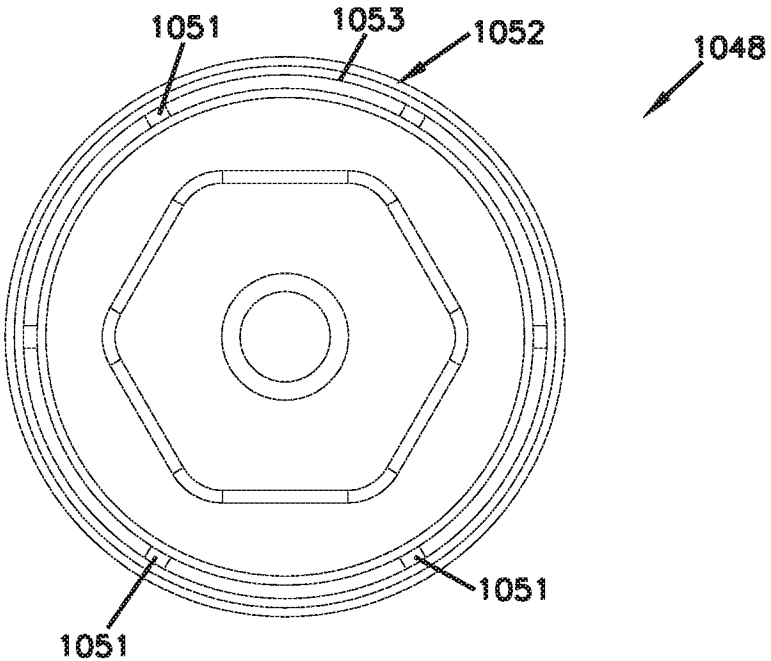
FIG. 61 illustrates an uphole end view of the drive coupling of FIG. 58.

FIG. 50 shows a perspective view of the drive coupling 848. FIG. 51 shows a side view of the drive coupling 848. FIG. 52 shows a longitudinal cross-section of the drive coupling 848 along line 52-52 in FIG. 51. FIG. 53 shows an uphole end view of the drive coupling 848. As shown, the balancing features 850 are generally disposed on the exterior surface 889 at the downhole end 864 and uphole end 862. As shown in FIGS. 49-53, uphole balancing features 852 include the fluid flow passages 851. The uphole balancing features 852, as shown in FIGS. 49-52, are generally rectangular projections. However, it is considered within the scope of the present disclosure that the uphole balancing features can be configured in a variety of different ways to achieve stabilization and allow fluid flow therethrough. In other examples, the uphole balancing features 852 can be secured to the exterior surface 889 of the drive coupling 848 by, for example, a fastener (e.g., bolt, adhesive, weld, etc.).

Figure 62:
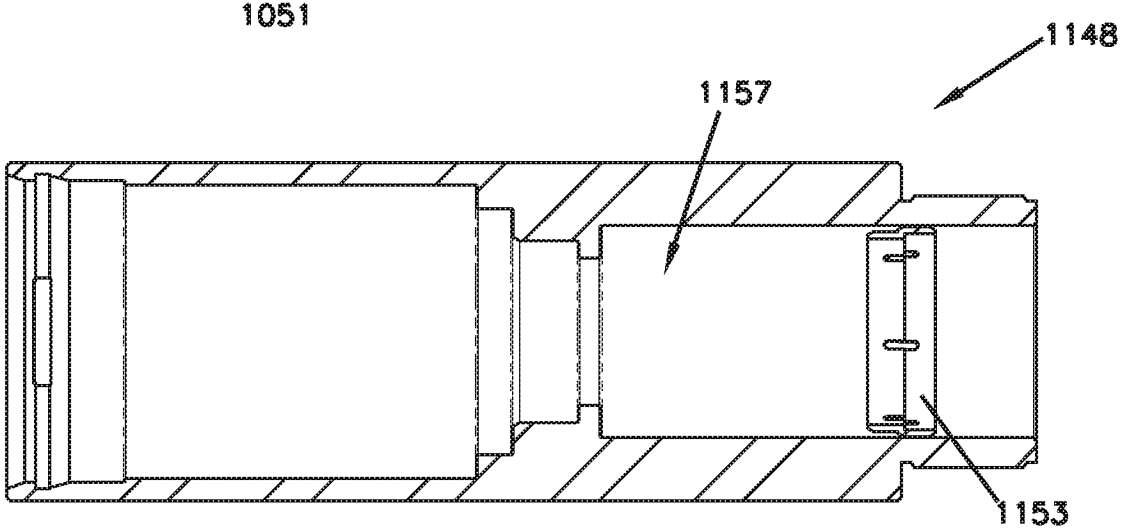
FIG. 62 illustrates a longitudinal cross-sectional view of an end casing with a balancing feature, according to one embodiment of the present disclosure.

FIGS. 54-57 depict a drive coupling 948 with uphole balance features 952 that are partiality spherical in nature. FIGS. 58-61 depict a drive coupling 1048 with uphole balancing features 1052 in the form of a sleeve 1053 with a plurality of fluid flow passages 1051 disposed therein. Alternatively, as shown in FIG. 62, a recess 1157 of an end casing 1144, which are substantially similar to the recess 157 of the end casing 144 described above, can include a sleeve 1153 disposed therein (i.e., press fit, fastened, or integrally formed with) to act as a balancing feature for a drive coupling positioned within the recess 1157. In some examples, the sleeve 1153 is substantially similar to the sleeve 1053. Accordingly, a drive coupling, such as the drive coupling 148 described above, can be positioned within the recess 1157.

Figure 63:
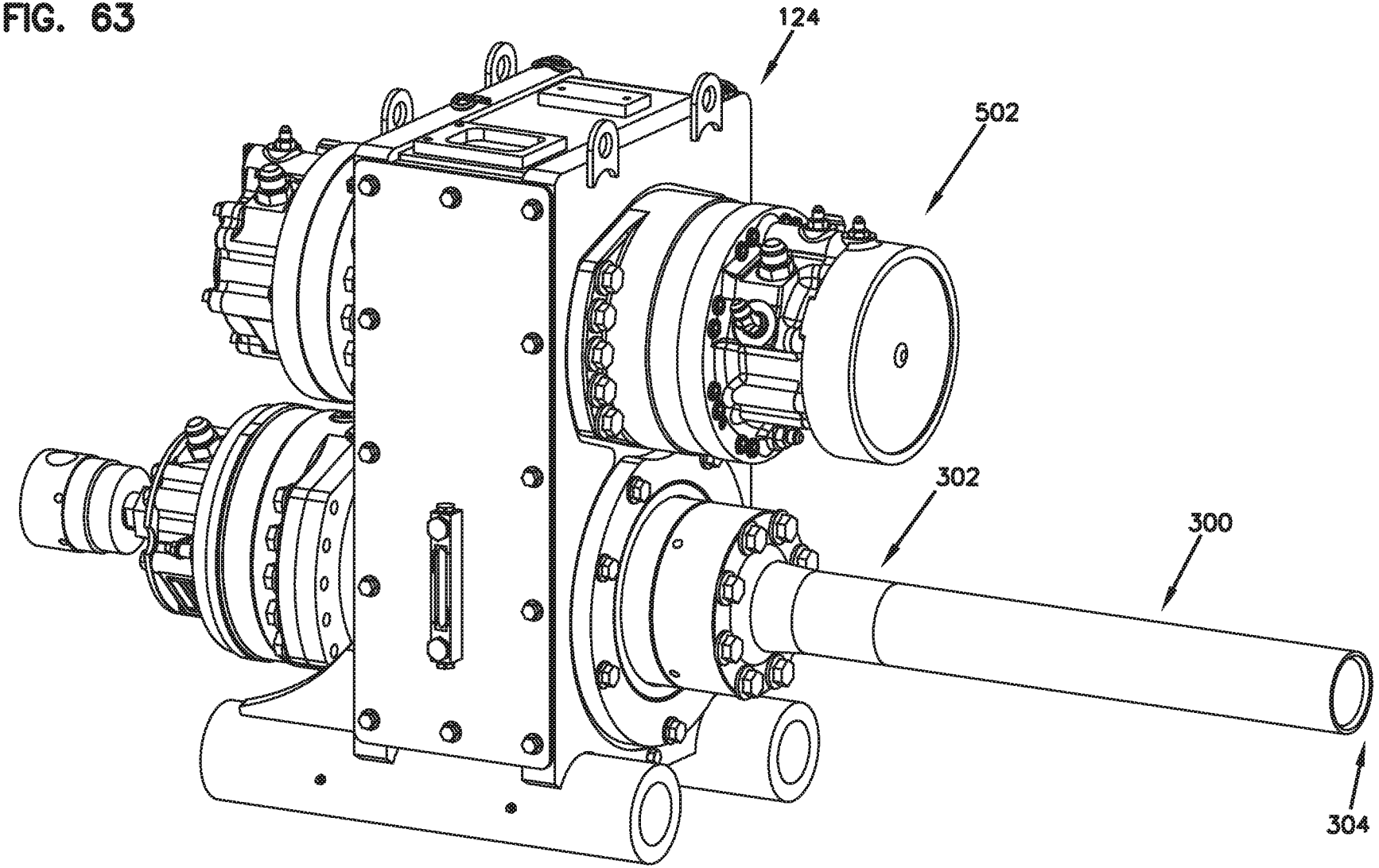
FIG. 63 illustrates a perspective view of a gearbox including a sub saver, according to one embodiment of the present disclosure.

FIG. 63 shows a perspective view of the gearbox 124 with a sub saver 300 installed on a front end. The gearbox 124 is configured to drive the drill rod assemblies 106, specifically the outer drill rods 114 and inner drill rods 116. In some examples, the sub saver 300 can first be installed onto the inner and outer drive shafts of the gearbox 124, and then a drill rod assembly 106 can be attached to, and driven by, the sub saver 300 and gearbox 124 assembly. The sub saver 300 is attached at a rear end 302 to a front side 502 of the gearbox 124 and further configured to attach to the outer and inner drill rods 114, 116 at a front end 304.

Figure 64:
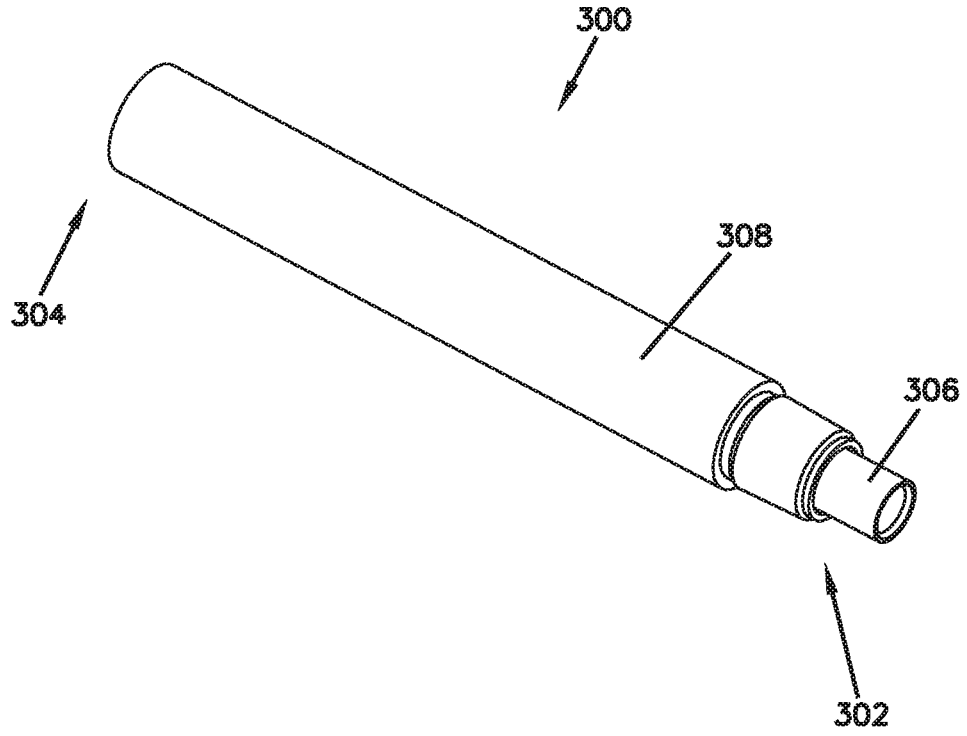
FIG. 64 illustrates another perspective view of the sub saver of FIG. 63.
Figure 65:
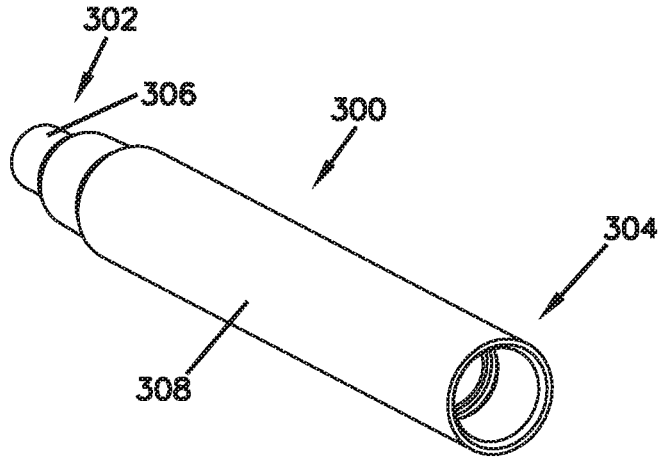
FIG. 65 illustrates another perspective view of the sub saver of FIG. 63.

FIGS. 64 and 65 show perspective views of the sub saver 300. The sub saver 300 includes an inner rod member 306 contained within an outer rod member 308. The outer rod member 308 is configured to drive the outer drill rod 114 of the drill rod assembly 106, and the inner rod member 306 is configured to drive the inner drill rod 116 of the drill rod assembly 106.

Figure 66:
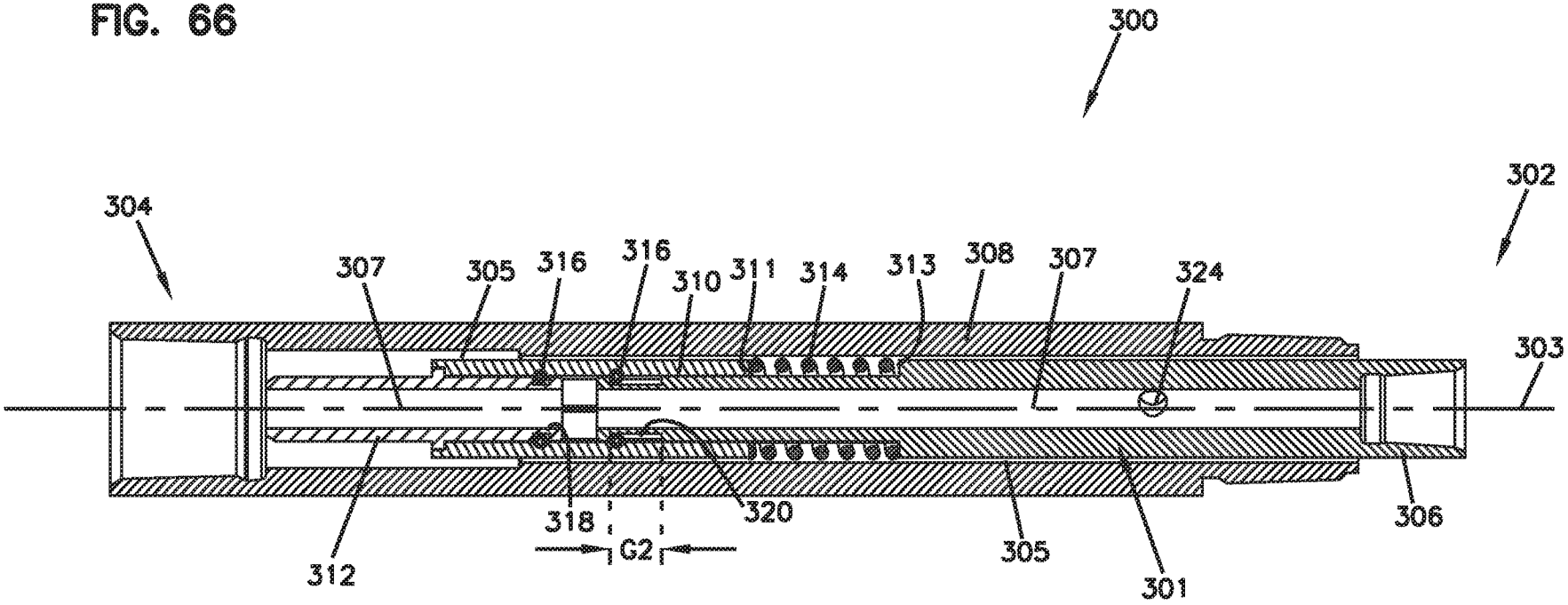
FIG. 66 illustrates a side cross-sectional view of the sub saver of FIG. 63.

FIG. 66 shows a longitudinal cross-section of the sub saver 300. The sub saver 300 includes an inner assembly 301 that is configured to be positioned within, and rotated separately about a longitudinal axis 303 of the sub saver 300 from, the outer rod member 308. The inner assembly 301 includes the inner rod member 306, a sub saver coupling 310, an inner rod adapter 312, and a sub saver spring 314.

The inner rod adapter 312 is positioned within the sub saver coupling 310 together with the inner rod member 306. In some examples, both the inner rod adapter 312 and the inner rod member 306 are retained within the coupling using pins 316 positioned in respective grooves 318, 320. Such a pin and groove arrangement is substantially similar to the pin and groove arrangement of the inner rod coupling 118, inner drill rod 116, and drive shaft 150 described above. In some examples, the groove 320 of the inner rod member 306 has a width G2 that is greater than the width of the pins 316. In some examples, an elongated groove having a width greater than the width of the pins 316 can be defined by the inner rod adapter 312, instead of the inner rod member 306. In other examples still, an elongated groove having a width greater than the width of the pins 316 can be defined by cross apertures 332 of the sub saver coupling 310.

In operation, the inner rod adapter 312 and sub saver coupling 310 are slidably attached to the inner rod member 308 so as to be configured to move axially along the longitudinal axis 303 separate from the inner rod member 306. During such axial movement, the inner rod adapter 312 and sub saver coupling 310 act upon the sub saver spring 314 that is captured between the inner rod member 306 and the sub saver coupling 310. The sub saver spring 314 biases the sub saver coupling 310 and inner rod adapter 312 to a first position. The first position is a position of the inner rod adapter 312 in which there is no force exerted by the inner rod adapter 312 on the sub saver spring 314 by an inner drill rod 116. Accordingly, the inner rod adapter 312 can be positioned in any position between the first position and a position where the spring 314 is completely compressed.

As noted above, the inner and outer drill rods 116, 114 have differing lengths and each drill rod assembly 106 is configured to allow movement of the inner drill rod 116 within the outer drill rod 114, such movement being limited by the flow collar 119 and the inner rod coupling 118/618. However, this movement results in different relative positioning of the uphole ends 111 of the inner and outer drill rods 116, 114 of the most-uphole drill rod assembly 106. For example, in some situations, the outer rod interfacing surface 163 of inner rod coupling 118/618 is spaced away from the uphole shoulder 117*a* of the outer drill rod 114, and in other examples, the outer rod interfacing surface 163 of inner rod coupling 118/618 is contacting the uphole shoulder 117*a* of the outer drill rod 114. Therefore, to accommodate this relative positioning, the sub saver 300 includes the sub saver spring 314 that allows the sub saver 300 to attach to both the inner and outer drill rods 116, 114 of the drill rod assembly 106 regardless of their relative positioning. Further, this relative movement aids in preventing damage to drill rod assembly 106, specifically the inner drill rod 116 and the inner rod coupling 118/618.

Similar to each drill rod assembly 106, in some examples, the sub saver 300 includes an inner flow path 307 and an annular flow path 305. The inner flow path 307 is disposed along the axis 303 of the sub saver 300 within the inner assembly 301. The annular flow path 305 is configured to be disposed between the inner assembly 301 and the outer rod member 308. In some examples, the sub saver 300 can just include an annular flow path 305 and no inner flow path 307.

Figure 67:
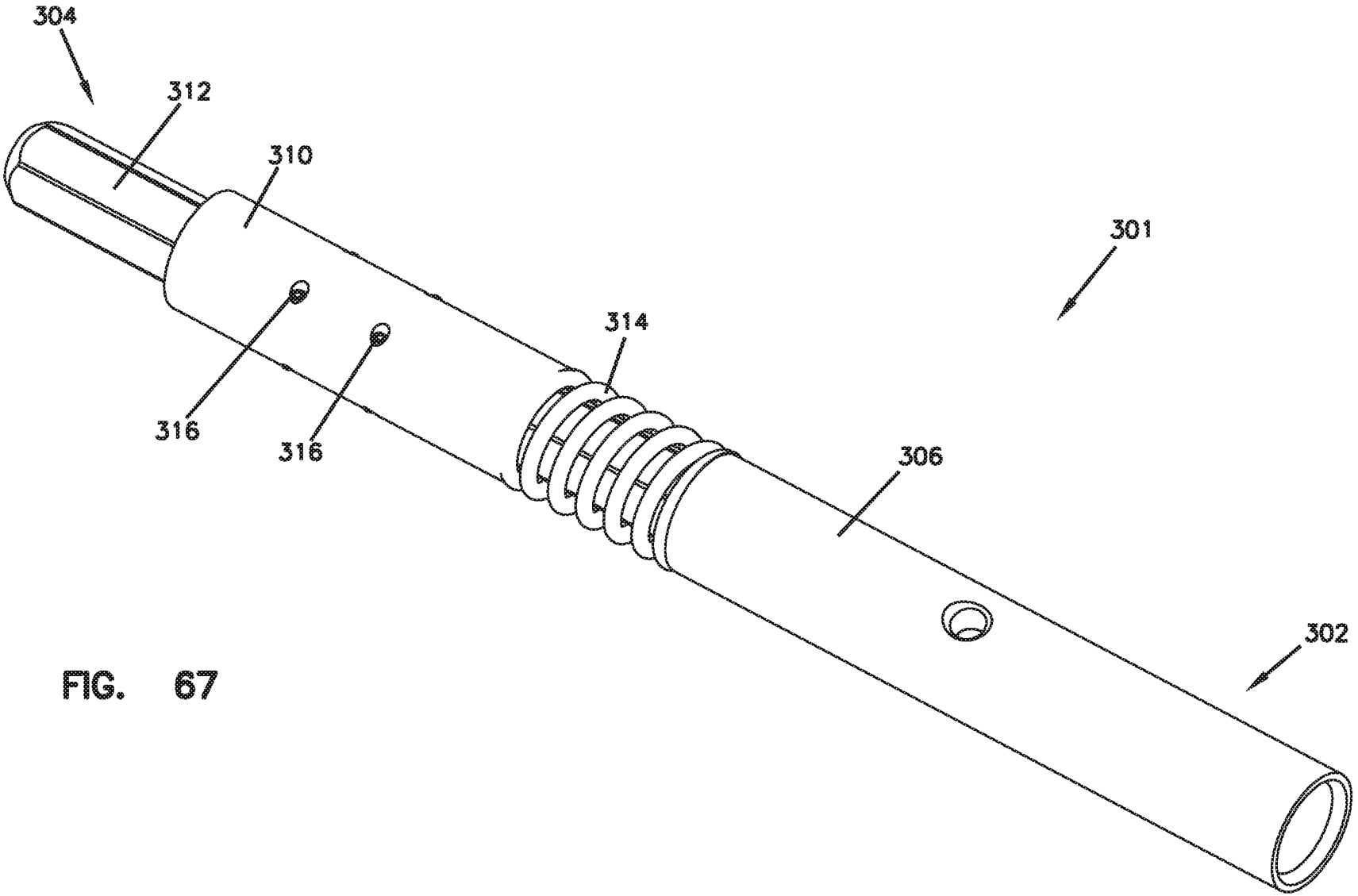
FIG. 67 illustrates a perspective view of an inner assembly of a sub saver, according to one embodiment of the present disclosure.
Figure 68:
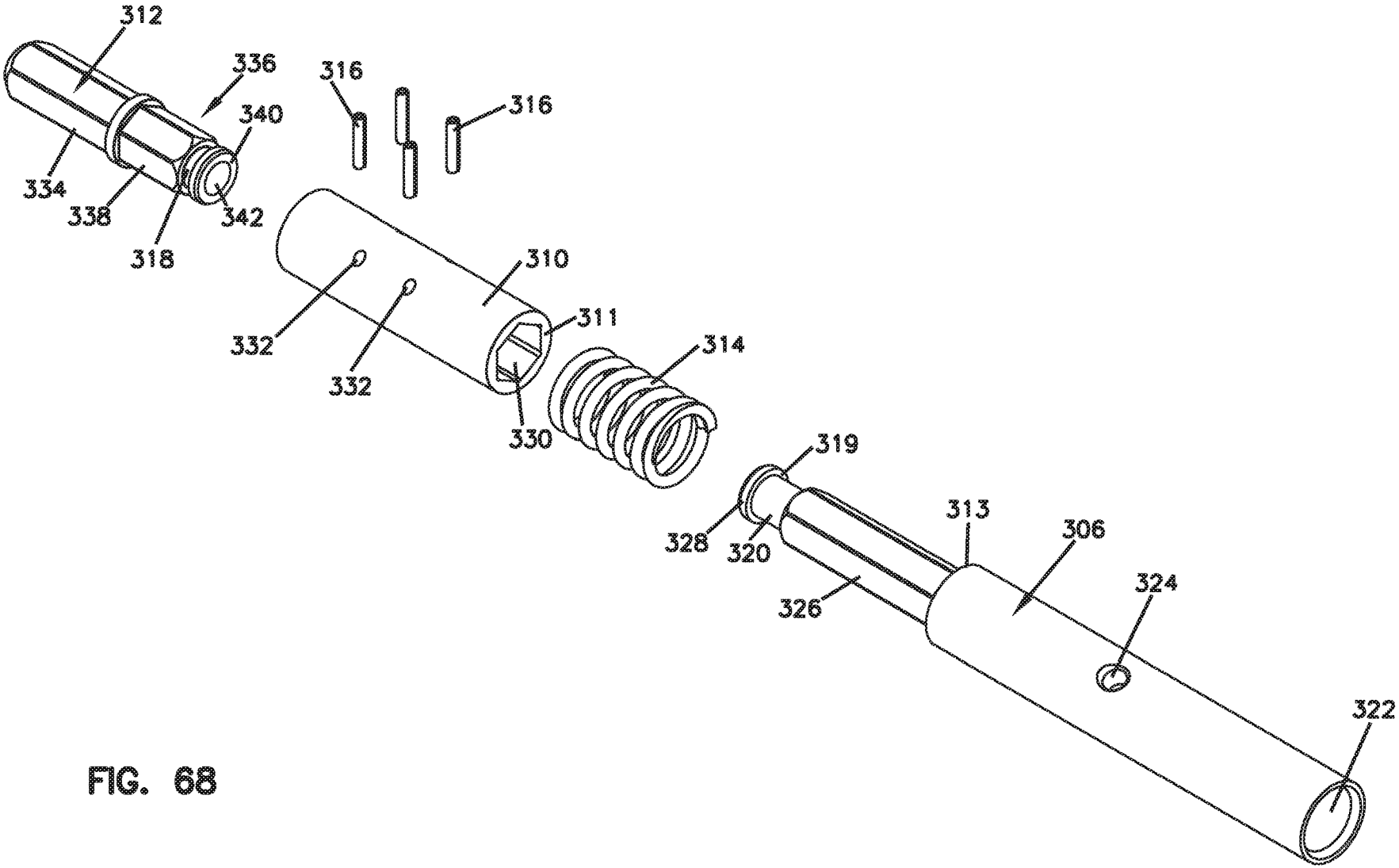
FIG. 68 illustrates an exploded view of the inner assembly of FIG. 67.

FIG. 67 shows a perspective view of the inner assembly 301 of the sub saver 300, and FIG. 68 shows an exploded view of the sub saver 300.

The inner rod member 306 is configured to be attached to an inner drill rod drive shaft assembly 510 of the gearbox 124. The inner rod member 306 includes an axial fluid flow passage 322, a radial fluid flow passage 324, a torque-carrying portion 326, the groove 320, and a non-carrying torque portion 328.

The axial fluid flow passage 322 is configured to allow fluid flow along the axis 303 of the sub saver 300. Further, the axial fluid flow passage 322 can receive fluid from the gearbox 124 and transfer fluid out of the radial fluid passage 324 to the annular fluid flow passage 305 of the sub saver 300.

The inner rod member 306 can include torque transferring features (i.e., the torque-carrying portion 326 and groove 320), in addition to the non-torque-carrying portion 328, that are substantially similar to the features of the inner rod coupling 118. Specifically, the inner rod member 306 can have a polygonal cross-section at the torque-carrying section 326 that is configured to mate with, and be coupled with, the sub saver coupling 310. The torque-carrying section 326 can be of any cross-sectional profile that is configured to transfer torque while minimizing friction and the potential for jamming (e.g., lobes, flat faces, curved faces, etc.). As mentioned above, in some examples, the groove 320 of the inner rod member 306 can have a width G2 that is greater than a width of the pin(s) 316. This allows the sub saver coupling 310 to move axially with respect to the inner rod member 306. The movement of the sub saver coupling 310 with respect to the inner rod member 306 is limited by radial walls 319 of the groove 320. Depending on the axial movement desired, the groove 320 can have a range of widths G2. During movement, the pins 316 slide within the groove 320 while a portion of an inner bore 330 of the sub saver coupling 310 slides freely over the torque-carrying section 326. This allows for a non-binding telescopic connection that can account for relative positioning of the inner and out rods 116, 114 and, due to the configuration of the inner bore 330 of the sub saver coupling 310 and torque-carrying section 326, simultaneously transfer torque.

The sub saver coupling 310 includes the inner bore 330 that is configured to mate with the torque-carrying section 326 of the inner rod member 306 and with the inner rod adapter 312. The sub saver coupling 310 includes a plurality of cross apertures 332, similar to the apertures 135 of the inner rod coupling 118, that are configured to receive the pins 316. Each cross aperture 332 is sized and configured to retain each pin 316 so as to retain the inner rod adapter 312 and inner rod member 306 within the inner bore 330 of the sub saver coupling 310.

The inner rod adapter 312 is configured to interface with an inner rod coupling 118 located on an uphole end 111 of a drill rod assembly 106. Accordingly, the inner rod adapter 312 can have a polygonal cross-section at a first section 334 that mates with the inner bore 133 of the inner rod coupling 118. Further, the inner rod adapter 312 can include a second section 336 that includes a torque-carrying portion 338, the groove 318, and a non-torque-carrying portion 340 that are substantially similar to the features of the inner rod coupling 118. The second section 336 is configured to be retained within the sub saver coupling 310 by at least one pin 316 that captures the groove 318 of the inner rod adapter 312. The inner rod adapter 312 can also include an inner flow path 342 so as to provide fluid flow to the drill string 102. Further, in some examples, the inner rod adapter 312 can be replaced separately from the entire inner assembly 301.

The sub saver spring 314 is configured to interface with the sub saver coupling 310 and be positioned around a portion of the inner rod member 306. Specifically, the sub saver spring 314 is configured to surround a portion of the torque-carrying portion 326 of the inner rod member 306 and be captured between a sub saver coupling face 311 and an inner rod member face 313.

Figure 69:
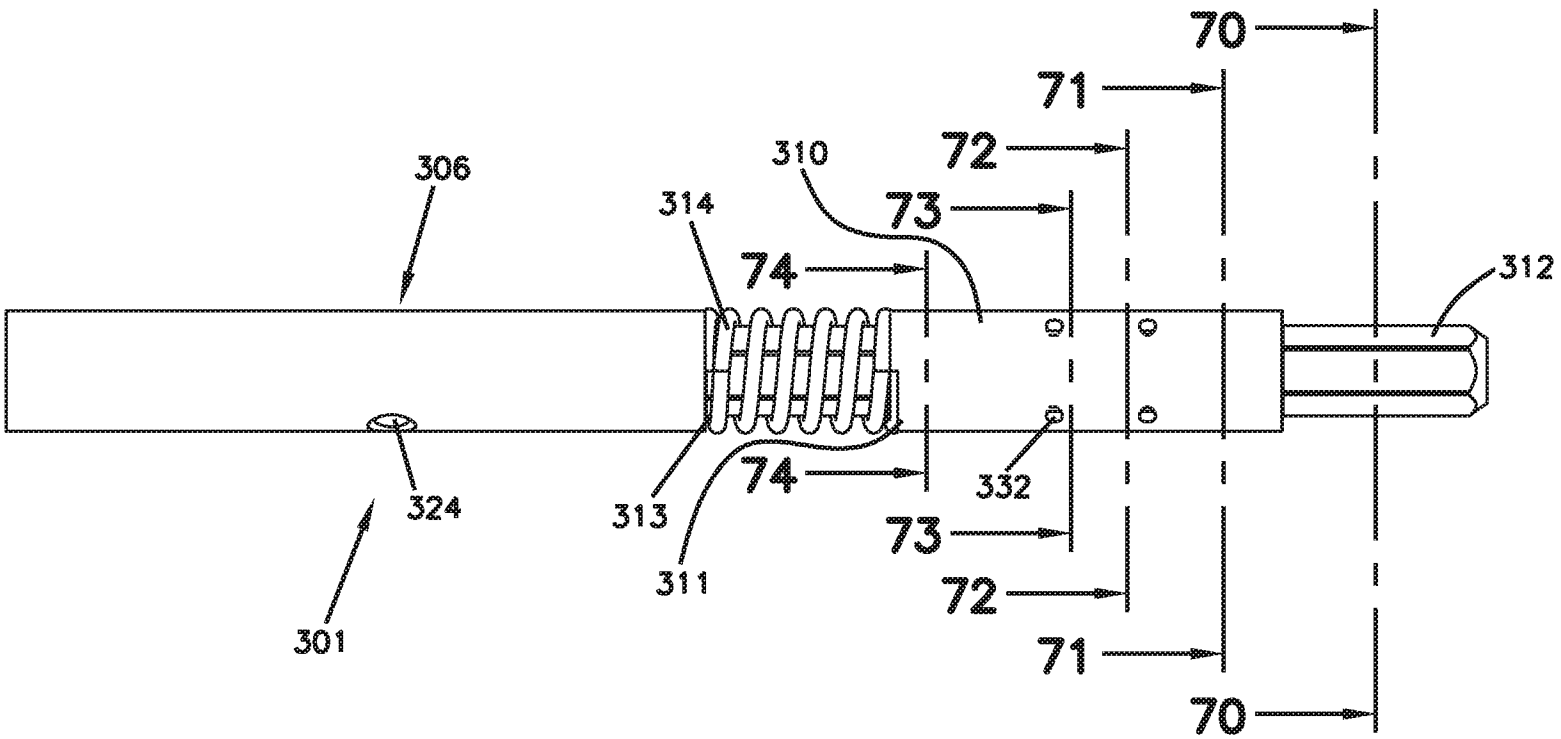
FIG. 69 illustrates a side view of the inner assembly of FIG. 67.

FIG. 69 shows a side view of the inner assembly 301 of the sub saver 300.

Figure 70:
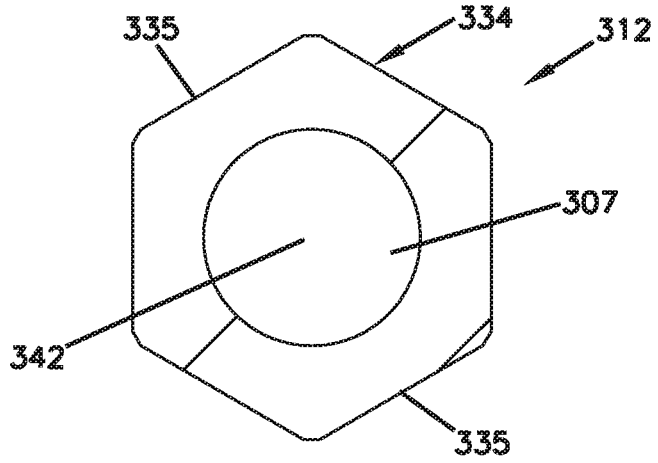
FIG. 70 illustrates a cross-sectional view of the inner assembly of FIG. 69 along line 70-70.

FIG. 70 shows a cross-section of the inner rod adapter 312 taken along line 70-70 in FIG. 69. In the depicted example, the first section 334 of the inner rod adapter 312 has a hexagonal cross-section. However, in other examples, the first section 334 can have a variety of different cross-section shapes.

As noted above, the inner rod adapter 312 is configured to mate with the inner bore 133 of the inner rod coupling 118. Specifically, the first section 334 is configured to slidably mate with the inner bore 133 of the inner rod coupling 118. Because this connection is made by mechanically moving the sub saver 300 into engagement with the inner rod coupling 118 of the drill rod assembly 106, it is advantageous for the first section 334 of the inner rod adapter 312 to be properly mated within the inner bore 133 of the inner rod coupling 118 to prevent potential damage to the inner rod coupling 118 and inner rod adapter 312. To promote this alignment, the first section 334 of the inner rod adapter 312 includes a plurality of faces 335 that are arranged in a polygonal pattern that match the shape of the inner bore 133. In some examples, the faces 335 are flat. In other examples, the faces 335 are rounded. Due to the configuration of the faces 335, the faces 335 facilitate torque transfer while minimizing the chance of misalignment within the inner rod coupling 118 by allowing for a sliding connection with the inner bore 133 of the inner rod coupling 118. The faces 355 result in a simplified construction that is resistant to damage. For example, even if the faces 335 are partially deformed (i.e., by accident, by wear, etc.) proper alignment with the inner bore 133 of the inner rod coupling 118 can still be possible. This is not the case with a more complicated cross-sectional profile where damage to such a profile can result in the inability to mate with a drill rod assembly or result in a jammed connection between the inner rod coupling and the sub saver that can cause damage to the drill rod assembly and/or a sub saver.

Further aiding in aligning the inner rod adapter 312 with the inner bore 133 of the inner rod coupling 118, the inner rod adapter 312 is configured to be spring loaded by way of the sub saver spring 314. Therefore, during engagement, even if the inner rod adapter 312 is misaligned with the inner bore 133 of the inner rod coupling 118, the sub saver spring 314 and the non-binding telescopic movement between the sub saver coupling 310 and the torque-carrying portion 326 of the inner rod member 306 prevents the inner rod adapter 312 from forcibly engaging with the inner rod coupling 118, which could potentially lead to damage of the inner rod coupling 118 and the inner rod adapter 312 of the sub saver 300. Therefore, in some examples, the sub saver spring 314 allows the inner rod adapter 118 to self-align and slidably engage with inner rod adapter 312.

In some examples, at least portions of the faces 335 of the inner rod adapter 312 are heat treated to discourage wear and accidental damage. Further, in other examples still, the inner rod adapter can include a sliding feature (not shown) to promote a telescopic connection. Such a sliding feature can include a coating, treatment, or other material that promotes a low friction connection disposed on the faces 335 of the inner rod adapter 312.

Figure 71:
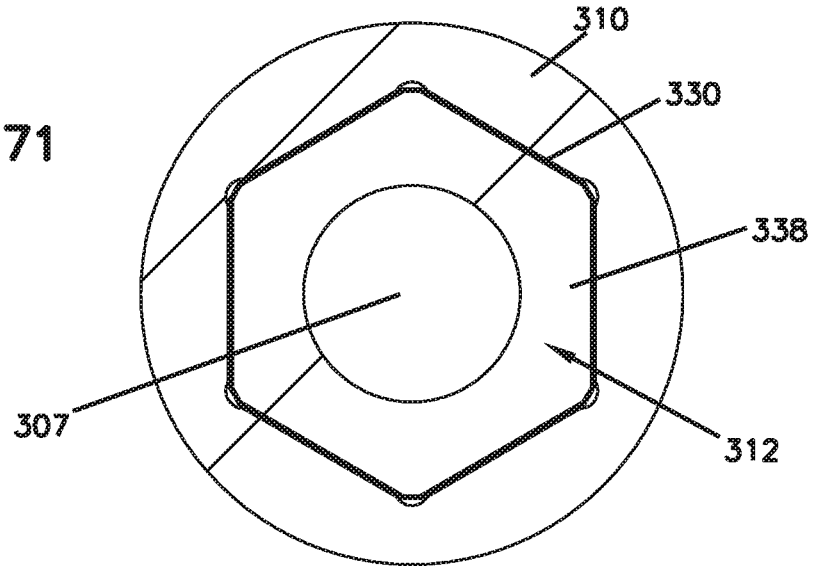
FIG. 71 illustrates a cross-sectional view of the inner assembly of FIG. 69 along line 71-71.

FIG. 71 shows a cross-section of the inner rod adapter 312 and the sub saver coupling 310 taken along line 71-71 in FIG. 69. The torque-carrying portion 338 is shown to be mated with the inner bore 330 of the sub saver coupling 310. Such mating allows torque to be transferred from the sub saver coupling 310 to the inner rod adapter 312. The torque-carrying portion 338 can form any cross-sectional profile that is configured to transfer torque while minimizing friction and the potential for jamming (e.g., lobes, flat faces, curved faces, etc.).

Figure 72:
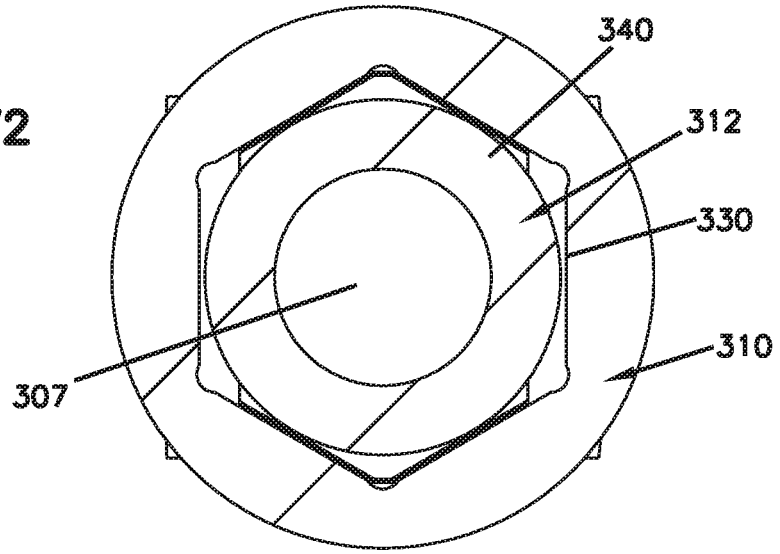
FIG. 72 illustrates a cross-sectional view of the inner assembly of FIG. 69 along line 72-72.

FIG. 72 shows a cross-section of the inner rod adapter 312 and the sub saver coupling 310 taken along line 72-72 in FIG. 69. As shown, the non-torque-carrying portion 340 does not engage the inner bore 330 of the sub saver coupling 310.

Figure 73:
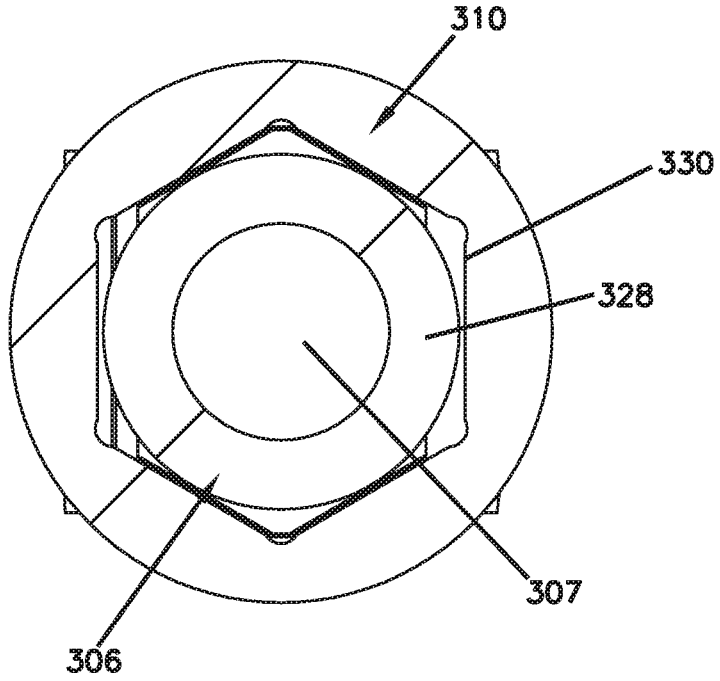
FIG. 73 illustrates a cross-sectional view of the inner assembly of FIG. 69 along line 73-73.

FIG. 73 shows a cross-section of the inner rod member 306 and the sub saver coupling 310 taken along line 73-73 in FIG. 69. Similar to the non-torque-carrying portion 340 of the inner rod adapter 312, the non-torque-carrying portion 328 of the inner rod member 306 does not engage with the inner bore 330 of the sub saver coupling 310.

Figure 74:
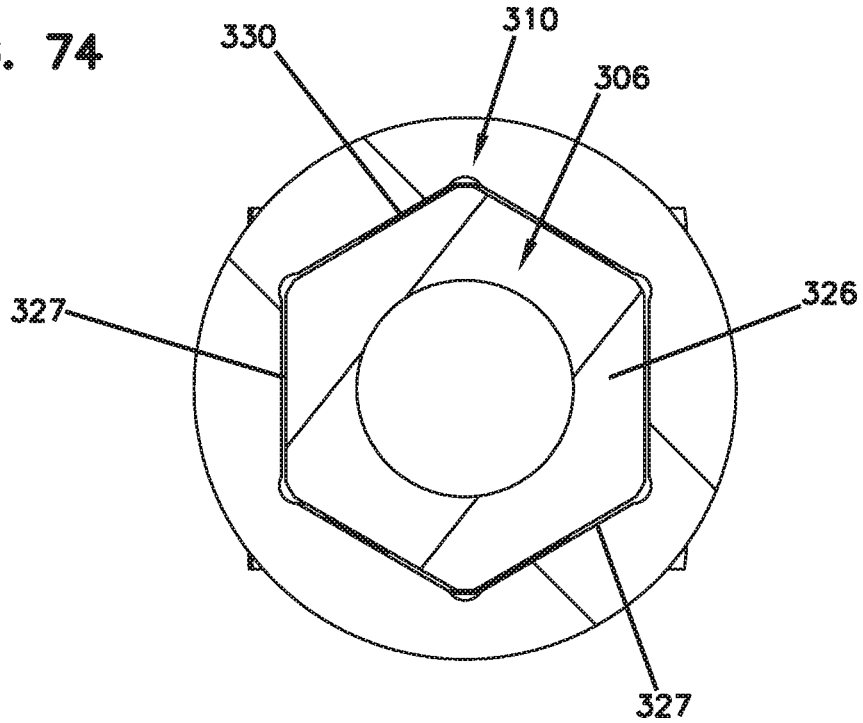
FIG. 74 illustrates a cross-sectional view of the inner assembly of FIG. 69 along line 74-74.

FIG. 74 shows a cross-section of the inner rod member 306 and the sub saver coupling 310 taken along line 74-74 in FIG. 69. Similar to the torque-carrying portion 338 of the inner rod adapter 312, the torque-carrying portion 326 is shown to be mated with the inner bore 330 of the sub saver coupling 310. Such mating allows torque to be transferred from the inner rod member 306 to the sub saver coupling 310. In the depicted example, the torque-carrying portion 326 of the inner rod member 306 has a polygonal cross section. In other examples, the torque-carrying portion 326 of the inner rod member 306 has a hexagonal cross-section. However, in other examples still, the torque-carrying portion 326 can have a variety of different cross-section shapes.

Like the inner rod adapter 312, the inner rod member 306, specifically the torque-carrying portion 326, has a configuration to facilitate the telescopic connection between the sub saver coupling 310 and the torque carrying portion 326 of the inner rod member 306. Such movement occurs when the inner rod adapter 312 and the sub saver coupling 310 axially move with respect to the inner rod member 306. While the pins 316 of the sub saver coupling 310 are configured to be positioned within, and movable along, the groove 320, the inner bore 330 of the sub saver coupling 310 slides over the torque-carrying portion 326. Specifically, the torque carrying section 326 includes a plurality of faces 327 that are configured to slide smoothly within the inner bore 330 of the inner rod coupling 310. In some examples, the faces 327 are flat. In other examples, the faces 327 are rounded. Due to the configuration of the faces 327, jamming or binding between the inner bore 330 and the torque-carrying portion 326 is minimized. By not binding or jamming, it ensures that the inner rod adapter 312 and sub saver coupling 310 can freely move with respect to the inner rod member 306 when needed. If the connection between the inner rod member 306 and the sub saver coupling 310 were configured in such a way to allow periodic jamming (e.g., a cross-section having a more complicated profile such as a spline), there is a chance that the connection with the inner rod adapter 312 and the inner coupling 118 of a drill rod assembly may be misaligned. Such misalignment could damage the inner rod coupling 118, inner rod adapter 312, and/or portions of the drill rod assembly 106. However, by configuring the inner rod adapter 312 and the inner rod member 306 with torque-carrying portions 338, 326 that are resistant to jamming or binding, the chance of misalignment and subsequent damage to the components is reduced.

In some examples, at least portions of the faces 327 of inner rod member 306 are heat treated to discourage wear and accidental damage. Further, in other examples still, the inner bore 330 of the sub saver coupling 310 and/or the torque carrying section 326 can include a sliding feature (not shown) to promote a telescopic connection. Such a sliding feature can include a coating, treatment, or other material that promotes a low friction connection disposed on or between the sub saver coupling 310 and/or the torque carrying section 326.

Figure 75:
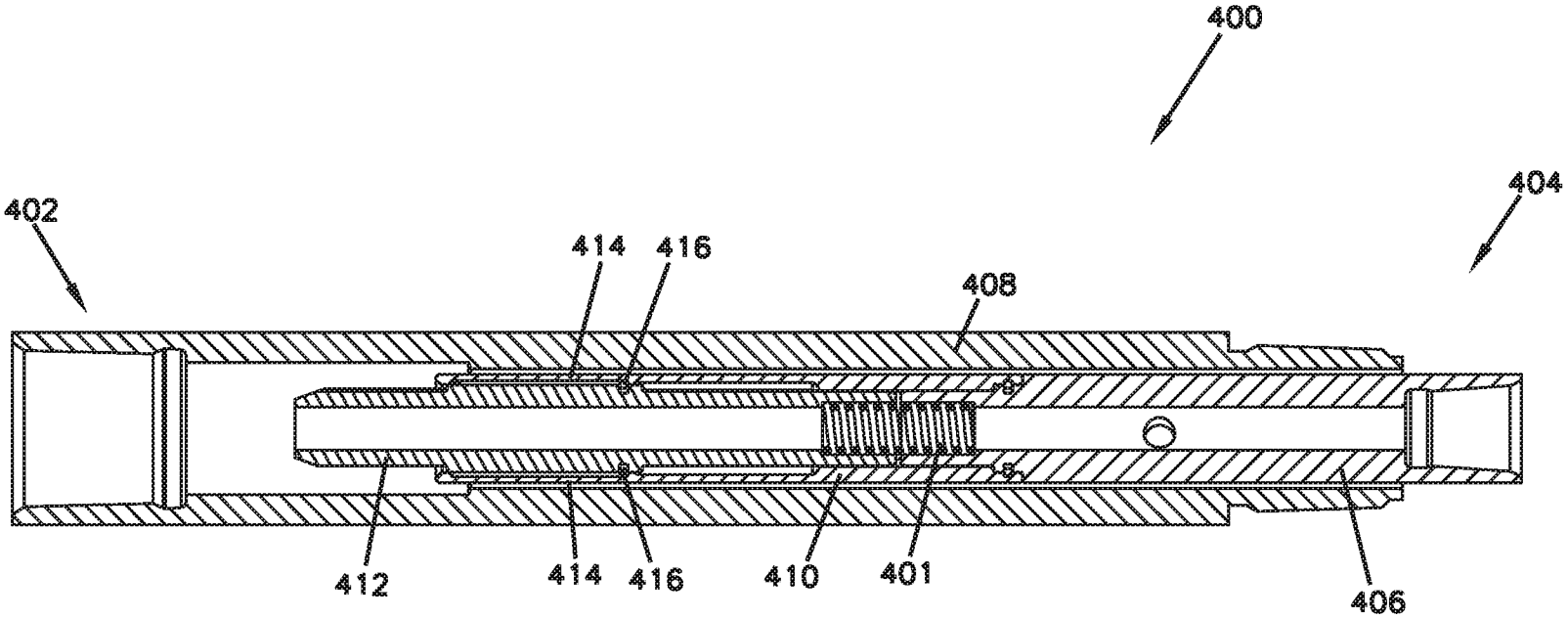
FIG. 75 illustrates a side cross-sectional view of a sub saver, according to one embodiment of the present disclosure.
Figure 76:
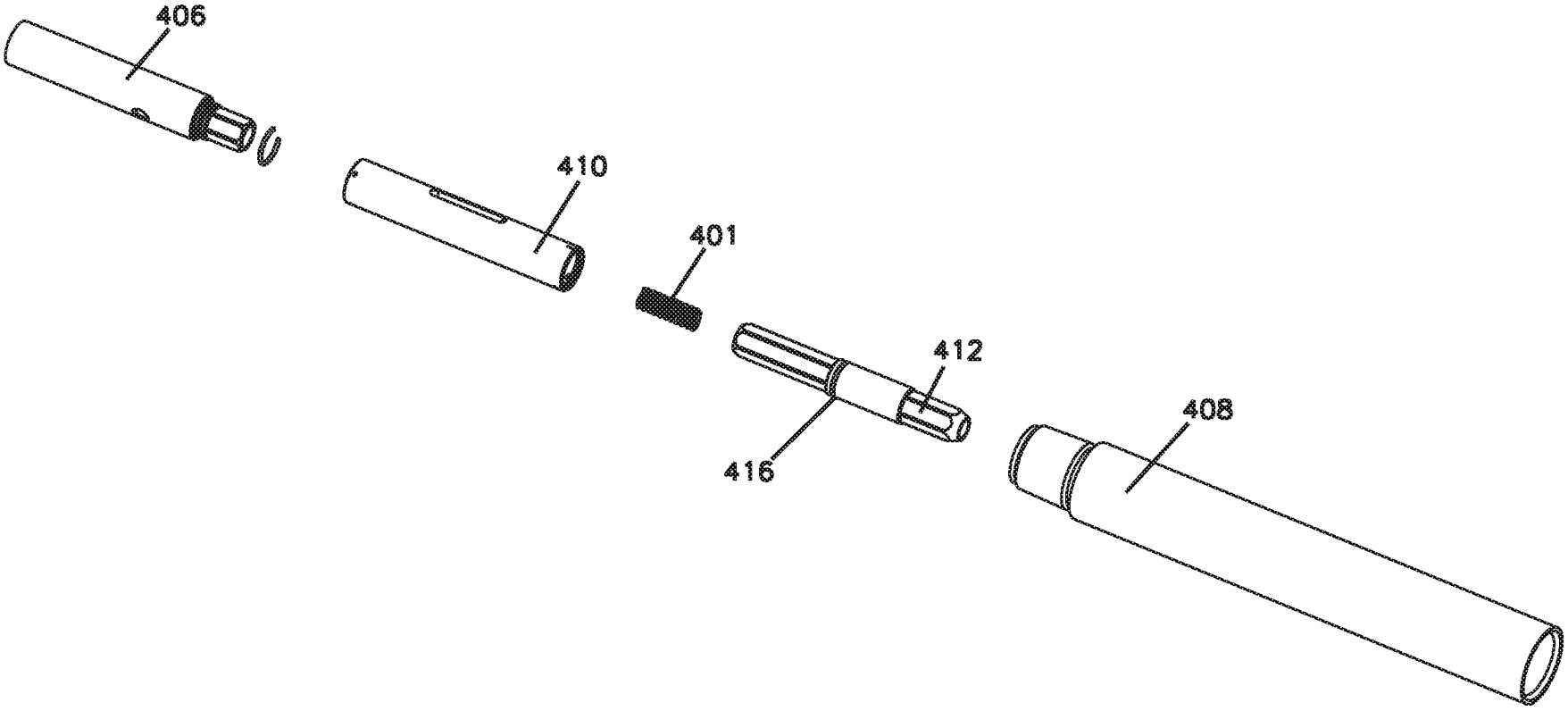
FIG. 76 illustrates an exploded view of the sub saver of FIG. 75.

FIG. 75 shows a longitudinal cross section of a sub saver 400 according to one embodiment of the present disclosure. FIG. 76 shows an exploded view of the sub saver 400.

The sub saver 400 operates in a substantially similar way to the sub saver 300 in that the sub saver 400 is configured to accommodate a range of relative positions between the outer and inner drill rods 114, 116 of the drill rod assembly 106 using a sub saver spring 401. The sub saver 400 is attached at a rear end 402 to the front side 502 of the gearbox 124 and configured to attach to inner and outer drill rods 116, 114 at a front end 404 of the sub saver 400. The sub saver 400 includes an inner rod member 406, an outer rod member 408, a sub saver coupling 410, and an inner rod adapter 412, all of which are substantially similar the components described above with respect to the sub saver 300.

However, in the sub saver 400, the sub saver spring 401 is positioned between and within the inner rod adapter 412 and the inner rod member 406. Such positioning allows for the spring-loaded relative movement of the inner rod adapter 412 with respect to the inner rod member 406 so that the inner rod adapter is biased to a first position. The first position is a position of the inner rod adapter 412 in which there is no force exerted by the inner rod adapter 412 on the sub saver spring 401 by an inner drill rod 116. When a force is received by the inner rod adapter, the inner rod adapter 414 can compress the spring 401 as needed to accommodate the relative positioning of the outer and inner rods 114, 116 of the drill rod assembly 106. Accordingly, the inner rod adapter 412 can be positioned in any position between the first position and a position where the spring 401 is completely compressed.

The inner rod adapter 412 is slidably mated within the sub saver coupling 410 while the inner rod member 406 is fixedly mounted to the inner rod coupling 410. To accommodate differing relative positioning of the outer and inner rods 114, 116, the inner rod adapter 412 can slide within a recess 414 defined within the sub saver coupling 410. The inner rod adapter 412 can be retained within the recess 414 using a variety of different methods. In one example, the inner rod adapter 412 can be retained within the recess 414 using a retainer ring 416. In other examples, the inner rod adapter 412 can be retained within the recess 414 using a single pin, or a plurality of pins (not shown).

Figure 77:
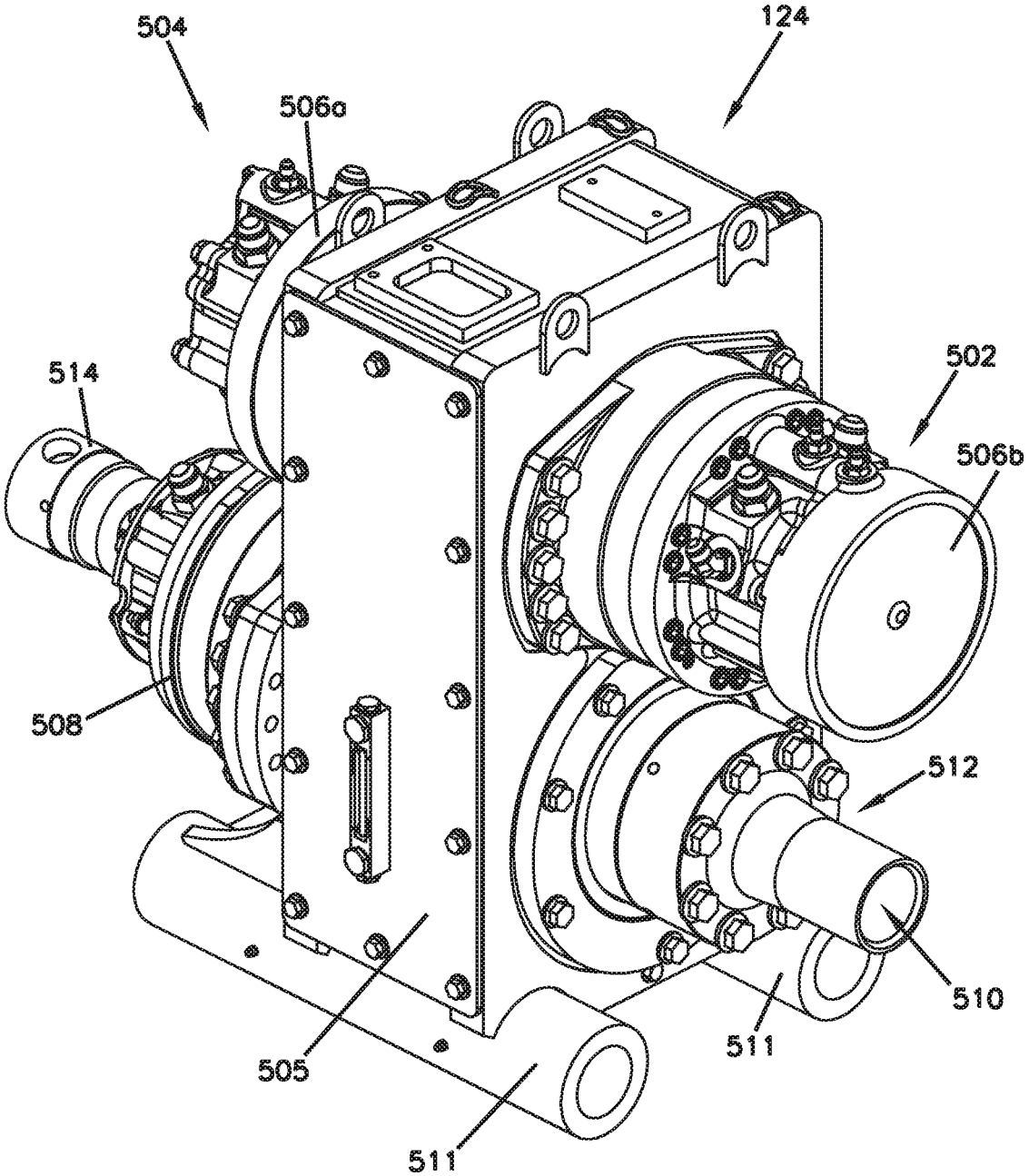
FIG. 77 illustrates a perspective view of a gearbox, according to one embodiment of the present disclosure.
Figure 78:
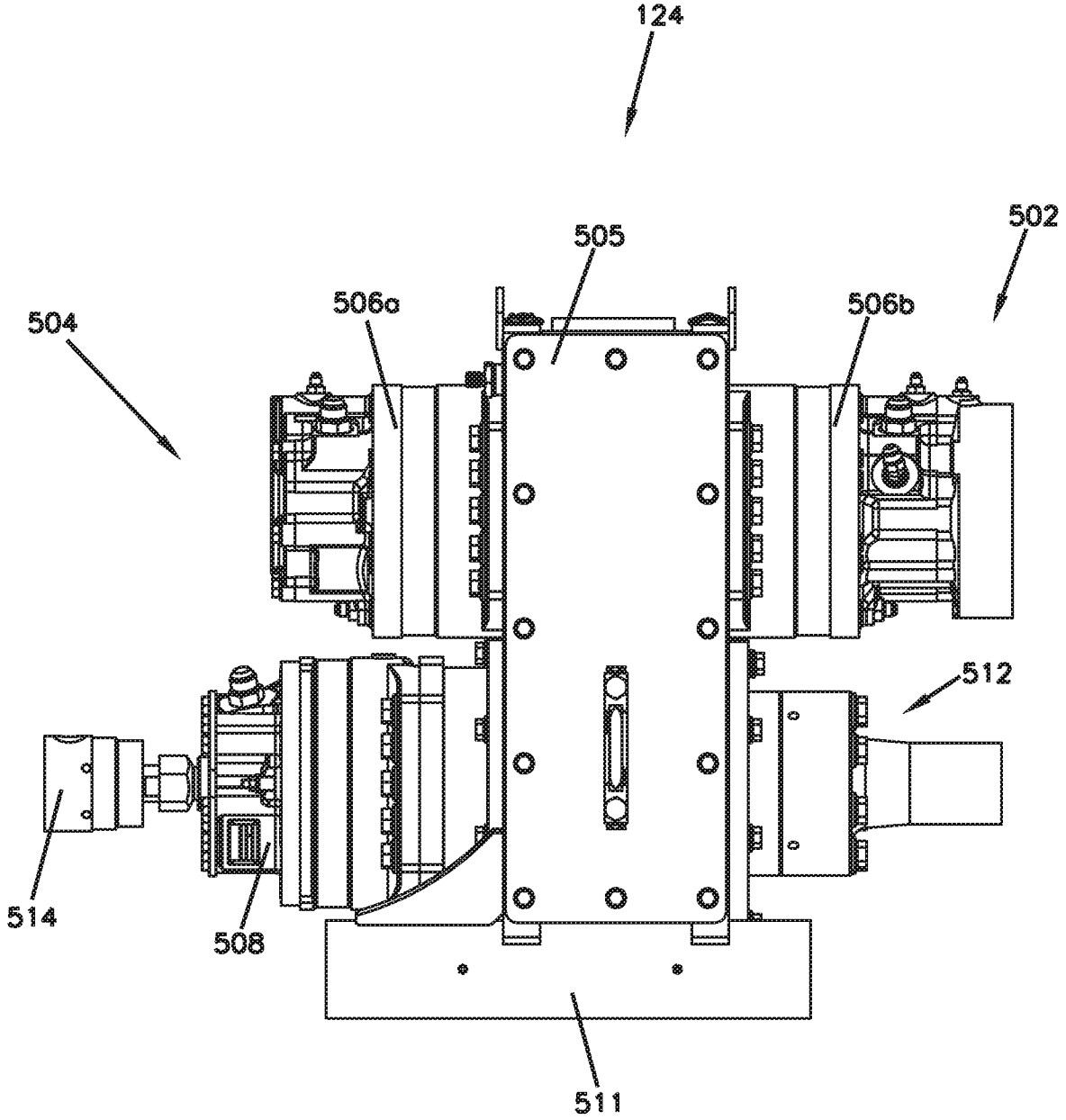
FIG. 78 illustrates a side view of the gearbox of FIG. 77.

FIG. 77 is a perspective view of the gearbox 124, and FIG. 78 shows a side view of the gearbox 124. As described above, the gearbox 124 is positioned on the rack 126 and configured to engage and rotate each drill rod assembly 106 about their respective longitudinal axis and further couple each drill rod assembly 106 with an immediately preceding downhole drill rod assembly 106.

When driving drilling rod assemblies into the ground, the gearbox 124 is configured to travel toward the break out mechanism 128 while pushing the drill rod assemblies 106 into the ground. Simultaneously, the gearbox 124 is configured to selectively drive (i.e., rotate) both the outer and inner drill rods 114, 116 of the drill rod assembly 106.

When pulling drill rod assemblies 106 from the ground, the gearbox 124 is configured to move on the rack 126 away from the break out mechanism 128 while simultaneous selectively rotating the outer and inner rods 114, 116 of the drill rod assemblies 106.

The gearbox includes a front 502, a rear 504, a housing 505, at least one outer drill rod drive motor 506, an inner drill rod drive motor 508, an inner drill rod drive shaft assembly 510 (i.e., an inner rod drive shaft) and an outer drill rod drive shaft assembly 512 (i.e., an outer rod drive shaft). Further, the gearbox 124 includes attachment features 511 that are configured to mount the gearbox 124 to the rack 126.

The gearbox 124 is configured to drive (i.e., rotate) the drill rod assemblies 106 at the front end 502 of the gearbox 124, and is also configured to receive drilling fluid via a fluid swivel 514 at the rear 504 of the gearbox 124, which will be described in more detail below.

The outer and inner drill rod drive motors 506, 508 can be hydraulic motors that are configured to be operated using an on-board hydraulic system (not shown) of the drilling machine 104. In some examples, the gearbox 124 utilizes two outer drill rod drive motors 506*a*, 506*b* and a single inner drill rod drive motor 508.

The outer drill rod drive motors 506, together, are configured to drive the rotation of the outer drill rod drive shaft assembly 512, thereby driving the outer drill rod 114 of the drill rod assembly 106, and thereby driving all coupled outer drill rods of the drill string 102.

The inner drill rod drive motor 508 is configured to drive the rotation of the inner drill rod drive shaft assembly 510, thereby driving the inner drill rod 116 of a drill rod assembly 106, and thereby driving all of the coupled inner drill rods 116 of the drill string 102. Further, in some examples, the inner drill rods 116 are connected to the drive shaft 150 of the drill head 110 and, therefore, the inner drill rod drive motor 508 is configured to drive the rotation of the drill bit shaft 142 and the drill bit 140.

In some examples, the gearbox 124 is configured so that no relative axial movement between the inner drill rod drive shaft assembly 510 and the outer drill rod drive shaft assembly 510 is allowed.

Figure 79:
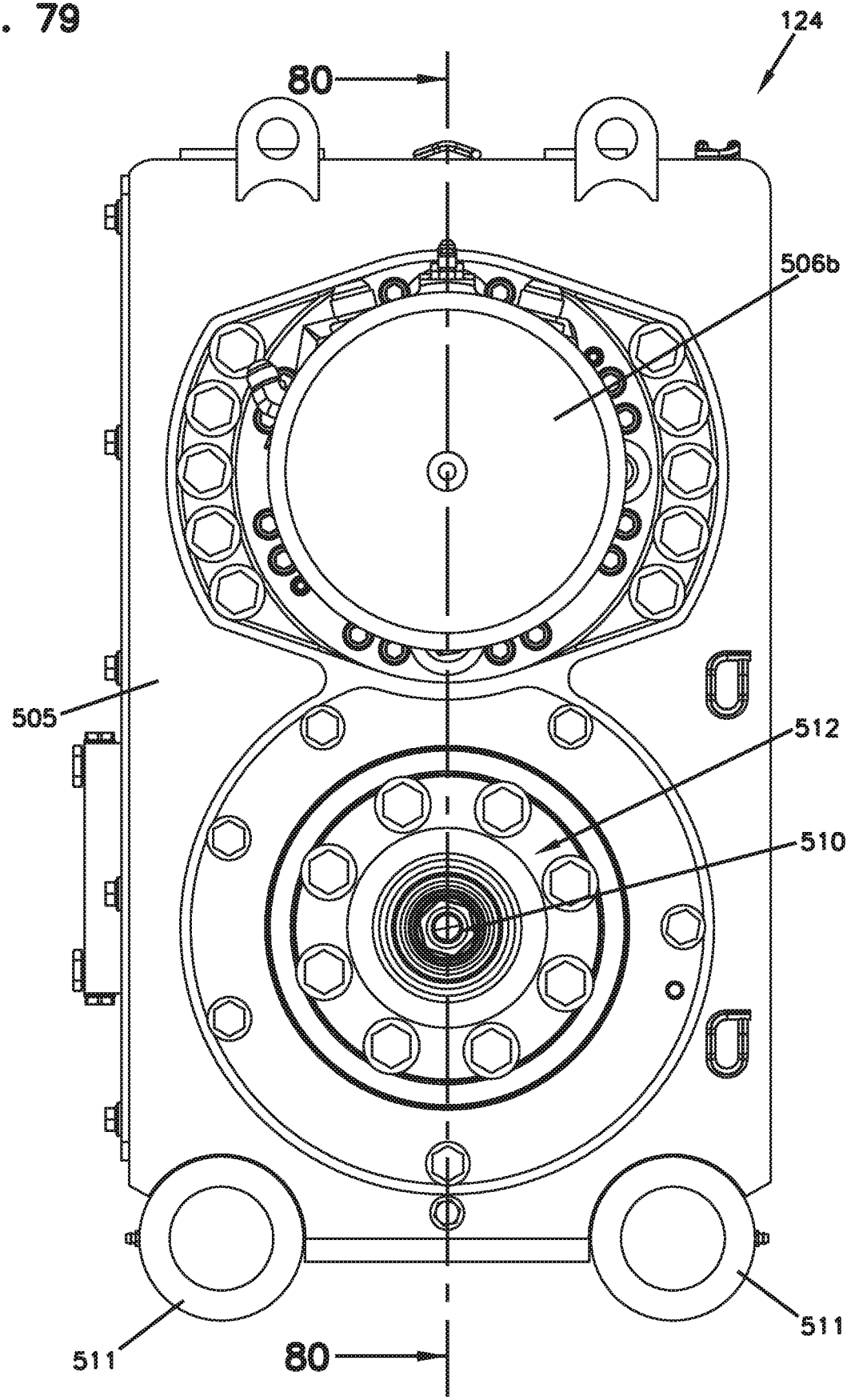
FIG. 79 illustrates a front view of the gearbox of FIG. 77.
Figure 80:
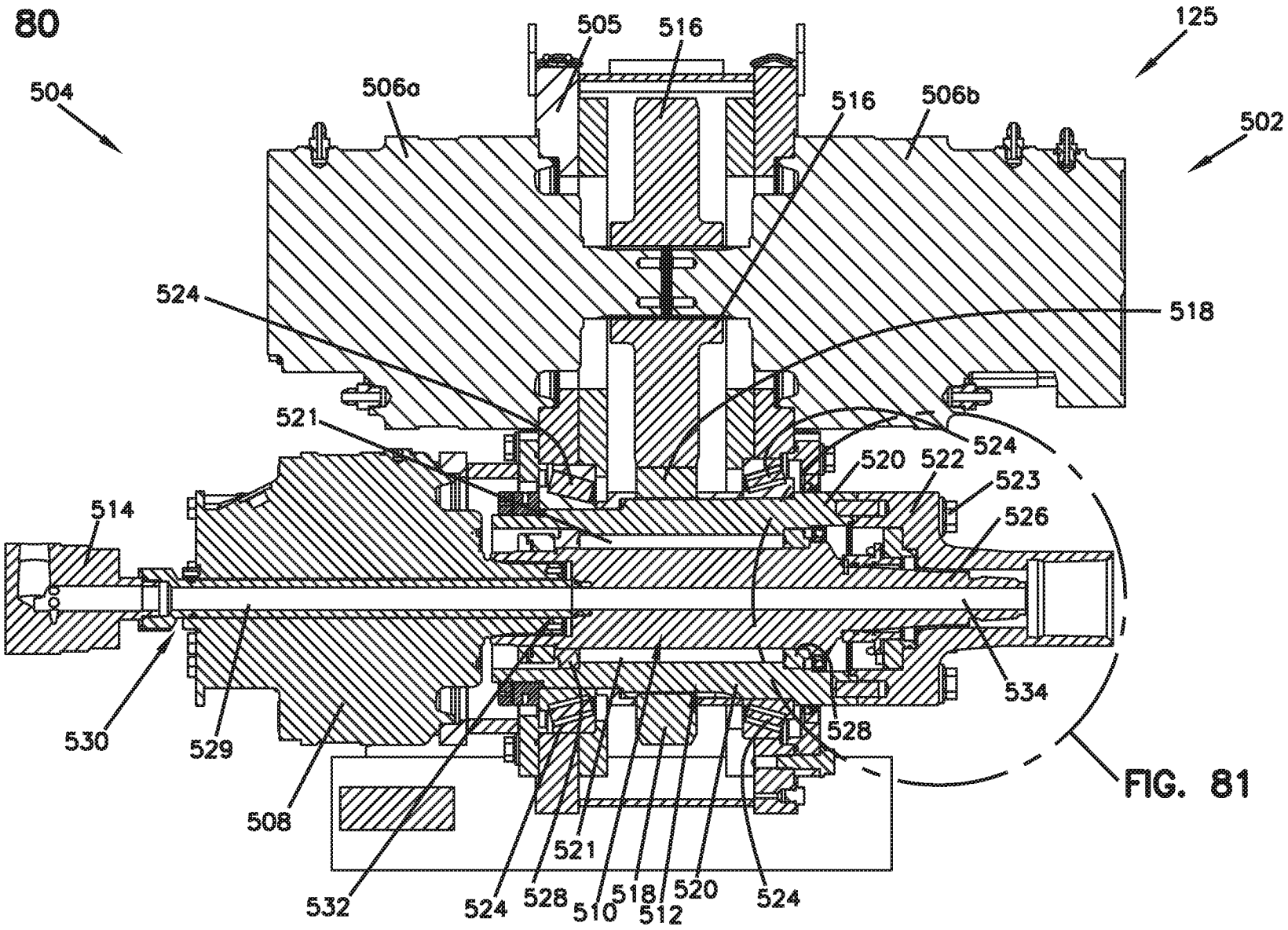
FIG. 80 illustrates a side cross-sectional view of the gearbox of FIG. 79 along line 80-80.

FIG. 79 shows a front view of the gearbox 124, and FIG. 80 shows a cross-section of the gearbox 124 along line 80-80 of FIG. 79.

The outer drill rod drive motors 506 are configured to drive a pair of gears 516 and 518. These components are configured to provide rotational drive torque to the outer drill rod drive shaft assembly 512. Specifically, power is transferred from the motors 508, to the gear 516, to the gear 518, to an outer drill rod head shaft 520, and then to an outer drill rod drive chuck 522.

The outer drill rod head shaft 520 is configured to be substantially contained and supported within the housing 505 of the gearbox 124. Specifically, the outer drill rod head shaft 520 is configured to be in communication with a gearbox lubricating fluid (e.g., oil) contained within an internal cavity 521 of the housing 505. Further, a pair of bearings 524 are configured to support the outer drill rod head shaft 520 within the housing 505.

The outer drill rod drive chuck 522 is configured to be removably coupled to the outer drill rod head shaft 520 at the front end 502 of the gearbox 124. The outer drill rod drive chuck 522 is further configured to couple to the end of an outer member of the drill string 102. In some examples, the outer drill rod drive chuck 522 is coupled to the outer drill rod head shaft 520 by a plurality of fastener 523. In some examples, the outer drill rod drive chuck 522 is configured to be further coupled directly to an outer drill rod 114 of a drill rod assembly 106. In other examples still, the outer drill rod drive chuck 522 is configured to be threaded directly to an outer rod member 308/408 of the sub saver 300/400.

The inner drill rod drive motor 508 is positioned at the rear 504 of the gearbox 124. The inner drill rod drive motor 508 is configured to directly provide rotational drive torque to the inner drill rod drive shaft assembly 510. Specifically, power is transferred from the inner drill rod drive motor 508 to an inner drill rod head shaft 526 and then to an inner member of the drill string 102. In some examples, the inner drill rod head shaft 526 is configured to be coupled to an inner rod member 306/406 of the sub saver 300/400. In other examples, the inner drill rod head shaft 526 can be directly coupled to an inner drill rod 116 of a drill rod assembly 106.

In some examples, the inner drill rod head shaft 526 can be supported within the housing 505 by a pair of bearings 528. Further, like the outer drill rod head shaft 520, the inner drill rod head shaft 526 is configured to be in communication with a gearbox lubricating fluid (e.g., oil) contained within the internal cavity 521 of the housing 505.

The inner drill rod drive motor 508 also includes an axial drilling fluid passage 529 that is generally axially aligned with the inner drill rod head shaft 526. The axial drilling fluid passage 529 is defined by the motor 508 and configured to receive drilling fluid at a first end 530 from a drilling fluid source (not shown) via the fluid swivel 514. The axial drilling fluid passage 529 then delivers the drilling fluid to the inner drill rod head shaft 526 at a second end 532 of the axial drilling fluid passage 529. Specifically, the inner drill rod head shaft 526 receives the drilling fluid at a head shaft axial drilling fluid passage 534 that is isolated from the inner cavity 521 of the housing 505. The inner drill rod head shaft 526 then delivers the drilling fluid to the inner drill rod of the drill string 102. In some examples, drilling fluid is delivered from the inner drill rod head shaft 526 to the inner flow path 307 of the sub saver 300. In some examples, the drilling fluid is delivered from the inner drill rod head shaft 526 to the axial fluid flow passage 322 of the inner rod member 306 of the sub saver 300.

The fluid swivel 514 is configured to deliver drilling fluid to the axial drilling fluid passage 529 of the inner drill rod drive motor 508. In some examples, the fluid swivel 514 can be connected to a drilling fluid pump (not shown) which is connected to a drilling fluid reservoir (not shown). In some examples, the fluid swivel 514 is configured to freely rotate about an axis 536 so as to accommodate the movement of the gearbox 124. In some examples, the fluid swivel can be removably installed to the inner drill rod drive motor 508.

Figure 81:
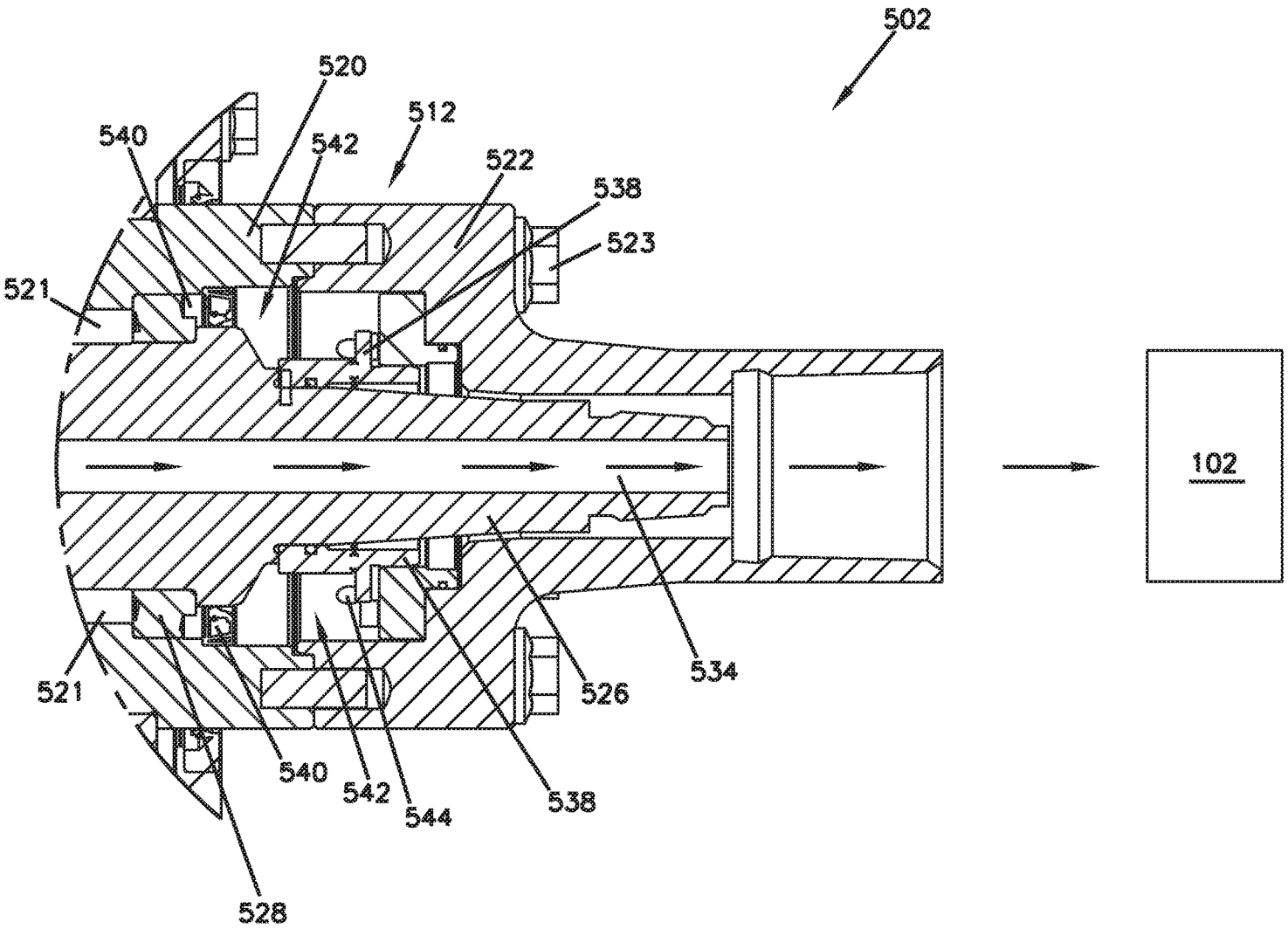
FIG. 81 illustrates a zoomed-in cross-sectional side view of the gearbox of FIG. 80.

FIG. 81 shows a zoomed-in view of the front 502 of the gearbox 124 of the longitudinal cross-section section in FIG. 80. The gearbox 124 further includes a drilling fluid seal 538, an oil seal 540, a weep cavity 542, and at least one weep indicator 544.

In order to prevent drilling fluid contained within the drill string 102 from entering back into the gearbox 124, specifically the cavity 521, the gearbox 124 includes the drilling fluid seal 538 that is positioned between the inner drill rod drive shaft assembly 510 and the outer drill rod drive shaft assembly 512. Specifically, the drilling fluid seal 538 is positioned between the inner drill rod head shaft 526 and the outer drill rod drive chuck 522. The fluid seal 538 can be a variety of different types of seals. In one example, the seal 538 is a ceramic seal. In some examples, the drilling fluid seal can be positioned between the inner drill rod drive shaft assembly 510 and the outer drill rod drive shaft assembly 512 where it can be easily accessed for maintenance. As shown, to access the seal 538, an operator must only remove the outer drill rod drive chuck 522.

Conversely, in order to prevent oil from entering into the drill string from the cavity 521 of the housing 505 of the gearbox 124, the gearbox 124 includes the oil seal 540 positioned within the housing 505, between the inner drill rod drive shaft assembly 510 and the outer drill rod drive shaft assembly 512. Specifically, the oil seal 540 is positioned between the outer drill rod head shaft 520 and the inner drill rod head shaft 526. Therefore, in some examples, the oil seal 540 is positioned closer the rear 504 of the gearbox 124. Such positioning of the oil seal 540 allows the outer drill rod drive chuck 522 to be removed from the outer drill rod head shaft 520 without having to drain the oil from the cavity 521. This arrangement eases maintenance.

The gearbox 124 further defines the weep cavity 542. The weep cavity 542 is defined between the inner drill rod drive shaft assembly 510, the outer drill rod drive shaft assembly 512, the drilling fluid seal 538, and the oil seal 540. During normal proper operation, the weep cavity 542 contains no oil and no drilling fluid, thanks to the oil seal 540 and the drilling fluid seal 538. However, if either the oil seal 540 or the drilling fluid seal 538 malfunctions, the weep cavity 542 is configured to receive any fluid that escapes either seal 540, 538.

In some examples, the weep indicator 544 is configured to indicate when fluid is present within the weep cavity 542. In some examples, the weep indicator 544 is a sensor disposed within the weep cavity 542. In other examples still, the weep indicator 544 is a passage defined in the outer drill rod drive shaft assembly 512. Further, in some examples, the weep cavity 542 can be vented to atmospheric pressure by way of the at least one weep indicator 544. Because drilling fluid within the housing 505 of the gearbox 124 can damage components quickly and oil within the drill string 102 is not preferred, the weep cavity 542 and weep indicator 544 allow for an indication of such a malfunction so that the operator can cease operation before damage is done to the components of the drilling system 100.

Figure 82:
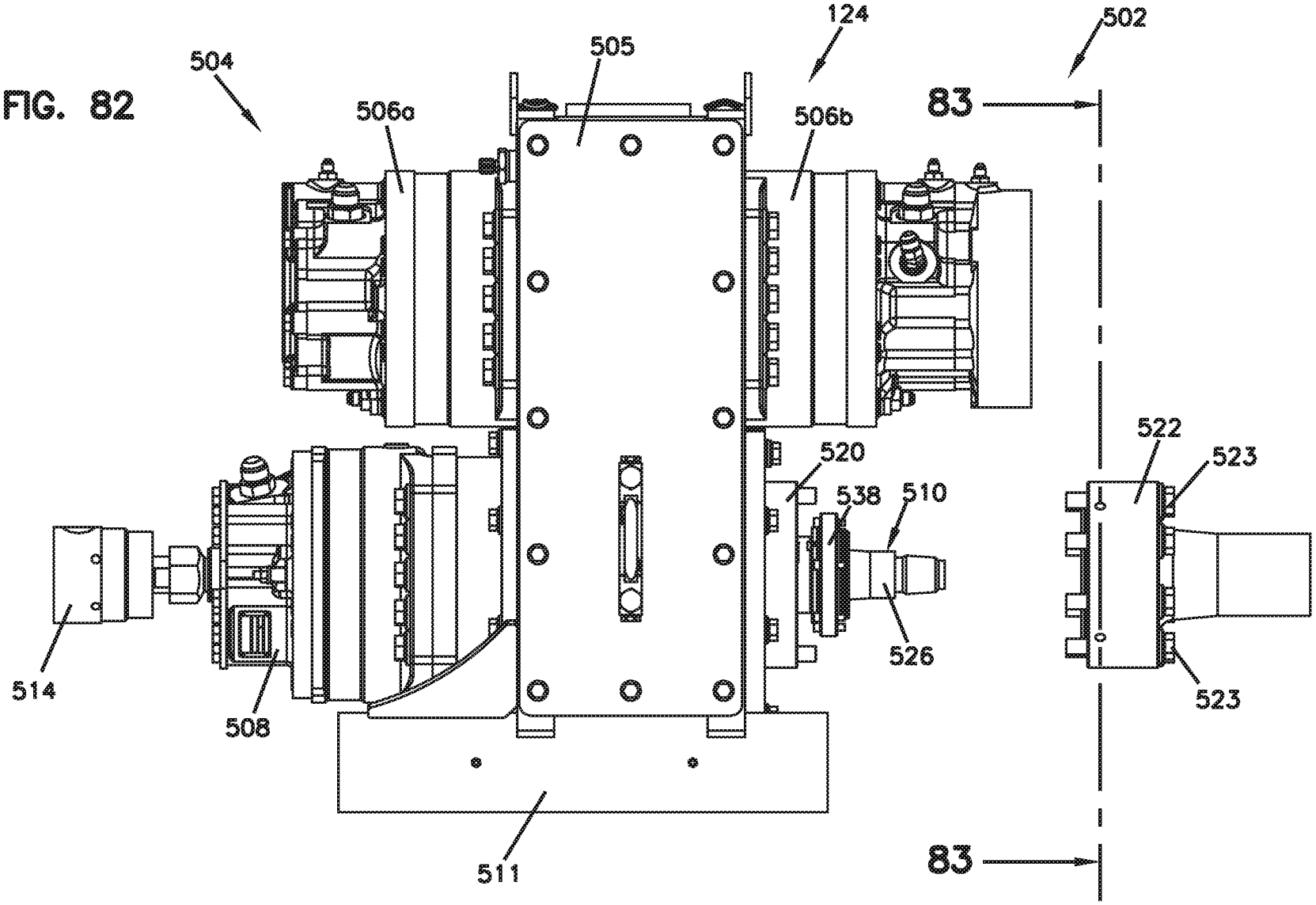
FIG. 82 illustrates a side view of the gearbox of FIG. 77 with an outer drill rod drive chuck decoupled.

FIG. 82 shows a side view of the gearbox 124 with the outer drill rod drive chuck 522 removed. In the depicted example, once the outer drill rod drive chuck 522 is removed, the drilling fluid seal 538 remains positioned around the inner drill rod head shaft 526. In some examples, the drilling fluid seal 538 separates into two halves, one that attaches to the inner drill rod head shaft 526 and one that attaches to the outer drill rod drive chuck 522.

Figure 83:
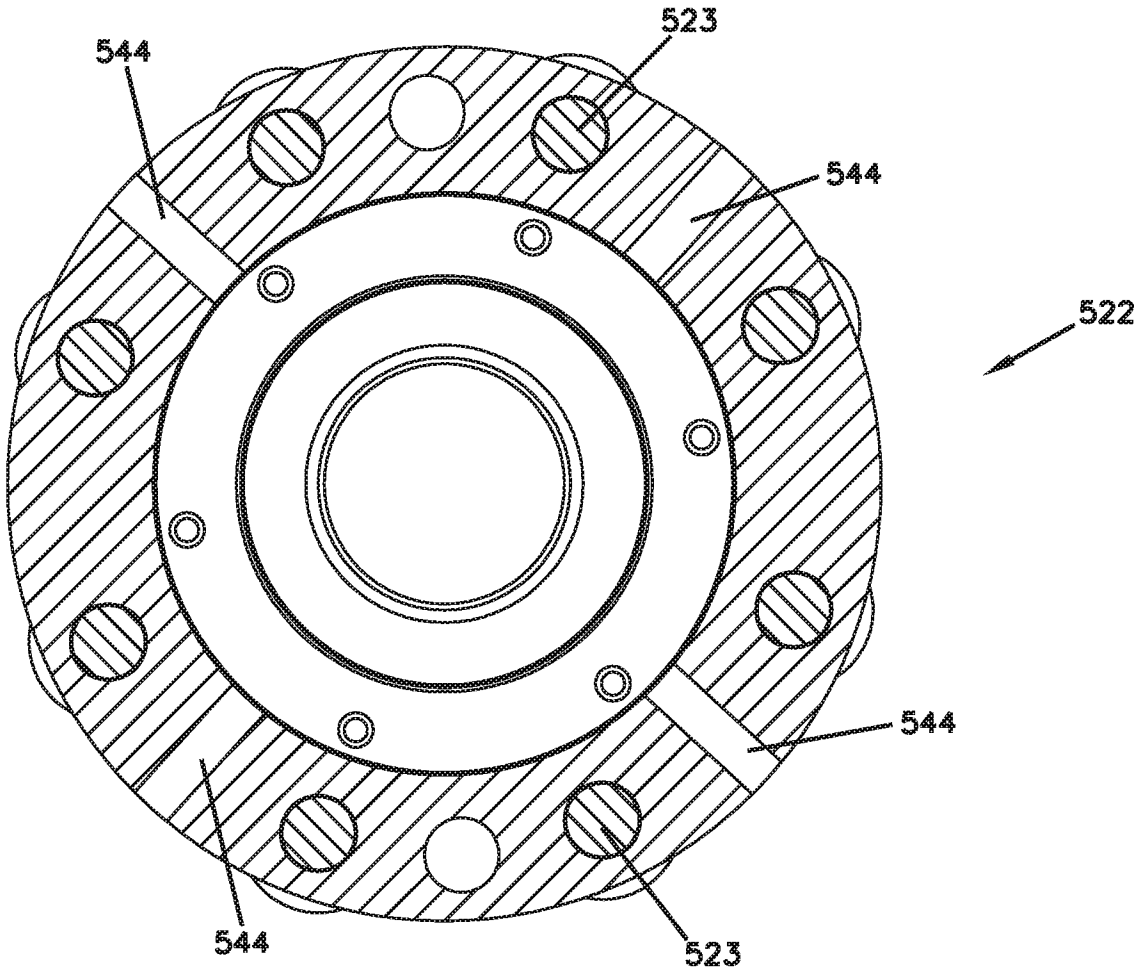
FIG. 83 illustrates a side cross-sectional view of the outer drill rod drive chuck of FIG. 82 along line 83-83.

FIG. 83 shows a cross-section of the outer drill rod drive chuck 522 taken along line 83-83 in FIG. 82. In the depicted example, the outer drill rod drive chuck 522 includes a plurality of weep indicators 544. As shown, the weep indicators 544 are radial weep passages positioned around a periphery of the outer drill rod drive chuck 522. The weep passages 544 allow for any leaked fluid (e.g., oil or drilling fluid) that enters the weep cavity 542 to escape the weep cavity 542, thereby providing a visual indication to the operator that a malfunction has occurred. In other examples, the weep indicators 544 can be disposed in the outer drill rod head shaft 520 in addition to, or in replacement of, the outer drill rod drive chuck 522.

The process of driving the drill rod assemblies 106 into the ground requires control of the gearbox 124 to perform a number of steps. In one example, some of these steps are performed automatically by the controller 550 (shown in FIG. 2), while in other examples, all of these steps are performed automatically by the controller 550.

First, when the gearbox 124 has reached its most downhole position on the rack 126, the break out mechanism 128 clamps the drill string 102, and the gearbox 124 can uncouple to move back uphole along the rack 126. The step of uncoupling requires the outer drill rod drive shaft assembly 512 to rotate in a reverse direction as it unthreads from the outer rod 114 of the drill string 102, while at the same time the gearbox 124 has to move uphole on the rack 126 to separate from the drill string 102. During this process, the inner drill rod drive shaft assembly 510 simultaneously slides out of engagement with the inner rod 116 of the drill string 102. In one example of this step, the controller 550 automatically applies oscillating, relatively low torque to the inner drill rod drive shaft assembly 510, specifically the inner rod head shaft 526, whenever the break out mechanism 128 is clamped onto the drill string 106, and the control signal (e.g. generated from the controller 550 via the controls 552 or automatically generated from the controller 550) for the outer drill rod drive shaft assembly 512 is operated to rotate in a reverse direction, or the control signal (e.g. generated from the controller 550 via the controls 552 or automatically generated from the controller 550) to move the gearbox 124 along the rack 126 is operated to move uphole. In one example, the oscillating torque is limited to a maximum of 150 ft-lbs.

Once the gearbox 124 has reached its most uphole position on the rack 126, a singular drill rod assembly 106 is positioned (e.g., by a rod loader assembly mechanism, not shown) into alignment with the drill string 102 and the gearbox 124. The gearbox 124 is then moved downhole and into engagement with the singular drill rod 106, including coupling of the outer drill rod drive shaft assembly 512 and the outer rod 114 and simultaneous coupling of the inner drill rod drive shaft assembly 510 and the inner rod 116. In one example of this step, the controller 550 automatically applies an oscillating, relatively low torque to the inner drill rod drive shaft assembly 510, specifically the inner rod head shaft 526, whenever the break out mechanism 128 is clamped onto the drill string 102, and the control signal (e.g. generated from the controller 550 via the controls 552 or automatically generated from the controller 550) for the outer drill rod drive shaft assembly 512 is operated to rotate in a forward direction, or the control signal (e.g. generated from the controller 550 via the controls 552 or automatically generated from the controller 550) to move the gearbox 124 along the rack 126 is operated to move downhole. The controller 550 may also include closed loop control wherein the movement of the inner drill rod drive shaft assembly 510 is measured to ensure that the inner drill rod drive shaft assembly 510, specifically the inner rod head shaft 526, oscillates through a total angle range of 120 degrees, plus or minus 60 degrees, during this step. In one example, the oscillating torque is limited to a maximum of 150 ft-lbs.

Once the gearbox 124 is coupled to the singular rod 106, the gearbox 124 continues to move downhole on the rack 126 pushing the singular rod 106 into engagement with the drill string 102. Engaging the singular rod 106 with the drill string 102 requires the outer rods 116 to thread together while the inner rods 114 couple simultaneously. In one example of this step, the controller 550 automatically applies an oscillating, relatively low torque to the inner drill rod drive shaft assembly 510, specifically the inner rod head shaft 526, whenever the break out mechanism 128 is clamped onto the drill string 102, and the control signal (e.g. generated from the controller 550 via the controls 552 or automatically generated from the controller 550) for outer drill rod drive shaft assembly 512 is operated to rotate in a forward direction, or the control signal (e.g. generated from the controller 550 via the controls 552 or automatically generated from the controller 550) to move the gearbox 124 along the rack 126 is operated to move downhole. The controller 550 may also include closed loop control wherein the movement of the inner drill rod drive shaft assembly 510, specifically the inner rod head shaft 526, is measured to insure that the inner rod head shaft 526 oscillates through a total angle of 120 degrees, plus or minus 60 degrees, during this step. In one example, the oscillating torque is limited to a maximum of 150 ft-lbs.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

We claim:

1. A dual rod drill rod for a dual rod drilling system having a drill string extending from an above ground drilling machine to a downhole drilling tool, the drill string being formed by a plurality of dual rod drill rods joined end-to-end, the dual rod drill rod comprising:

a tubular outer rod including internal threads on a first end having a first shoulder, and external threads on a second, opposite end having a second shoulder;

an inner rod within the tubular outer rod, the inner rod including a first end having a torque-carrying section; and a flow collar having an outer rod interfacing surface; and a second end having a torque-carrying section; and a groove;

an inner rod coupling having an inner bore and defining a longitudinal axis, the inner rod coupling including a first end in which the inner bore has a non-circular profile receiving the torque-carrying section of the second end of the inner rod;

a second end in which the inner bore has a non-circular profile configured to mate with a torque-carrying section of a first end of an adjacent inner rod of the drill string;

a cross aperture perpendicular to the longitudinal axis and offset to a side of the longitudinal axis; and a retention pin held within the cross aperture of the inner rod coupling and positioned within the groove in the second end of the inner rod; and a flow sleeve on the second end of the inner rod and having an outer rod interfacing surface;

wherein the inner rod is retained within the outer rod by the flow collar interfacing with the first shoulder of the outer rod, and by the flow sleeve interfacing with the second shoulder of the outer rod.

2. The dual rod drill rod of claim 1, wherein the groove has a width larger than a width of the retention pin, and wherein the inner rod coupling and the inner rod are axially movable with respect to one another.

3. The dual rod drill rod of claim 1, wherein the flow sleeve engages the inner rod coupling, and includes at least one fluid flow passage.

4. The dual rod drill rod of claim 3, wherein the flow sleeve is positioned around an exterior surface of the inner rod coupling.

5. The dual rod drill rod of claim 3, wherein the flow sleeve includes a plurality of fluid flow passages positioned circumferentially about an exterior surface of the flow sleeve.

6. The dual rod drill rod of claim 1, wherein the inner rod includes an inner bore aligned with the inner bore of the inner rod coupling, and wherein the retention pin does not extend into the inner bore of the inner rod.

7. The dual rod drill rod of claim 1, wherein an annular fluid flow passage is defined between the inner rod and the outer rod.

8. The dual rod drill rod of claim 7, wherein the flow collar includes at least one peripheral fluid passage that allows fluid flow therethrough, wherein the at least one peripheral fluid passage of the flow collar is positioned within the annular fluid flow passage between the inner rod and the outer rod.

9. The dual rod drill rod of claim 1, wherein the outer rod interfacing surface of the flow collar is a continuous annular surface configured to contact the first shoulder, and wherein the outer rod interfacing surface of the flow sleeve is a continuous annular surface configured to contact the second shoulder.

10. The dual rod drill rod of claim 1, wherein an axis of the cross aperture is nonintersecting with the longitudinal axis.

11. The dual rod drill rod of claim 1, wherein the groove extends circumferentially about an entire circumference of the inner rod.

12. The dual rod drill rod of claim 1, wherein the cross aperture is a first cross aperture, the inner rod coupling further comprising a second cross aperture that is perpendicular to the longitudinal axis and spaced on an opposite side of the longitudinal axis from the first cross aperture; and wherein the retention pin is a first retention pin positioned within the first cross aperture, the dual rod drill rod further comprising a second retention pin positioned within the second cross aperture of the inner rod coupling and within the groove of the inner rod.

13. The dual rod drill rod of claim 1, wherein the second end of the inner rod further comprises a non-torque-carrying section having a cross-sectional width smaller than a cross-sectional width of the inner bore at the first end of the inner rod coupling, and wherein the groove is positioned between the non-torque-carrying section and the torque-carrying section of second end of the inner rod.

14. The dual rod drill rod of claim 1, wherein the groove is spaced from an end face of the inner rod and adjacent the torque-carrying section of the second end.

15. The dual rod drill rod of claim 1, wherein the groove is defined in part by a radially-innermost groove surface that is cylindrical and co-axial with the longitudinal axis of the inner rod coupling.

16. A dual rod drill rod for a dual rod drilling system having a drill string extending from an above ground drilling machine to a downhole drilling tool, the drill string being formed by a plurality of dual rod drill rods joined end-to-end, the dual rod drill rod comprising:

a tubular outer rod including internal threads on a first end having a first shoulder, and external threads on a second, opposite end having a second shoulder;

an inner rod within the tubular outer rod such that an annular fluid flow passage is defined between the inner rod and the outer rod, the inner rod including a first end having a torque-carrying section; and a flow collar having an outer rod interfacing surface, and having and at least one fluid flow passage; and a second end having a torque-carrying section; and a groove that extends circumferentially about an entire circumference of the inner rod, the groove being spaced from an end face of the inner rod and adjacent the torque-carrying section of the second end;

an inner rod coupling having an inner bore and defining a longitudinal axis, the inner rod coupling including a first end in which the inner bore has a non-circular profile receiving the torque-carrying section of the second end of the inner rod;

a second end in which the inner bore has a non-circular profile configured to mate with a torque-carrying section of a first end of an adjacent inner rod of the drill string;

a first cross aperture perpendicular to the longitudinal axis and offset to a first side of the longitudinal axis;

a second cross aperture perpendicular to the longitudinal axis and offset to a second side of the longitudinal axis;

a first retention pin held within the first cross aperture of the inner rod coupling and positioned within the groove in the second end of the inner rod; and a second retention pin held within the second cross aperture of the inner rod coupling and positioned within the groove in the second end of the inner rod; and a flow sleeve on the second end of the inner rod, the flow sleeve having an outer rod interfacing surface and at least one fluid flow passage;

wherein the inner rod is retained within the outer rod by the flow collar interfacing with the first shoulder of the outer rod and by the flow sleeve interfacing with the second shoulder of the outer rod.

17. The dual rod drill rod of claim 16, wherein the groove is defined in part by a radially-innermost groove surface that is cylindrical and co-axial with the longitudinal axis of the inner rod coupling.

18. The dual rod drill rod of claim 16, wherein the outer rod interfacing surface of the flow collar is a continuous annular surface configured to contact the first shoulder, and wherein the outer rod interfacing surface of the flow sleeve is a continuous annular surface configured to contact the second shoulder.

19. The dual rod drill rod of claim 16, wherein the flow sleeve engages the inner rod coupling.

20. The dual rod drill rod of claim 16, wherein the flow sleeve is positioned around an exterior surface of the inner rod coupling.

* * * * *